US009622623B2

(12) United States Patent
Kee et al.

(10) Patent No.: US 9,622,623 B2
(45) Date of Patent: Apr. 18, 2017

(54) ENCLOSURE SYSTEMS

(76) Inventors: Christopher Marshal Kee, Glendora, CA (US); Michael Henry Clark, Alta Loma, CA (US); Michael John Guidos, Lake Arrowhead, CA (US)

( * ) Notice: Subject to any disclaimer, the term of this patent is extended or adjusted under 35 U.S.C. 154(b) by 1199 days.

(21) Appl. No.: 13/552,603

(22) Filed: Jul. 18, 2012

(65) Prior Publication Data

US 2013/0019396 A1 Jan. 24, 2013

Related U.S. Application Data

(60) Provisional application No. 61/509,561, filed on Jul. 19, 2011.

(51) Int. Cl.
*A47K 3/00* (2006.01)
*A47K 3/34* (2006.01)

(52) U.S. Cl.
CPC ..... *A47K 3/34* (2013.01)

(58) Field of Classification Search
CPC ..... A47K 3/283; A47K 3/34; A47K 3/38
USPC ..... 4/614, 610, 607
See application file for complete search history.

(56) References Cited

U.S. PATENT DOCUMENTS

| | | | |
|---|---|---|---|
| 1,656,410 | A | 1/1928 | Baer et al. |
| 1,781,692 | A | 11/1930 | Lewis |
| 1,854,443 | A | 4/1932 | Barce |
| 1,873,424 | A | 8/1932 | Kerr et al. |
| 2,394,667 | A | 2/1946 | Dailey |
| 2,610,367 | A | 9/1952 | Nordahl |
| 2,677,268 | A | 5/1954 | Hobbs |
| D175,684 | S | 9/1955 | Kellogg |
| 2,761,150 | A | 9/1956 | Kellogg |
| 2,815,543 | A | 12/1957 | Gates |
| 2,897,515 | A | 8/1959 | Collins |
| 2,980,969 | A | 4/1961 | Tinfow |
| 3,037,555 | A | 6/1962 | Kochanowski |
| 3,102,581 | A | 9/1963 | Kochanowski |
| 3,335,784 | A | 8/1967 | Risk et al. |
| 3,418,666 | A | 12/1968 | Rockey |
| 3,422,464 | A | 1/1969 | O'Brien |
| 3,562,956 | A | 2/1971 | Johnson, Jr. |
| 3,744,827 | A | 7/1973 | Cox |
| 3,879,912 | A | 4/1975 | Cox |
| 3,942,197 | A | 3/1976 | Sudmann et al. |
| 4,014,377 | A | 3/1977 | Kochanowski |
| 4,014,378 | A | 3/1977 | Kochanowski |
| 4,060,267 | A | 11/1977 | Monfardini |

(Continued)

FOREIGN PATENT DOCUMENTS

| | | |
|---|---|---|
| GB | 2182085 | 5/1987 |

OTHER PUBLICATIONS

USPTO Office Action From U.S. Appl. No. 12/831,199, filed Jul. 6, 2010; Office action date: Mar. 27, 2014.

(Continued)

*Primary Examiner* — Huyen Le
(74) *Attorney, Agent, or Firm* — Peter Ganjian; Patent Law Agency, LLC

(57) ABSTRACT

An enclosure, comprising a sill that includes a drainage system having a spill channel that has a first barrier and a second barrier, with the second barrier positioned below the spill channel and facing a lower distal end of an exterior side of a stationary panel. The enclosure further provides set of hinge and distal rollers for maximum articulation of non-stationary panels without much encroachment into a closed space.

22 Claims, 61 Drawing Sheets

(56) References Cited

U.S. PATENT DOCUMENTS

| | | | |
|---|---|---|---|
| 4,089,135 | A | 5/1978 | Beny et al. |
| 4,115,900 | A | 9/1978 | Mihalcheon |
| 4,152,789 | A | 5/1979 | Heath |
| 4,256,164 | A | 3/1981 | Agcaoili |
| 4,316,295 | A | 2/1982 | Whitney et al. |
| 4,458,449 | A | 7/1984 | Breuer |
| 4,473,911 | A | 10/1984 | Germain |
| 4,480,862 | A | 11/1984 | Fleming |
| 4,484,411 | A | 11/1984 | Rystad |
| 4,653,127 | A | 3/1987 | Baus |
| 4,671,026 | A | 6/1987 | Wissinger |
| 4,769,862 | A | 9/1988 | Skrzelowski |
| 4,807,312 | A | 2/1989 | Baus |
| 4,882,795 | A | 11/1989 | Baus |
| 4,901,380 | A | 2/1990 | Smith |
| 5,083,822 | A | 1/1992 | Mangin et al. |
| 5,103,531 | A | 4/1992 | Perrotta |
| 5,311,707 | A | 5/1994 | LaRoche et al. |
| 5,473,843 | A | 12/1995 | LaRoche et al. |
| 5,622,017 | A | 4/1997 | Lynn et al. |
| 5,657,581 | A | 8/1997 | Husting |
| D397,928 | S | 9/1998 | Wise |
| 5,852,837 | A | 12/1998 | Husting |
| 5,860,264 | A | 1/1999 | Gephart et al. |
| 5,906,403 | A | 5/1999 | Bestlet et al. |
| 5,908,064 | A | 6/1999 | Bruce |
| 6,006,375 | A | 12/1999 | Carr |
| 6,023,794 | A | 2/2000 | Nein |
| 6,023,889 | A | 2/2000 | Husting et al. |
| 6,082,499 | A | 7/2000 | O'Donnell |
| 6,094,757 | A | 8/2000 | Torres |
| 6,109,666 | A | 8/2000 | Collet |
| 6,182,738 | B1 | 2/2001 | Chen |
| 6,216,287 | B1 | 4/2001 | Wise |
| 6,470,511 | B1 | 10/2002 | Smale |
| 6,491,326 | B1 | 12/2002 | Massey et al. |
| 6,691,339 | B1 | 2/2004 | Thomas |
| 6,698,037 | B2 | 3/2004 | Lippe |
| 6,817,144 | B1 | 11/2004 | Tavivian |
| 6,851,133 | B1 | 2/2005 | Nehring |
| 6,990,695 | B2 | 1/2006 | Grayson |
| 7,028,349 | B2 | 4/2006 | Helmetsie et al. |
| 7,174,944 | B1 | 2/2007 | Clark et al. |
| 7,225,480 | B2 | 6/2007 | Mascheron |
| 7,273,084 | B2 | 9/2007 | Chen |
| 7,377,076 | B2 | 5/2008 | Shedd |
| 7,591,492 | B2 | 9/2009 | Nikkhah |
| 7,634,823 | B2 | 12/2009 | Sisk |
| 7,694,358 | B2 | 4/2010 | Stimpson |
| 7,735,795 | B2 | 6/2010 | Wronski |
| 7,761,935 | B1 | 7/2010 | Whitaker |
| 7,849,531 | B2 | 12/2010 | Rooke et al. |
| 7,856,771 | B2 | 12/2010 | Guidos et al. |
| 7,861,761 | B2 | 1/2011 | Martineau et al. |
| 8,037,556 | B2 | 10/2011 | Lock et al. |
| 8,069,506 | B2 | 12/2011 | Hammond |
| 8,151,385 | B2 | 4/2012 | Goskowski et al. |
| 2002/0157325 | A1 | 10/2002 | Domanico |
| 2002/0163203 | A1 | 11/2002 | Donald |
| 2003/0188379 | A1 | 10/2003 | Cowell et al. |
| 2004/0003484 | A1 | 1/2004 | D'Assumcao |
| 2005/0177936 | A1 | 8/2005 | Graells Pane |
| 2008/0047057 | A1 | 2/2008 | Ho |
| 2008/0202056 | A1 | 8/2008 | Jantzen |
| 2008/0250558 | A1 | 10/2008 | Torres |
| 2009/0038070 | A1 | 2/2009 | Belanger et al. |
| 2009/0056077 | A1 | 3/2009 | Belanger et al. |
| 2009/0211175 | A1 | 8/2009 | Guidos |
| 2010/0147042 | A1 | 6/2010 | Chen |
| 2010/0281612 | A1 | 11/2010 | Cook |
| 2010/0293708 | A1 | 11/2010 | Hildebrandt |
| 2011/0005140 | A1 | 1/2011 | Guidos et al. |
| 2011/0083393 | A1 | 4/2011 | Guidos et al. |
| 2011/0094686 | A1 | 4/2011 | Kee et al. |
| 2011/0203046 | A1 | 8/2011 | Donnelly et al. |
| 2011/0283624 | A1 | 11/2011 | Baer |
| 2011/0291848 | A1 | 12/2011 | Burdenko |
| 2012/0023658 | A1 | 2/2012 | Bobeck et al. |
| 2012/0198655 | A1 | 8/2012 | Lapping |

OTHER PUBLICATIONS

USPTO Office Action From U.S. Appl. No. 12/910,740, filed Oct. 22, 2010 With Office Action Date: Mar. 26, 2014.

Photos of rollers.

Photos of enclosures; the photos were taken on Jul. 6, 2011.

Photo of adjustable roller; http://cqyqgd.en.made-in-china.com/.

Photo of broken hinge roller.

Photo of garage door roller; Pub. 2006.

Photo of Roller-Hinge replacement.

USPTO: Office action and file history for U.S. Appl. No. 12/831,199, filed Jul. 6, 2010; Office Action Date: Aug. 8, 2013.

USPTO Office Action for U.S. Appl. No. 12/910,740, filed Oct. 22, 2010; Office Action Date: Oct. 1, 2015.

http://www.raumplusna.com/air ; Sliding door system—AIR product list and system description, including accessories ; 2013.

http://www.contractorswardrobe.com/instructions_all.html ; Door Panel Model #5000-45-45; assembly and installation instructions.

mobilehomepartsstore.com ; Kinro Vinyl Sliding Patio Door; 2002-2012.

USPTO Office Action From U.S. Appl. No. 12/831,199, filed Jul. 6, 2010: Office action date: Mar. 27, 2014.

File History of U.S. Appl. No. 14/629,422, including Office actions May 6, 2015 and.

File History of U.S. Appl. No. 12/910,740, filed Oct. 22, 2010 ; Office Action Date: May 6, 2016.

106b

ENCLOSURE SYSTEMS

CROSS-REFERENCE TO RELATED APPLICATIONS

This application claims the benefit of priority of the U.S. Utility Provisional Patent Application No. 61/509,561, filed 19 Jul. 2011, the entire disclosure of which is expressly incorporated by reference herein.

BACKGROUND OF THE INVENTION

Field of the Invention

This invention relates to enclosures, and more particularly, to enclosure systems with improved leakage prevention, installation, and esthetics.

Description of Related Art

Conventional shower enclosures for a shower area are well known and have been in use for a number of years. Most conventional shower enclosures include a rail system that is attached to a header (top rail) and or a sill (bottom rail). Further included is one or more fixed (stationary) panels that is designed to be permanently fixed and laterally coupled with a wall, and non-stationary (movable) panels that slide within the top and or bottom rails to open and close access to the shower area.

A further drawback with the conventional shower enclosures is that they fail to contain all water within the confines of the enclosed shower area. That is, water may leak through the physical connections between different structures.

Another drawback with most conventional shower enclosures is that they are manufactured for either right-sided installation only (the enclosure closes off the shower space at the right-side of the person standing outside the shower space), or, alternatively, they are manufactured for left-sided installation only (the enclosure closes off the shower space at the left-side of the person standing outside the shower space). Accordingly, the conventional shower enclosures are designed, manufactured, and installed for either a right side or left-side installation, but not both.

Additionally, the process or steps of installing the conventional shower enclosures are mostly executed from outside the enclosed area, including use of fasteners for fastening the various members of the enclosures or adjustments thereof, which is not esthetically pleasing since the fasteners are visible from the outside of the shower area.

Accordingly, in light of the current state of the art and the drawbacks to current enclosures mentioned above, a need exists for improved enclosure systems that would have enhanced or superior articulations, mechanisms for preventing leakage of fluid outside an enclosed area or space, show minimal fastener mechanisms (if any) from outside the enclosure for esthetics, and that could be used for both right and left sided configurations.

BRIEF SUMMARY OF THE INVENTION

A non-limiting, exemplary aspect of the present invention provides an enclosure, comprising:

a sill that includes a drainage system that is comprised of:

a spill channel defined by an exterior side of a stationary panel in relation to a spill guide and a first barrier, forming the spill channel that redirects leaked fluid blocked by the first barrier for draining the leaked fluid;

a lower distal end of the exterior side of the stationary panel faces a second barrier, with the second barrier further blocking fluid and redirecting the leaked fluid drained from the spill channel and back into an enclosed space.

Another non-limiting, exemplary aspect of the present invention provides an enclosure, comprising:

one or more rollers;

a roller of one or more rollers is comprised of:

one or more bracket that has a yoke at an end thereof;

a wheel that is coupled with a first distal end of an axle, with a second distal end of the axle coupled with the yoke by a pivot-shaft;

the one or more bracket includes mounting mechanism for securing the roller onto one or more structures.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout:

FIGS. 2A-1 to 2C-4 are non-limiting, exemplary illustrations of a sill for enclosure systems in accordance with the present invention;

FIGS. 3A-1 to 3C-2 are non-limiting, exemplary illustrations of a jamb for enclosure systems in accordance with the present invention;

FIGS. 4A-1 to 4C-3 are non-limiting, exemplary illustrations of a jamb-sill combination for enclosure systems in accordance with the present invention;

FIGS. 5A-1 to 5C-2 are non-limiting, exemplary illustrations of a stationary panel for enclosure systems in accordance with the present invention;

FIGS. 6A to 6C-4 are non-limiting, exemplary illustrations of a stationary panel-jamb combination for enclosure systems in accordance with the present invention;

FIGS. 7A-1 to 7J are non-limiting, exemplary illustrations of a non-stationary panel-roller combination for enclosure systems in accordance with the present invention.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

In the description given below, when it is necessary to distinguish the various members, elements, sections/portions, or components of the different types of enclosures from each other, the description will follow reference numbers with a small alphabet character such as (for example) "structures 102*a*, 102*b*, and 102*c*." If the description is common to all of the various members, elements, sections/portions, or components of all enclosures such as (for example) to all structures 102*a*, 102*b*, and 102*c*, then they are simply referred to with reference number only and with no alphabet character such as (for example) "structure 102."

Throughout the disclosure, references to a shower, shower enclosure, shower space, or a shower area are meant as illustrative and for convenience of example, only. That is, the use of the enclosure systems of the present invention should not be limited to enclosing a shower, shower space, shower area, or as a mere shower enclosure but may also be used to enclose or close-off a space or an area other than a shower, shower area, or shower space, non-limiting example of which may include dividing and closing off a section of a room.

The present invention provides enhanced members for various enclosure systems for preventing leakage of fluid outside an enclosed area or space, including improved articulation non-stationary panels for a superior enclosure. The present invention further provides an esthetically pleasing enclosure system with minimal fastener mechanisms (if any) seen from outside the enclosure, with the entire enclosure system easily configurable for use for both right and left sided installations.

More specifically, a frame structure of the enclosure systems of the present invention virtually eliminates leakage of fluid from an enclosed area. One single unit enclosure system of the present invention may be used for either right or left sided installation, which is tremendously advantageous in terms of manufacture, shipping, and installation. As detailed below, the process or steps of installing the enclosure system of the present invention is mostly executed from inside the enclosed area, including use of fasteners for fastening the various members of the enclosures or adjustments thereof, which is esthetically pleasing since the fasteners are no longer visible from the outside of the enclosed area. The enclosure system of the present invention has also eliminated the need for the use of vertical aluminum framing members for accommodating the tethering of non-stationary door panels together for specific types of enclosure systems that require it.

Figures 1, 1A:
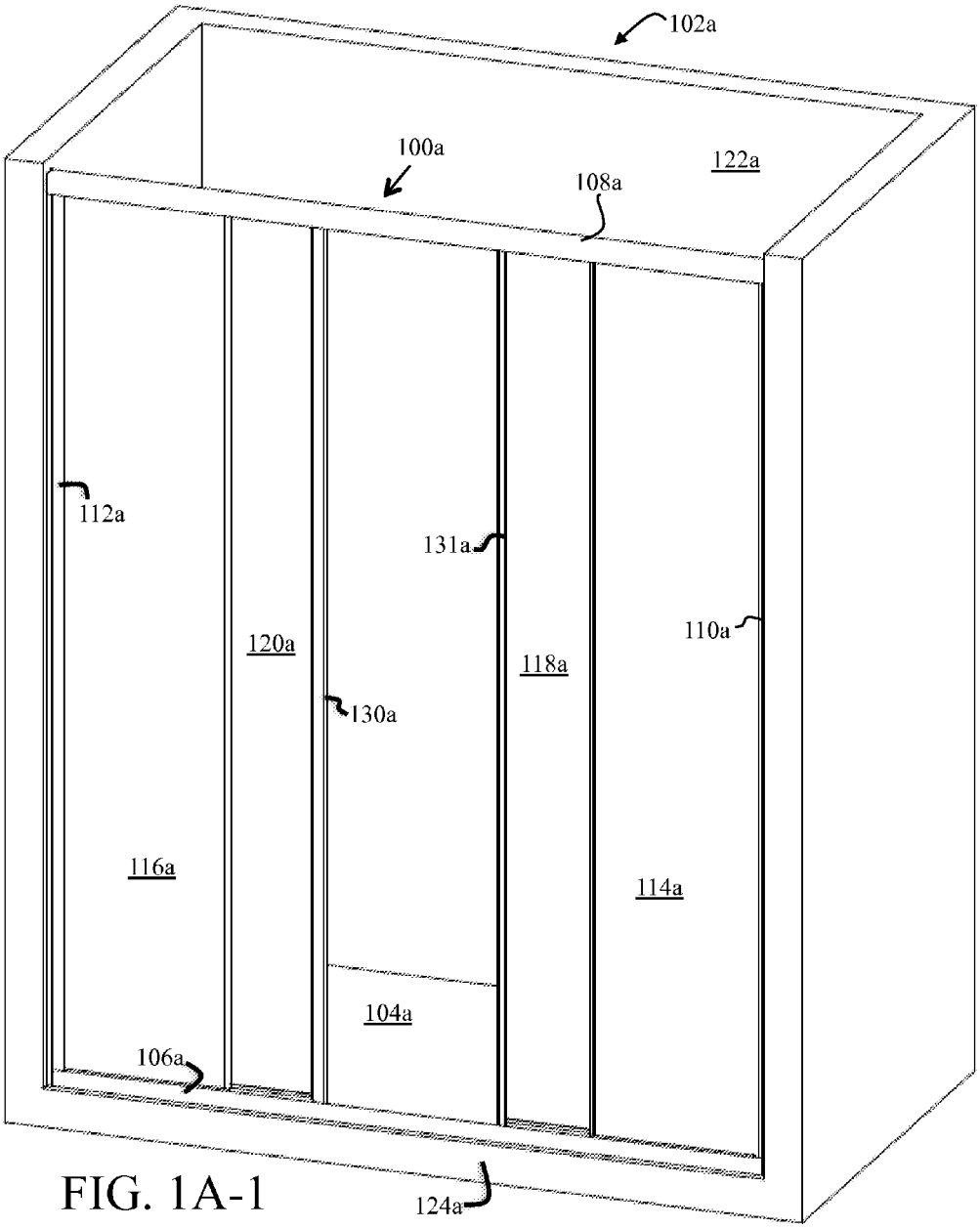
FIGS. 1A-1 to 1C-2 are non-limiting, exemplary illustrations of enclosure systems in accordance with the present invention.
Figures 1, 1A, 2:
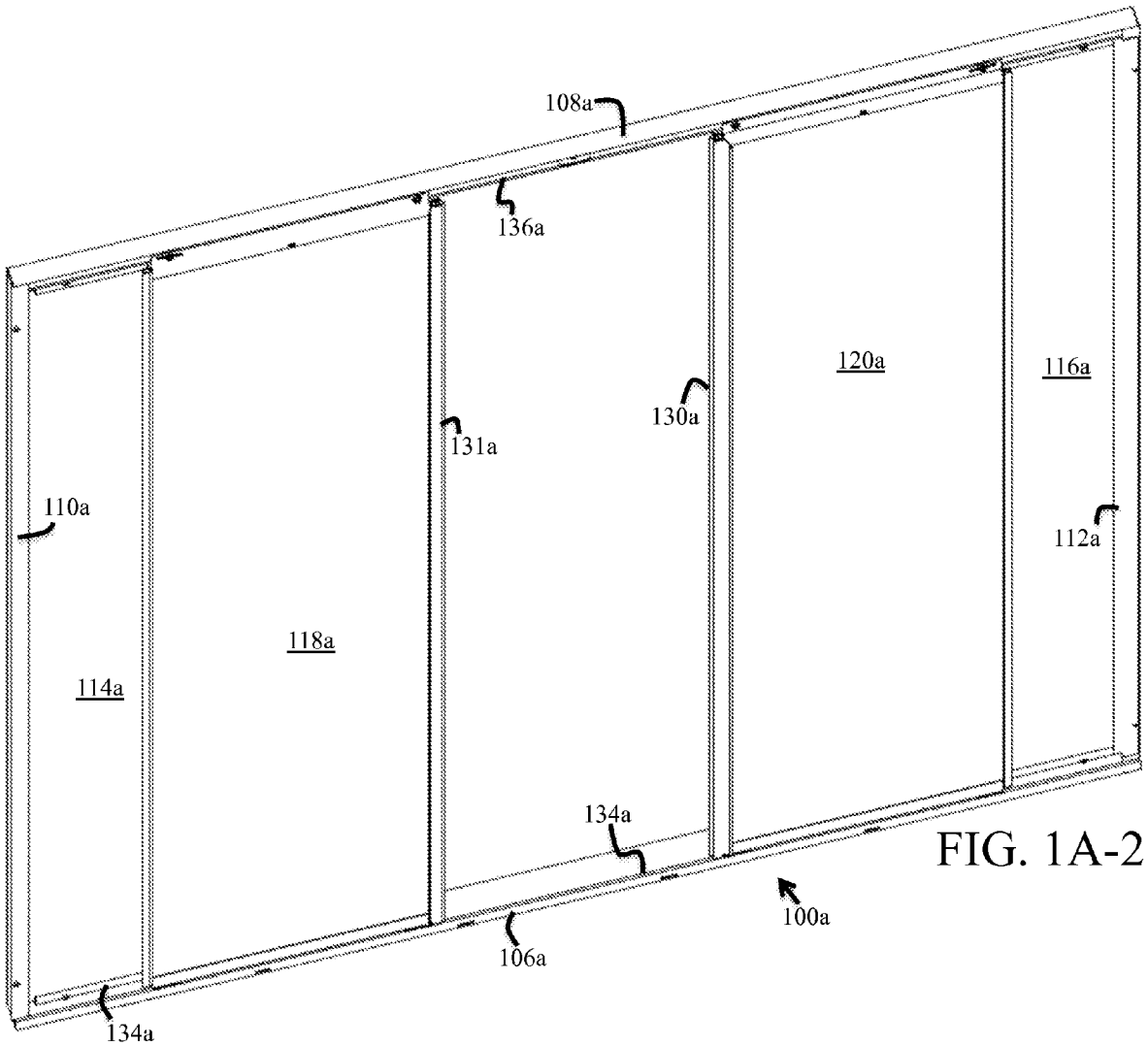
Figures 1, 1B:
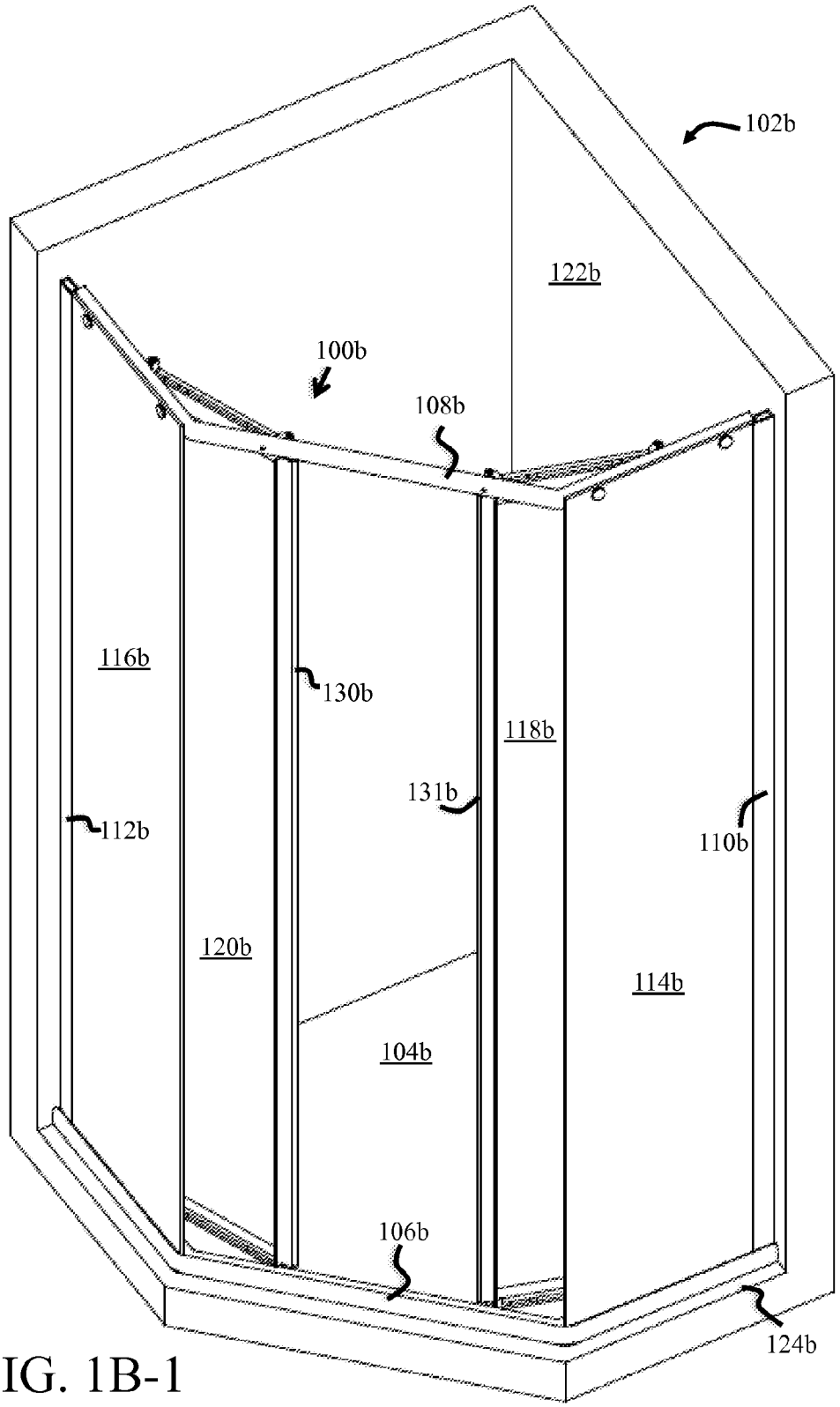
Figures 1, 1B, 2:
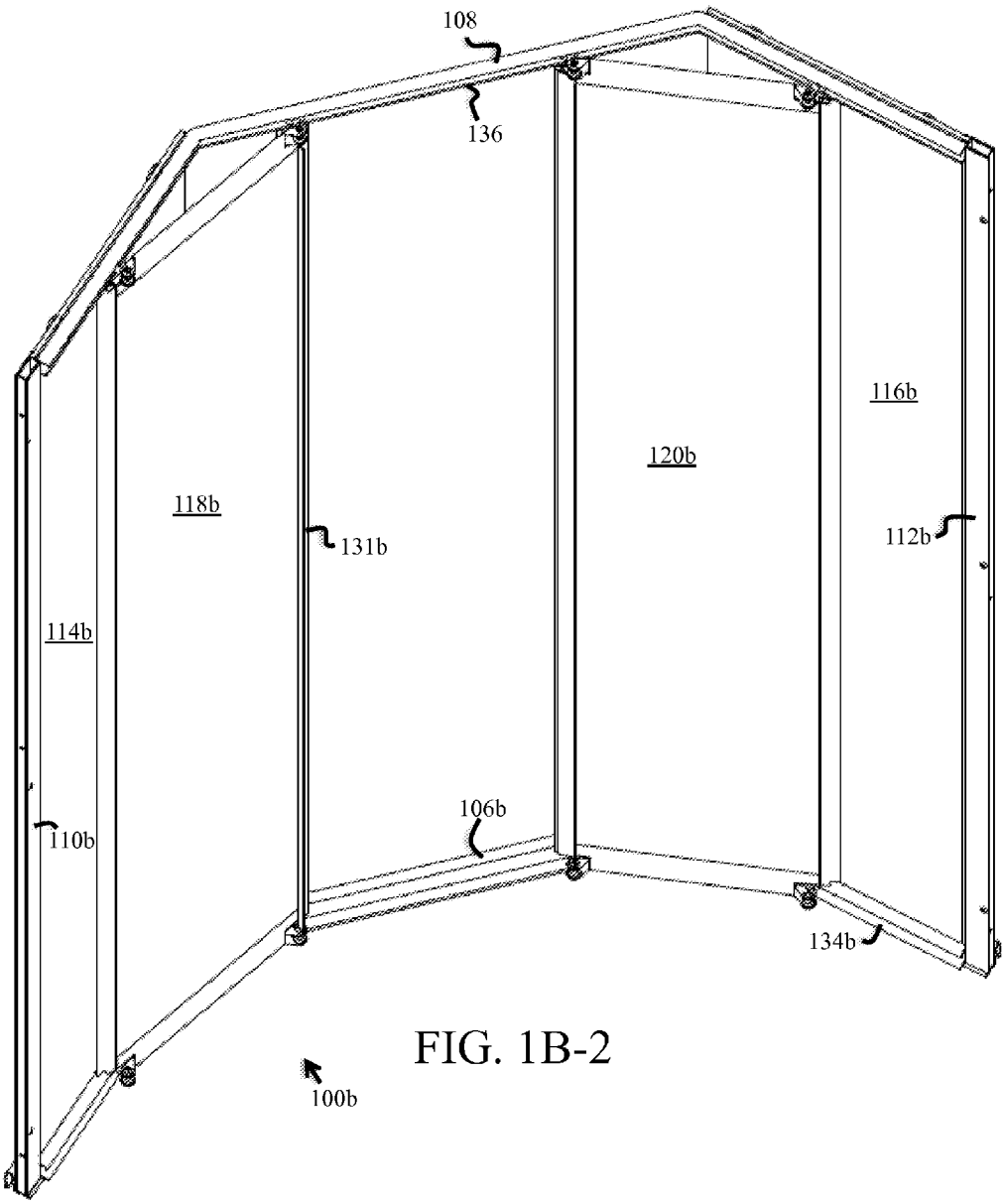
Figures 1, 1C:
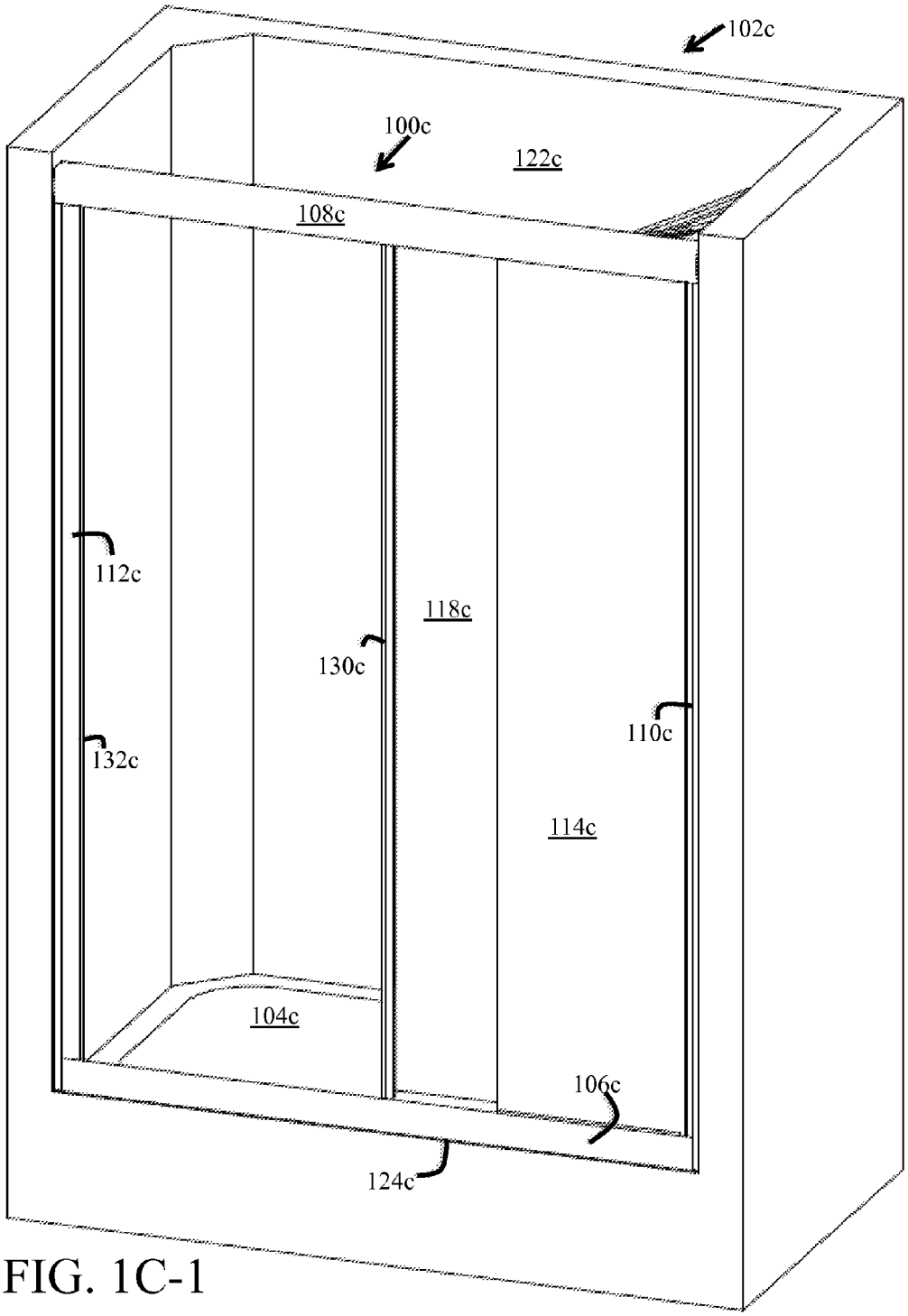
Figures 1, 1C, 2:
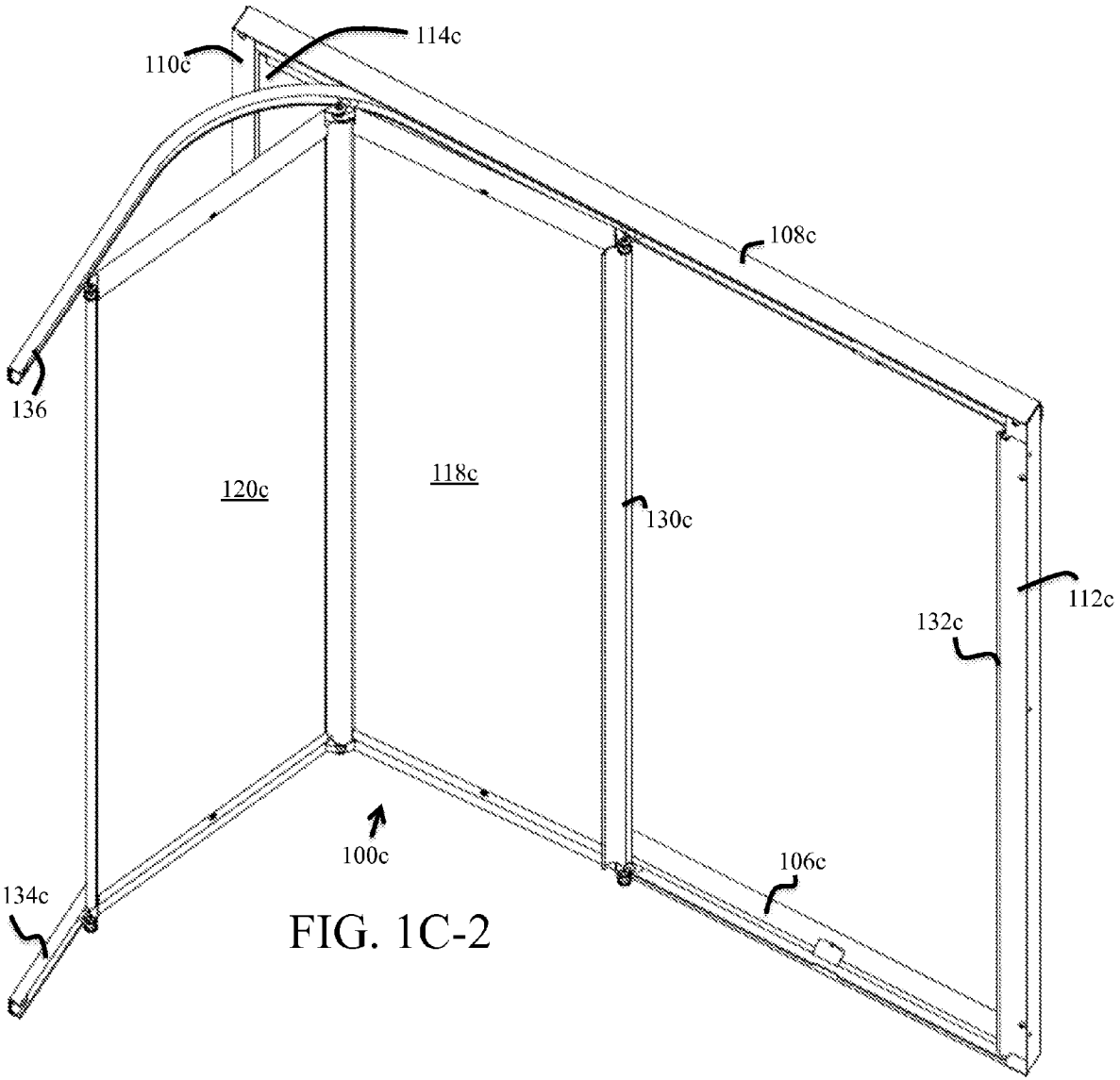

These and other features, aspects, and advantages of the invention are easily applicable to numerous, different types of enclosure systems, non-limiting, non-exhaustive examples of which are exemplarily illustrated in FIGS. 1A-1 to 1C-2. For example, FIGS. 1A-1 and 1A-2 are exemplary illustrations of an enclosure system with an inline articulation of non-stationary panels that incorporates the various features, aspects, and advantages of the present invention. As another example, FIGS. 1B-1 and 1B-2 are exemplary illustrations of a Neo-Angle enclosure system that easily incorporate the various features, aspects, and advantages of the present invention. As yet another example, FIGS. 1C-1 and 1C-2 are exemplary illustrations of an adjoining enclosure system configuration that has non-stationary door panels that articulate along a rail towards an adjoining wall from a fully closed position to a fully open position, which incorporates the various features, aspects, and advantages of the present invention.

As illustrated, FIG. 1A-1 is a non-limiting, exemplary illustration of an in-line enclosure system (half-way open) viewed from outside an enclosed space or area in accordance with the present invention, and FIG. 1A-2 is a non-limiting, exemplary illustration of the same as shown in FIG. 1A-1, but showing the in-line enclosure system (half-way open) from inside and with the actual area or surround removed for clarity. FIG. 1B-1 is a non-limiting, exemplary illustration of a Neo-Angle enclosure system (half-way open) viewed from outside an enclosed space or area in accordance with the present invention, and FIG. 1B-2 is a non-limiting, exemplary illustration of the same as shown in FIG. 1B-1, but showing the Neo-Angle enclosure system (half-way open) from inside and with the actual area or surround removed for clarity. FIG. 1C-1 is a non-limiting, exemplary illustration of an adjoining enclosure system (half-way open) viewed from outside an enclosed space or area in accordance with the present invention, and FIG. 1C-2 is a non-limiting, exemplary illustration of the same as shown in FIG. 1C-1, but showing the adjoining enclosure system (half-way open) from inside and with the actual area or surround removed for clarity.

As illustrated in FIGS. 1A-1 to 1C-2, the enclosure systems 100 include a frame that is associated with a structure 102, a non-limiting example of which may be a shower area with a surround 122 and a tub or shower basin 104. In general, the frame of the enclosure system 100 includes a sill 106 that is coupled with structure 102, with the sill 106 having a length that extends longitudinally along an open length that defines a first side of the structure 102 with which the sill 106 is associated. The sill 106 conforms to a contour of a periphery edge 124 of the first side of the structure 102 with which the sill 106 is associated.

As further illustrated in FIGS. 1A-1 to 1C-2, the frame of the enclosure system 100 further includes a header 108 that has a length that extends longitudinally along a length of the first side of the structure 102 with which the sill 106 is associated. The header 108 is generally comprised of a single integral piece that includes an esthetically pleasing outer façade and an interior rail housing that accommodates a top rail 136. The frame of the enclosure system 100 further includes a first jamb 110 and a second jamb 112 coupled between the sill 106 and the header 108 at a respective first and second distal ends of the sill 106 and the header 108.

As further illustrated in FIGS. 1A-1 to 1C-2, the enclosure system 100 of the present invention further includes one or more stationary panels 114 and 116 that are coupled with one or both first and second jambs 110 and 112, the sill 106 and the header 108. Further included are one or more non-stationary panels 118 and 120 that articulate along the top rail 136 and a bottom rail 134 associated with the respective header 108 and sill 106 from one of a fully closed position to a fully open position and vice versa without substantial encroachment into the enclosing space.

The enclosure system of the present invention provides one or more stile 130 and 131 that is coupled with a first side of one or more non-stationary door panel 118 and 120 that when pulled (via the stile handles) at a closing direction, the one or more non-stationary door panels 118 and 120 in addition to the one or more stationary fixed panels 114 and 116 close-off the space, confining the fluid within the enclosed space. Although not illustrated, when fully closed, the entire length of the one or more stile 130 and 131 of the enclosure system physically contacts an entire length of one of another stile 131 and 130 or a strike jamb 132 of one of the jambs 110*c* or 112*c* to close-off the enclosed space.

Regarding the enclosure system illustrated in FIGS. 1C-1 and 1C-2, when the stile 130*c* is pulled (via a handle) to an opening direction, the stiles 130*c* (and the non-stationary panel 118*c* to which the stile 130*c* is coupled) is pushed to push an adjacent (tethered) second non-stationary panel

120*c* to fully open an ingress and egress access span of the shower space with minimal structural encroachment. In general, when in the fully open position, the enclosure system 100*c* of the present invention enables access with a span length to the shower area without much encroachment (if any, with the exception of the stationary fixed panels 114*c*).

FIGS. 2A-1 to 2C-4 are non-limiting, exemplary illustrations of a sill of an enclosure system in accordance with the present invention. FIGS. 2A-1 to 2A-4 are non-limiting, exemplary illustrative views of a sill used with the inline enclosure shown in FIGS. 1A-1 to 1A-2. FIGS. 2B-1 to 2B-6 are non-limiting, exemplary illustrative views of a sill used with the Neo-Angle enclosure shown in FIGS. 1B-1 and 1B-2. FIGS. 2C-1 to 2C-4 are non-limiting, exemplary illustrative views of a sill used with the adjoining enclosure system shown in FIGS. 1C-1 and 1C-2. It should be noted that as illustrated, the described (and illustrated) profile of the sill 106 extends longitudinally through the entire length of the sill 106.

As illustrated in FIGS. 2A-1 to 2C-4 and detailed below, in general, the sill 106 of the present invention includes a drainage system 202 having a spill channel (shown by the dashed circular line 204) that has a first barrier 206 and a second barrier 208, with the second barrier 208 positioned below the spill channel 204 and facing a lower distal end 258 of an exterior side 252 of a stationary panel 114/116. The sill 106 further includes exterior portion 210 and interior portion 212 (shown by the division dashed line 220) that accommodate jambs at distal ends 214 and 216 of the sill 106, with the interior portion 212 further including a stationary panel support 218 upon which a stationary panel 114/116 rests.

More particularly (and as best illustrated in FIGS. 2A-3, 2A-4, 2B-5, 2B-6, 2C-3, and 2C-4), the drainage system 202 of sill 106 includes a spill channel 204 defined by an exterior side 252 of a stationary panel 114/116 in relation to a spill guide 222 and a first barrier 206, forming the spill channel 204 that redirects leaked fluid 256 blocked by the first barrier 206 for draining the leaked fluid 256 back into the enclosed space. A lower distal end 258 of the exterior side 252 of the stationary panel 114/116 faces a second barrier 208, with the second barrier 208 further blocking fluid 256 and redirecting the leaked fluid 256 drained from the spill channel 204 and back into the enclosed space.

As further illustrated in FIGS. 2A-1 to 2C-3, and more particularly in FIGS. 2A-3, 2B-5, and 2C-3, the sill 106 includes an exterior portion 210 and an interior portion 212, with the exterior portion 210 including an exterior support 224 that has a lower end 226 that is integral with an exterior flange 228, and an upper end 230 that is associated with the first barrier 206 by a link 232 having a span that defines a distance 234 between the first barrier 206 and the exterior support 224. The Neo-Angle sill 106*b* (FIG. 2B-5) includes the exterior support 224*b* that is convex and curved outward providing a more esthetically pleasing façade with the exterior flange 228*b* providing further, horizontally stabilizing support. The exterior support 224*a* of the inline enclosure sill 106*a* (FIG. 2A-3) and the exterior support 224*c* of the adjoining enclosure sill 106*c* (FIG. 2C-3) are substantially vertical and their exterior flange 228*a* and 228*b* is associated with an exterior fin 330*a* and 330*b* of a jamb 110*a,b* and 112*a,b*.

As further illustrated in FIGS. 2A-3 and 2A-4, 2B-5 and 2B-6, and 2C-3 and 2C-4, the link 232 has an exemplary dome profile with an apex that defines the height of the first barrier 206. In fact, the height of the first barrier 206 may be defined from the exterior flange 228 to the apex of the dome. The interior portion 212 of the sill 106 has the drainage system 202 and the stationary panel support 218 as described above. The first barrier 206 of the drainage system 202 is oriented at a first angle in relation to the basin 104 of the enclosed space with the spill guide 222 oriented at a second angle in relation to the first barrier 206 and the basin 104 of the enclosed space, with an apex of the first barrier 206 (top of the link 232) ascending and extending to a height that is above the spill channel 204. More specifically, the first barrier 206 is oriented substantially vertically in relation to the basin 104 of the enclosed space, and the spill guide 222 may be oriented substantially horizontal or at a somewhat of an inwardly slope in relation to the basin 104 of the enclosed space, ending at the second barrier 208. The exterior side 252 of a lower distal end 258 of the stationary panel 114/116 faces the second barrier 208, with a bottom side 262 of the stationary panel 114/116 resting on the stationary panel support 218.

As further illustrated in FIGS. 2A-3 and 2A-4 the interior support portion 212*a* of the sill 106*a* used in the inline enclosure includes a fastener portion 238*a* near the second barrier 208*a* for securing the stationary panel 114*a*/116*a* onto the sill 106*a*, and has a ledge or shelf as the stationary panel support 218*a* upon which the stationary panel rests, with the support 218*a* oriented substantially perpendicular to the second barrier 208*a*. The sill 106*a* in the inline enclosure includes a roller housing 236*a* formed as a channel within which the rollers 264/265 of the non-stationary door panels 118*a*/120*a* articulate. Within the roller housing 236*a* is a lower step 237 that enables an interior fin 306*a* of a jamb 110*a*/112*a* to rest against.

Figures 1, 2A:
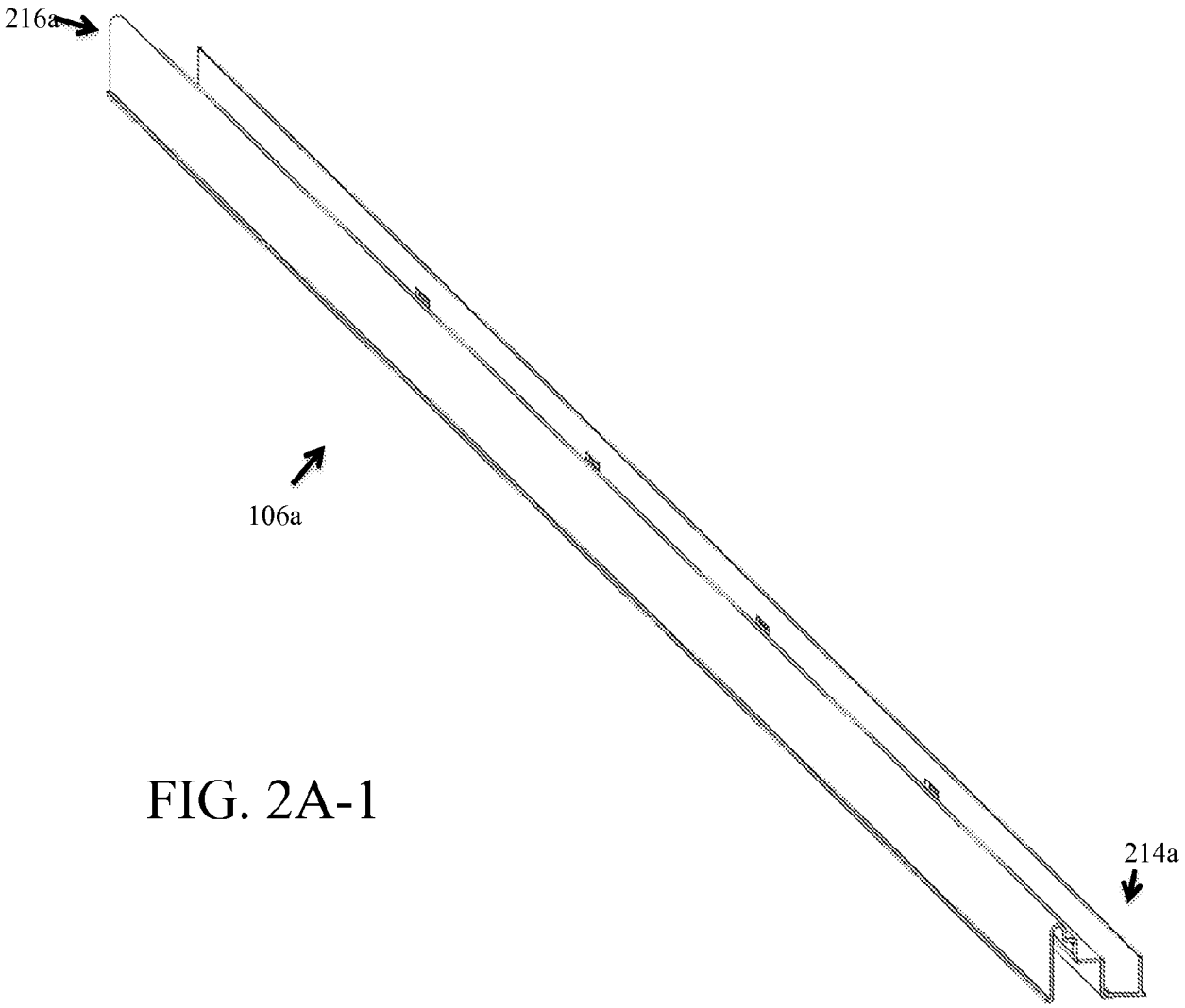
Figures 2, 2A:
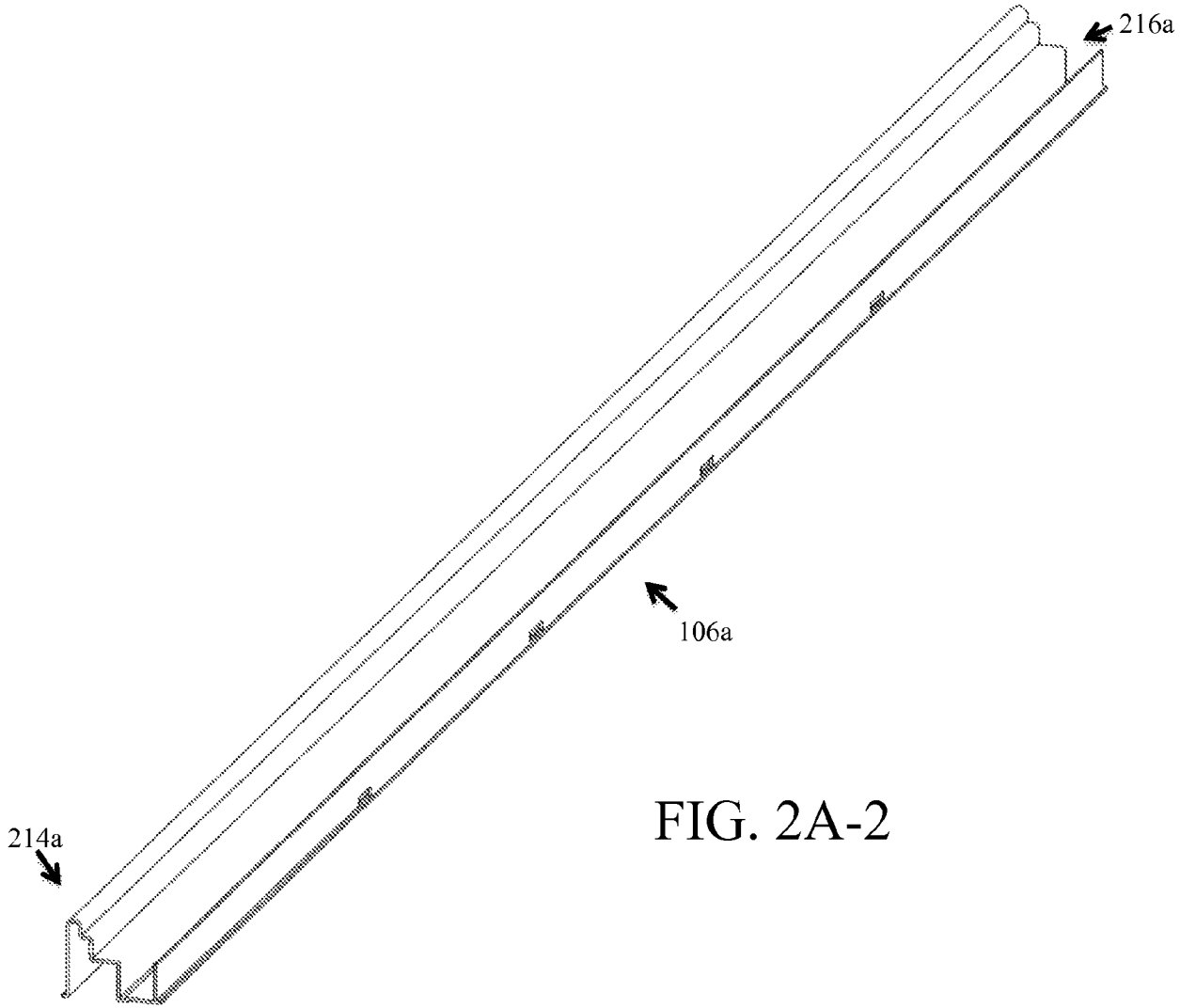
Figures 2, 2A, 3:
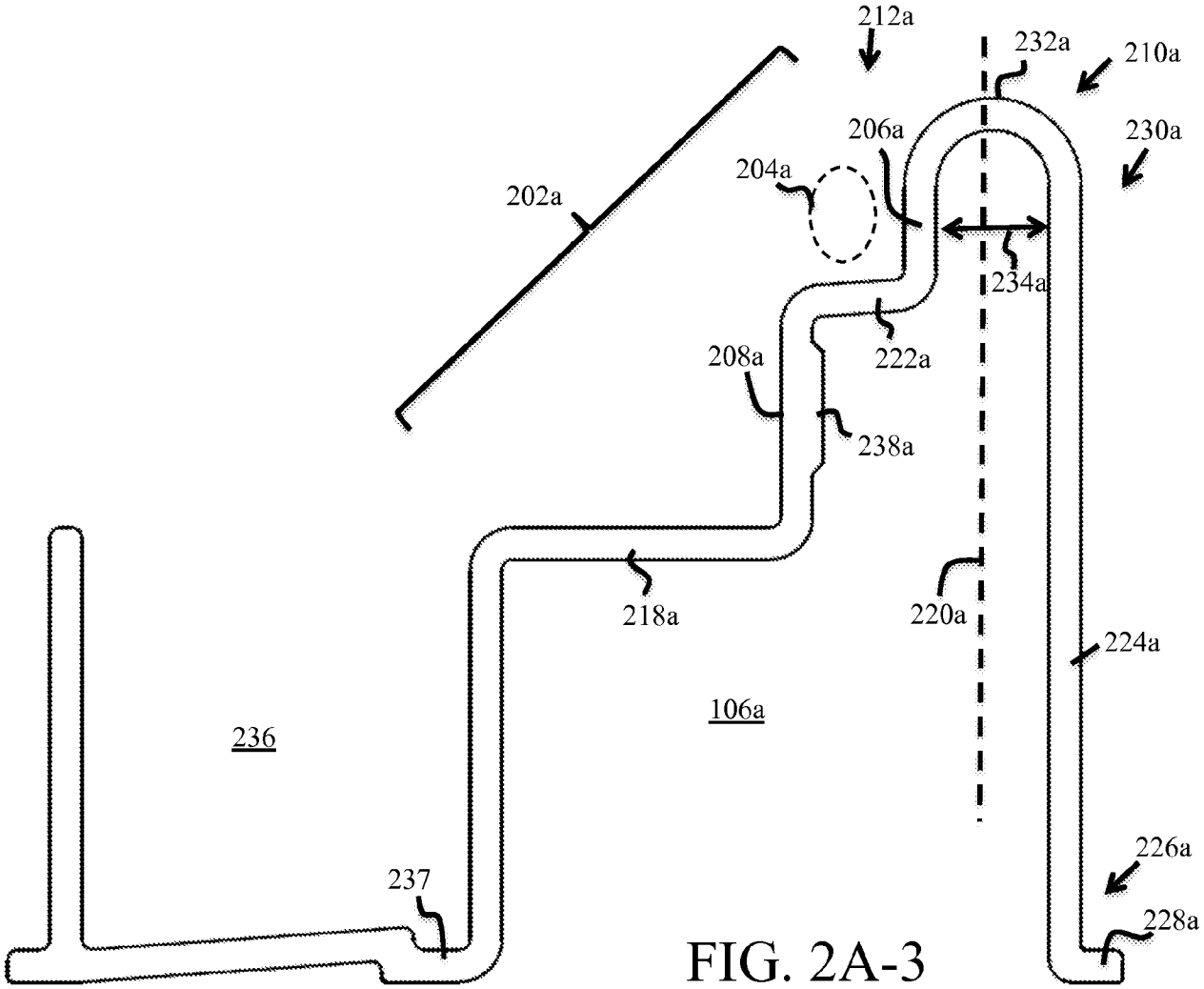
Figures 2, 2A, 3, 4:
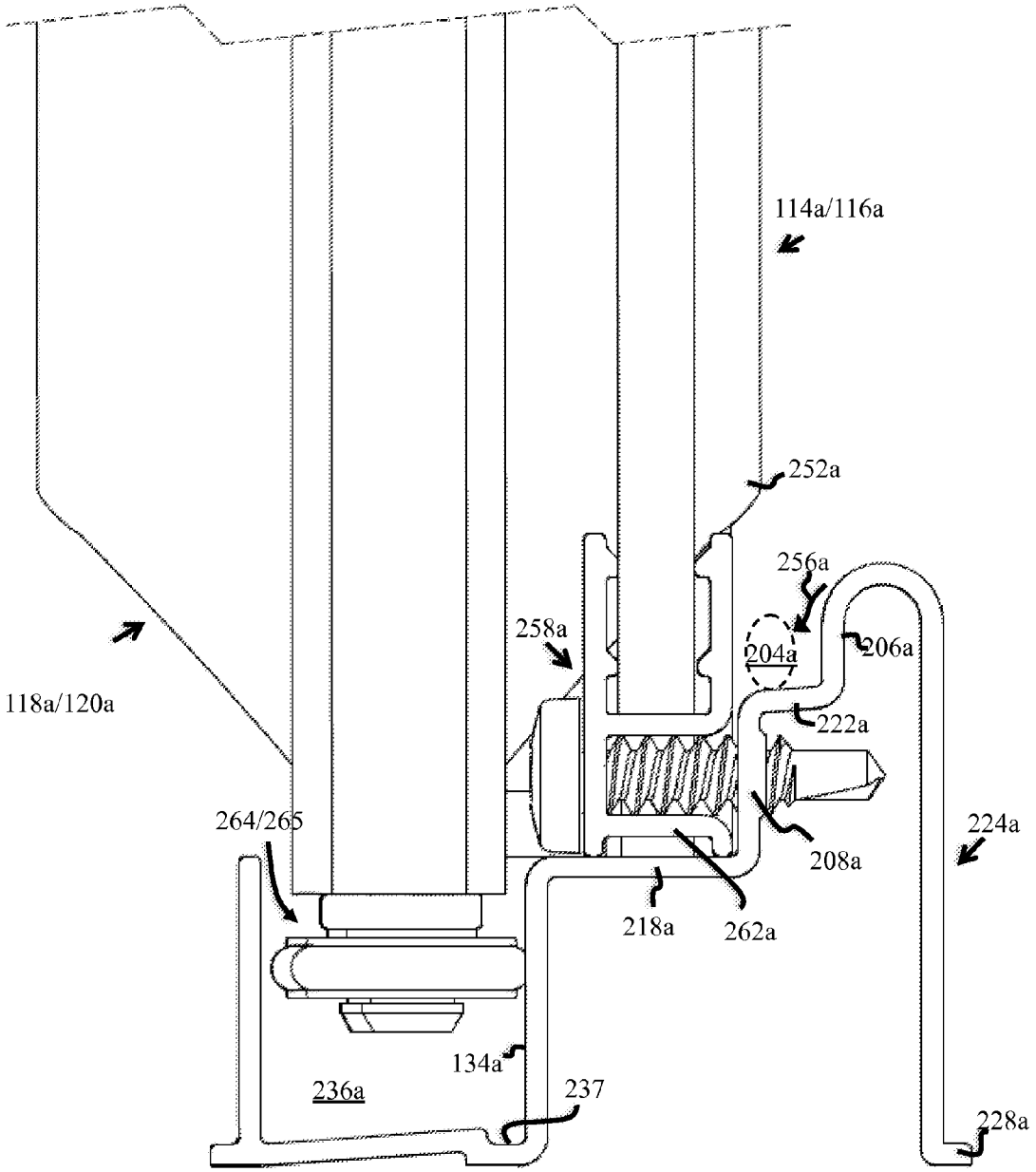
Figures 1, 2B:
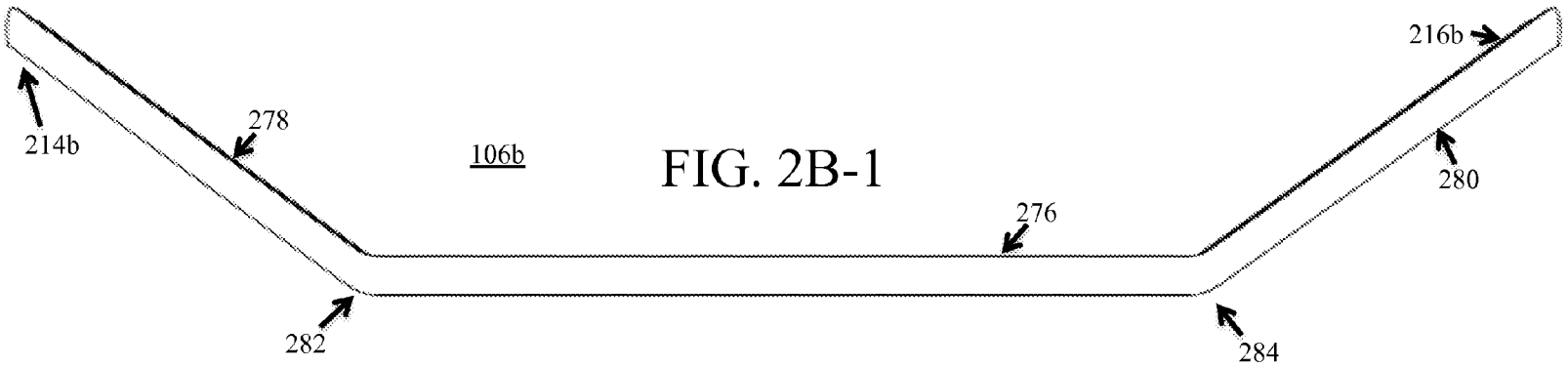
Figures 2, 2B:
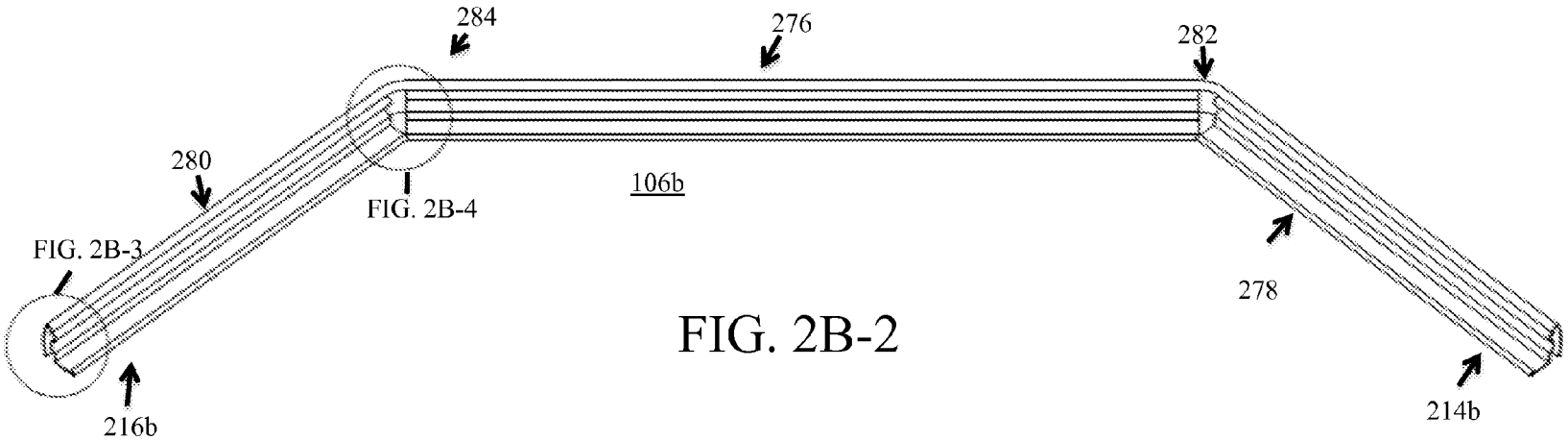
Figures 2, 2B, 3, 4:
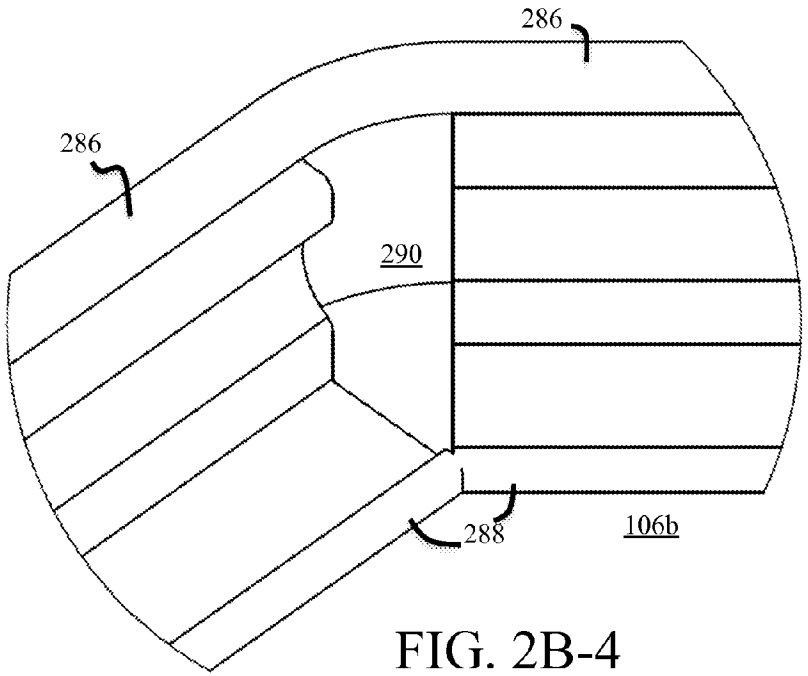
Figures 2, 2B, 3:
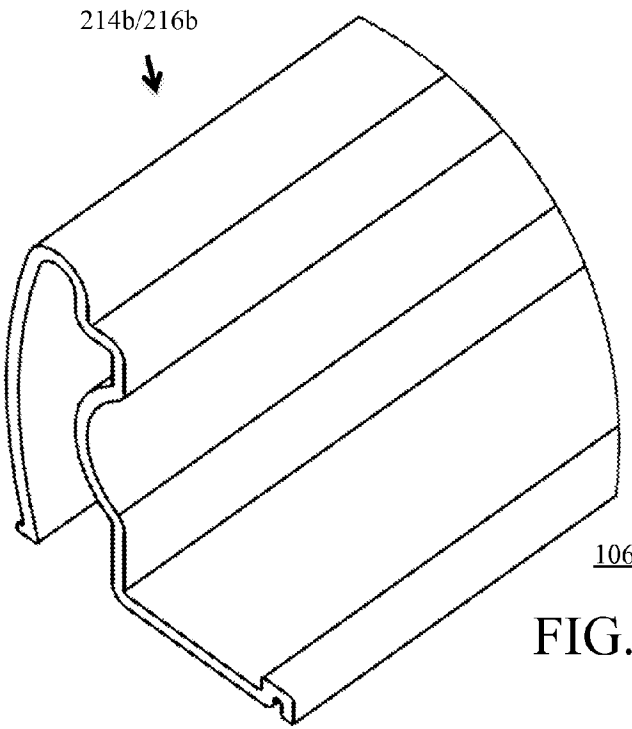
Figures 2, 2B, 3, 4, 5:
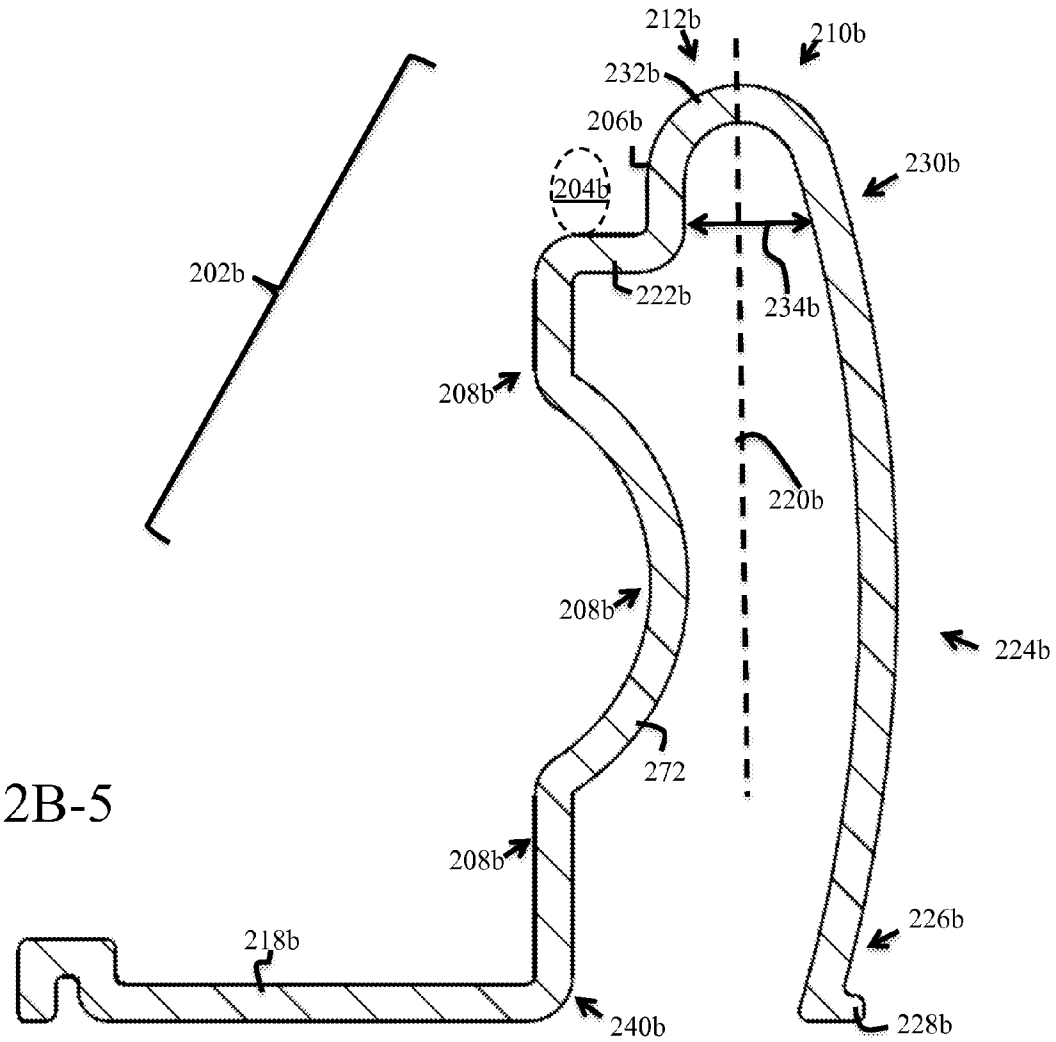
Figures 2, 2B, 3, 4, 5, 6:
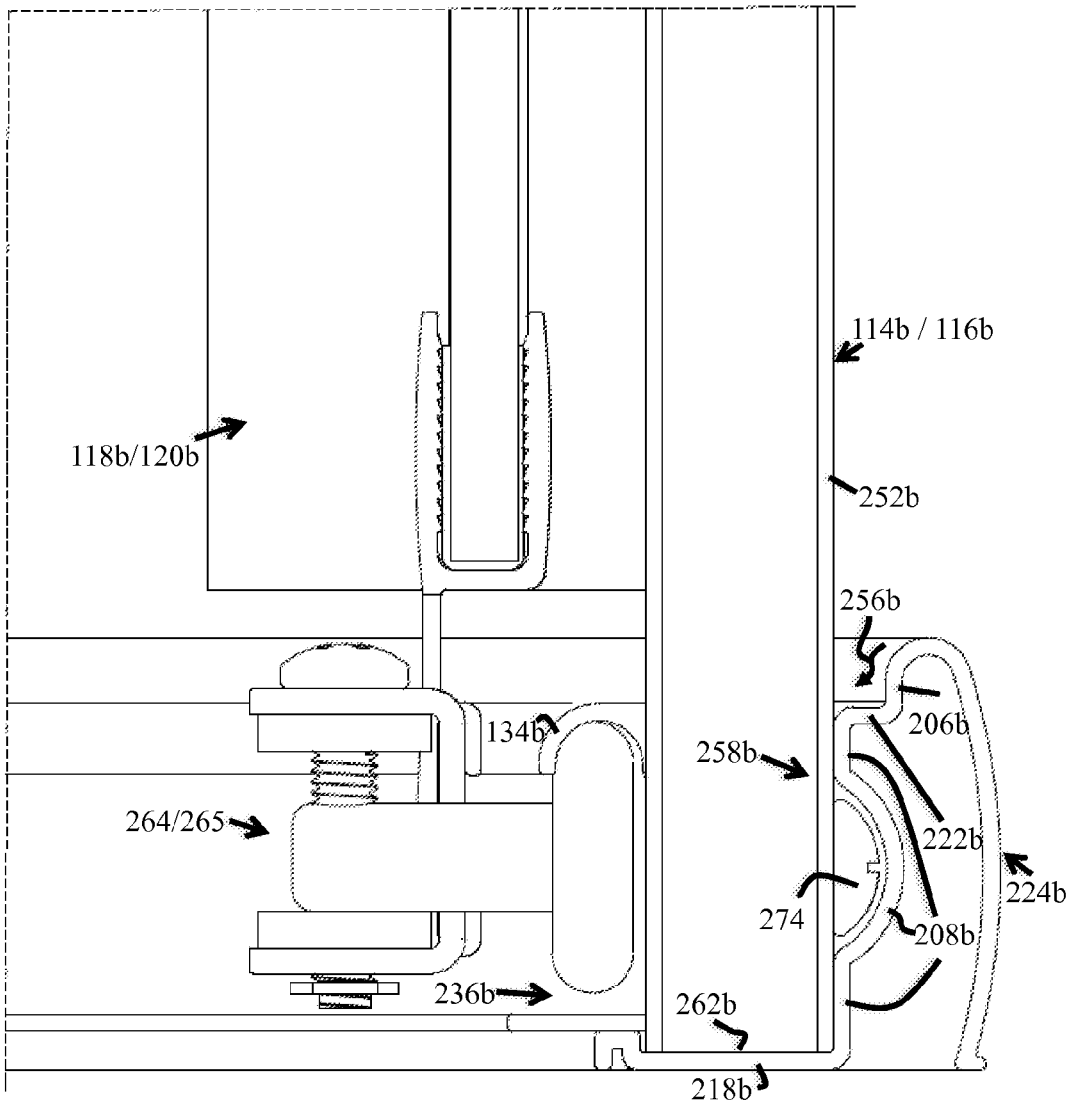
Figures 1, 2C:
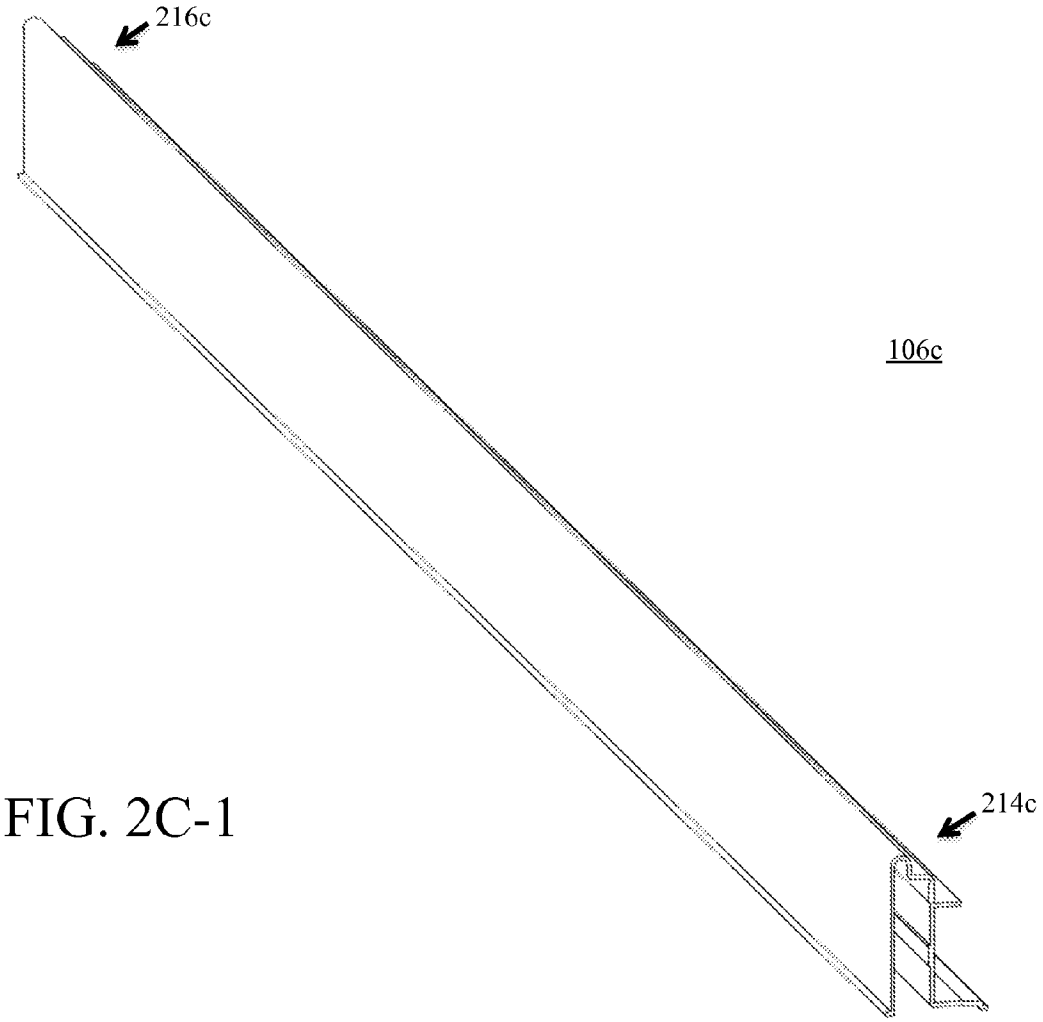
Figures 2, 2C:
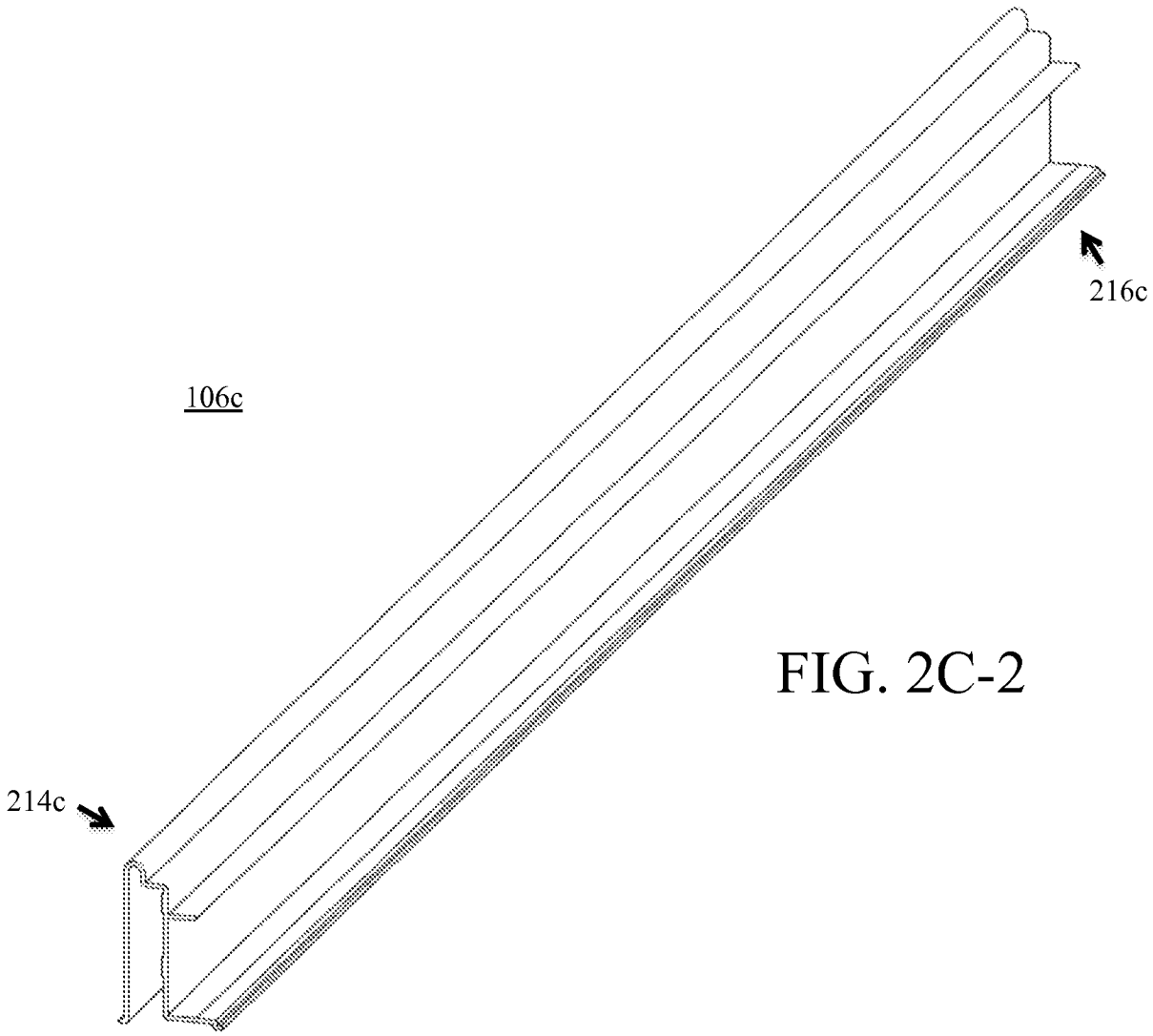
Figures 2, 2C, 3:
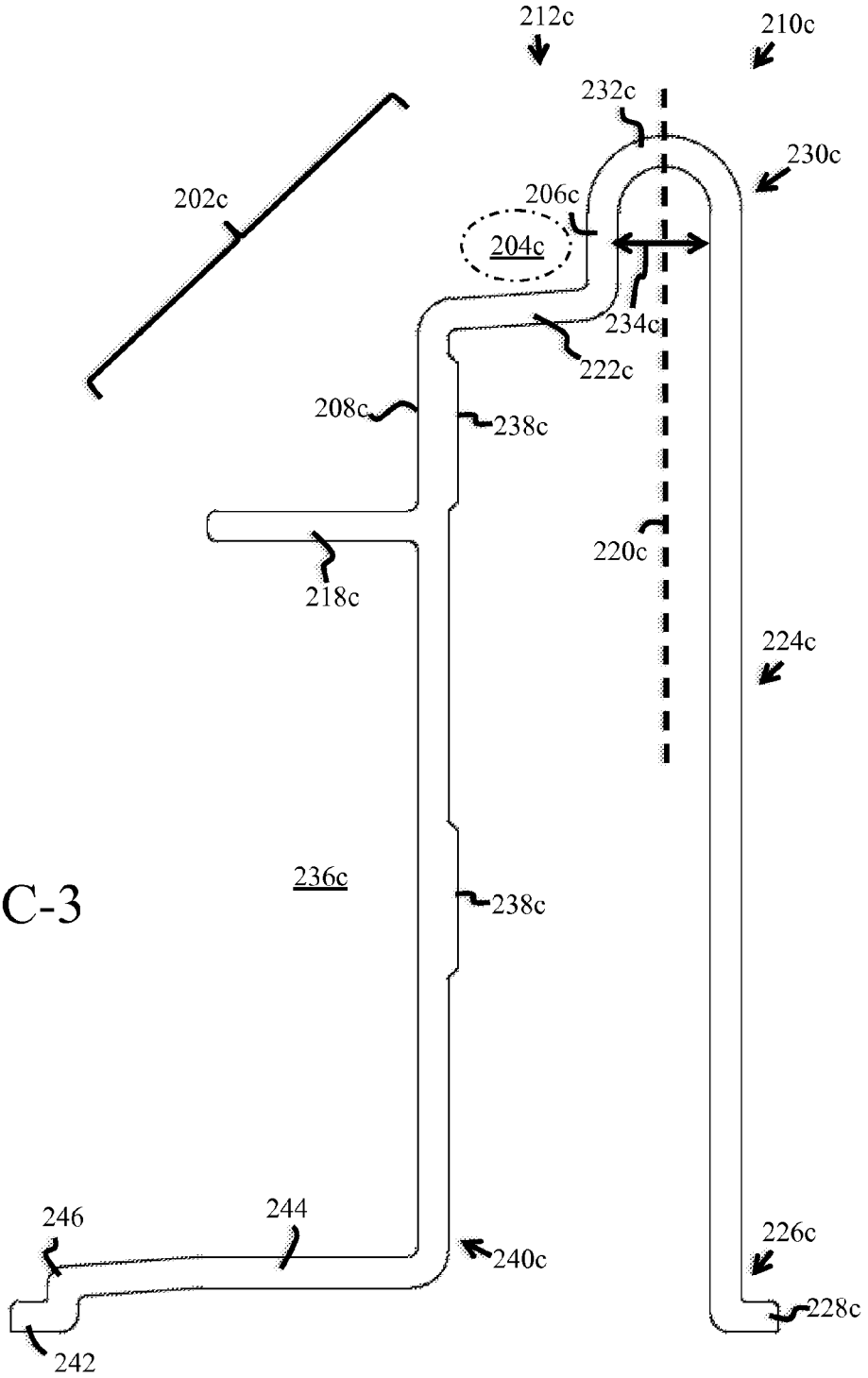
Figures 2, 2C, 3, 4:
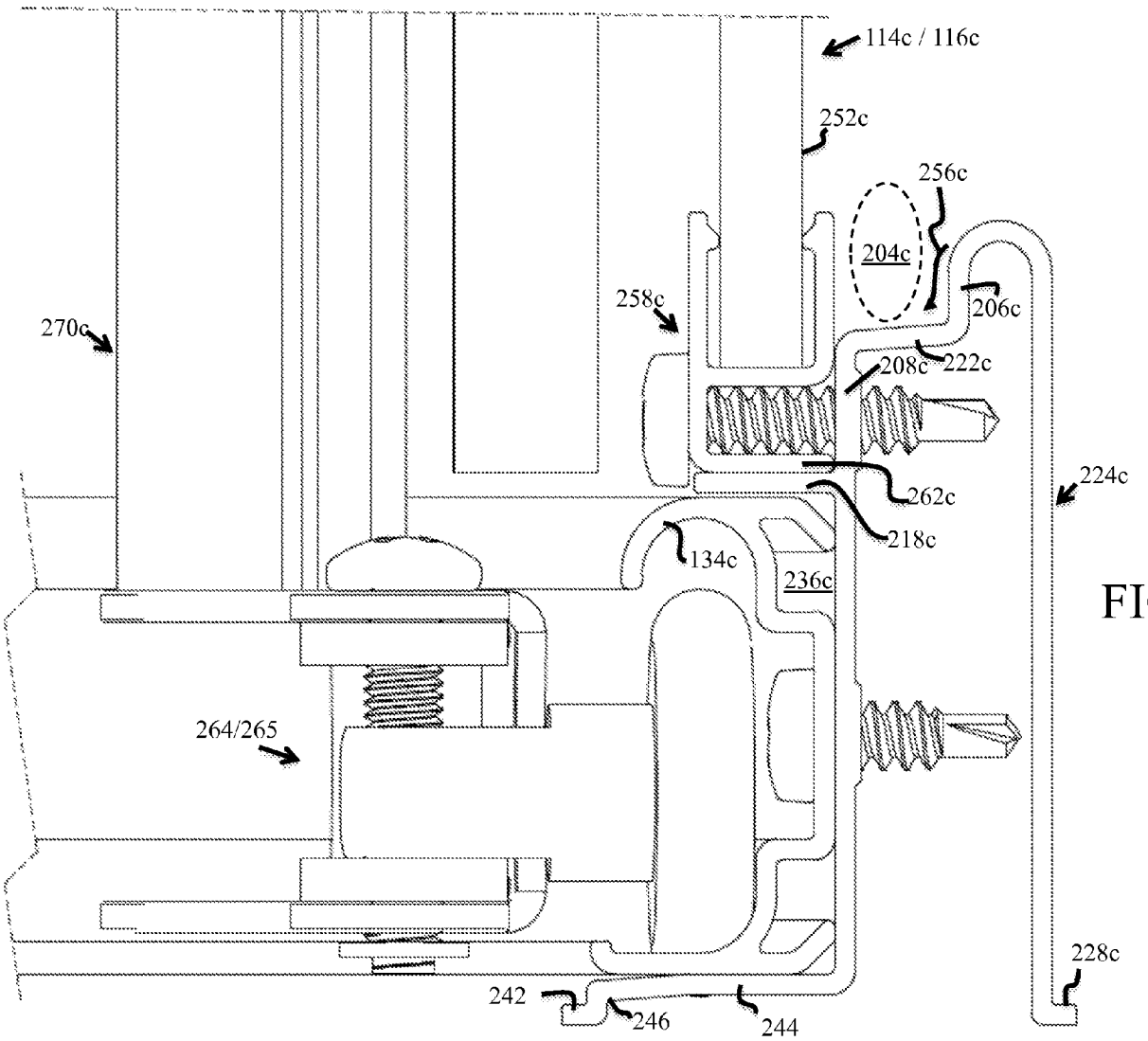

As illustrated in FIGS. 2B-2, 2B-3, and 2B-4, the sill 106*b* of the Neo-Angle enclosure is comprised of a substantially straight section 276 and distal sections 278 and 280 that are bent at 282 and 284 at an angle in relation to the straight portion 276, the details of which is illustrated in FIG. 2B-4 for the bent 282, with bent 284 being the mirror image of the bent 282. FIG. 2B-3 exemplarily illustrates the very distal ends of the sill 106*b* for the Neo-Angle enclosure. As illustrated in FIG. 2B-4, the top and bottom portions 286 and 288 of the bent 282/284 are continuous, with the mid-section 290 being open.

As further illustrated in FIGS. 2B-5 and 2B-6 the interior support portion 212*b* of the sill 106*b* used in the Neo-Angle enclosure has an interior mid-portion 272 that is concaved (viewed from inside) for accommodating a fastener 274 that is used to secure the stationary panel 114*b*/116*b* to the rail 134*a*. The sill 106*b* of the Neo-Angle enclosure further includes an interior lower end 240*b* that extends and leads to the stationary panel support 218*b*. The rollers 264/265 of the non-stationary panels 118*b*/120*b* articulate within the rails 134*b*/136*b*.

As further illustrated in FIGS. 2C-3 and 2C-4 the interior support portion 212*c* of the sill 106*c* used in the adjoining enclosure includes an interior lower end 240*c* that is integral with a rail flange 244 that terminates at a step 246 extending to the interior flange 242. The interior flange 242 and the exterior flange 228*c* enable interior and exterior fins 306*c* and 330*c* (FIGS. 3C-1 and 3C-2) of a jamb 110*c*/112*c* to rest against. The rail housing 236*c* of the sill 106*c* of the adjoining configuration enclosure (FIGS. 1C-1 and 1C-2) is comprised of the stationary panel support 218*c* in the form of a flange and the rail flange 244, in between which the lower rail 134*c* is accommodated, with the rail flange 244 ending in the interior flange 242 upon which the fins of the jambs 110*c*/112*c* rest. The rollers 264/265 of the non-stationary panels 118*c*/120*c* articulate within the rails 134*c*/136*c*.

Figures 2, 3A:
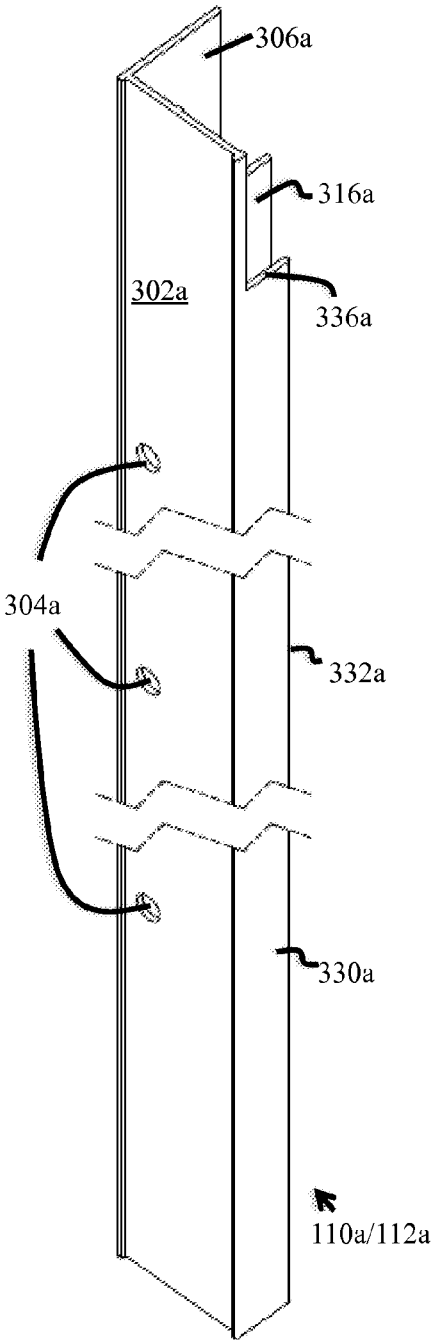
Figures 1, 3A:
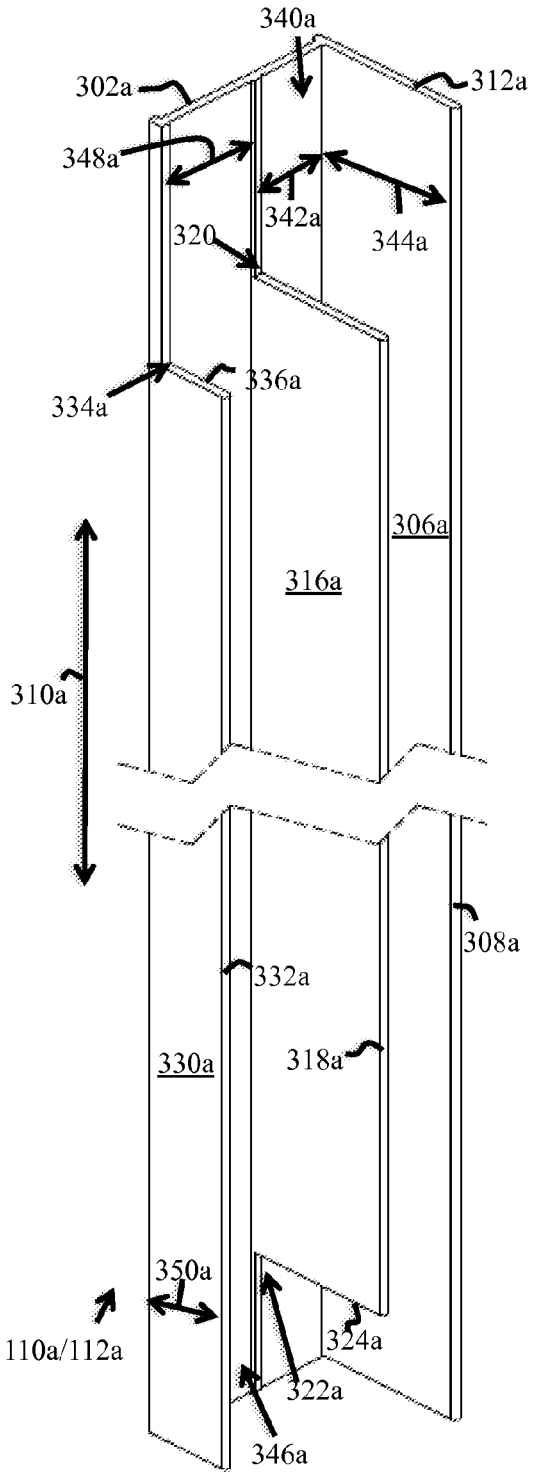
Figures 2, 3B:
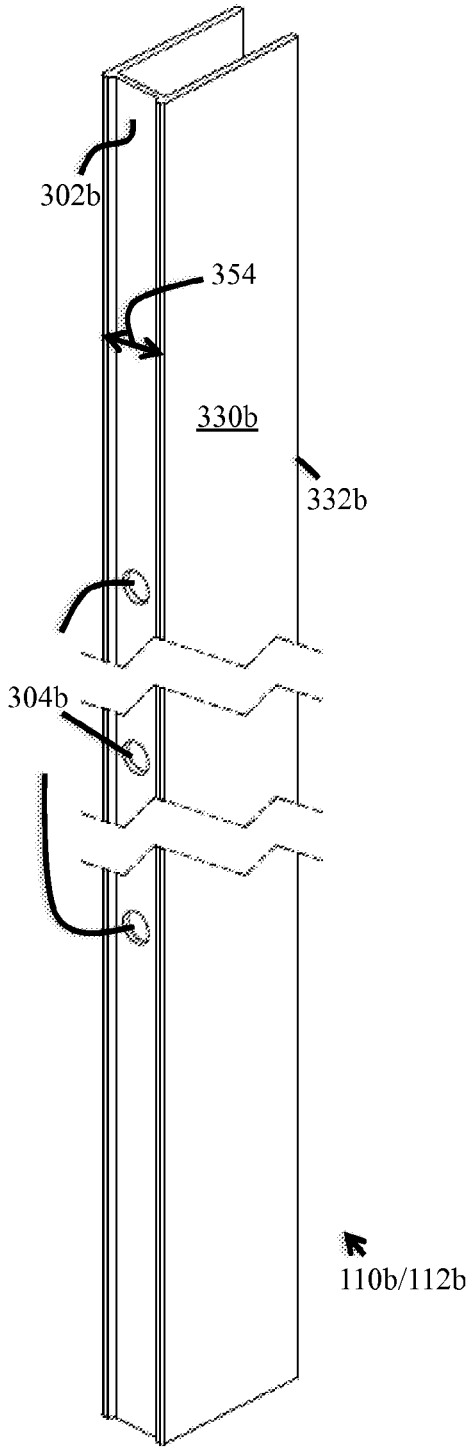
Figures 1, 3B:
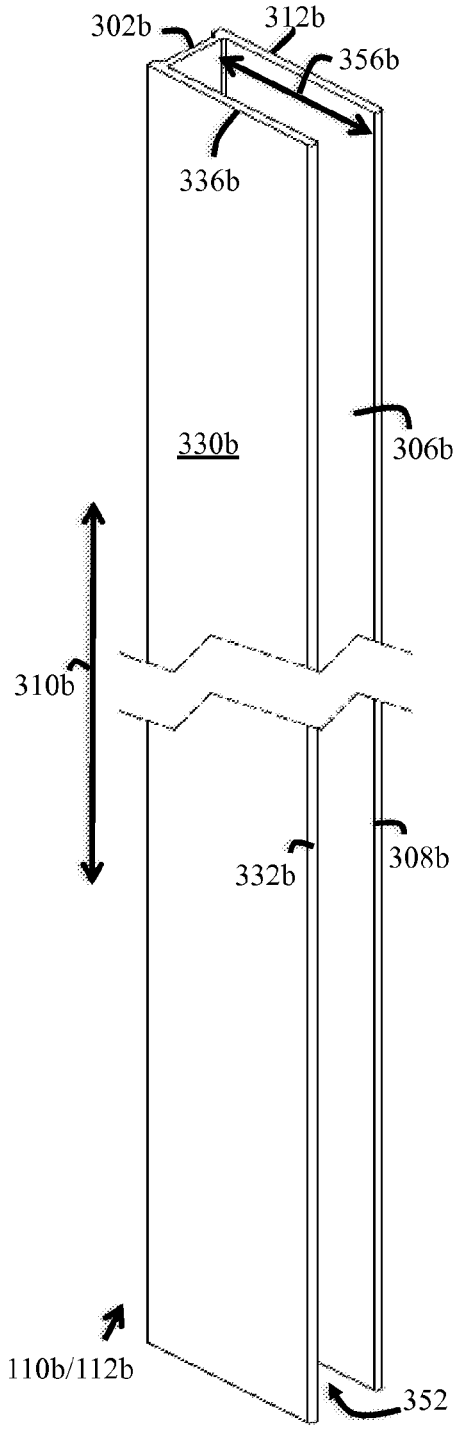
Figures 1, 2, 3C:
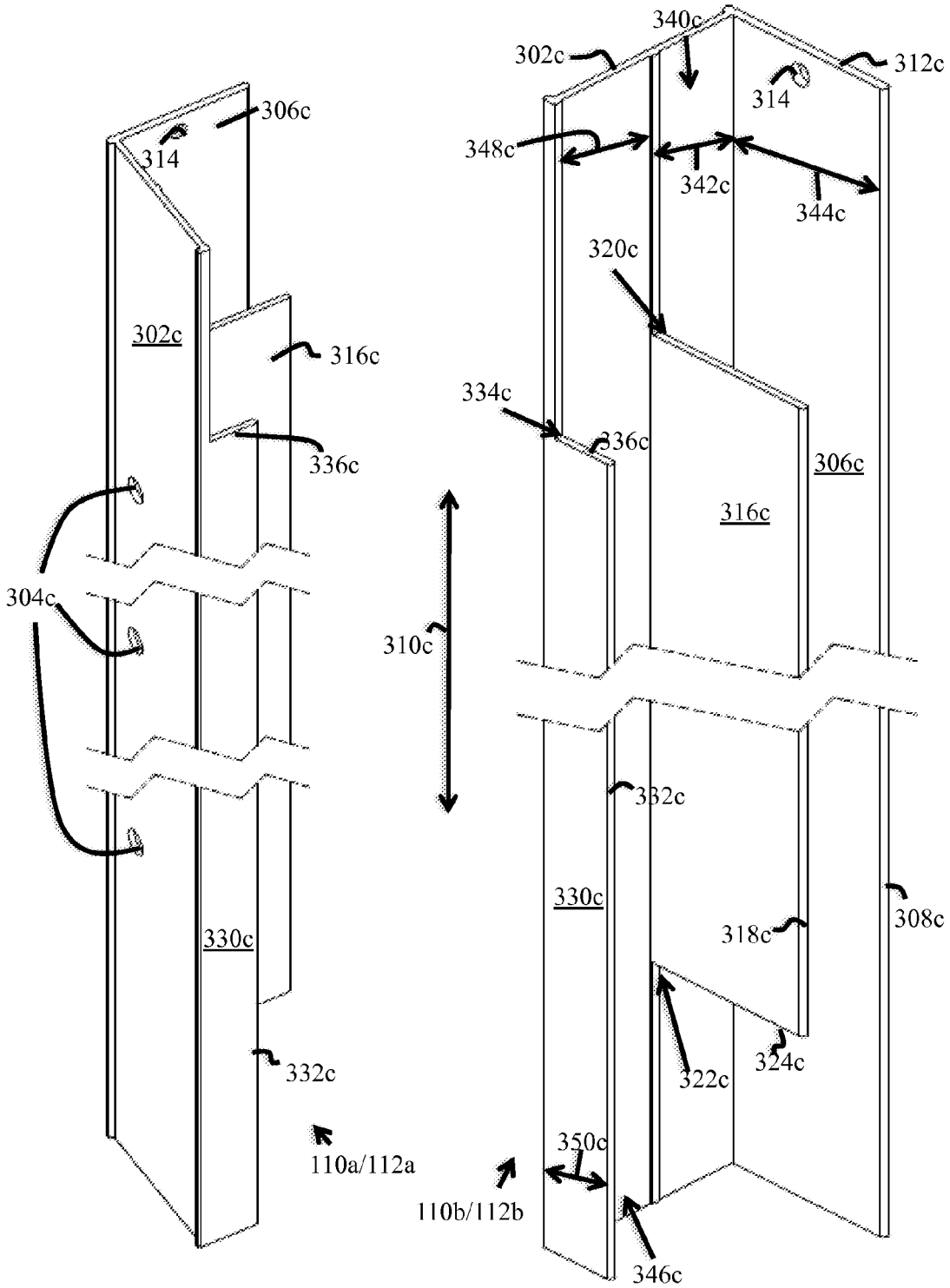

FIGS. 3A-1 to 3C-2 are non-limiting, exemplary illustrations of a jamb of an enclosure system in accordance with the present invention. FIGS. 3A-1 to 3A-2 are non-limiting, exemplary illustrative views of a jamb used with the inline enclosure shown in FIGS. 1A-1 to 1A-2. FIGS. 3B-1 to 3B-2 are non-limiting, exemplary illustrative views of a jamb used with the Neo-Angle enclosure shown in FIGS. 1B-1 and 1B-2. FIGS. 3C-1 to 3C-2 are non-limiting, exemplary illustrative views of a jamb used with the enclosure system shown in FIGS. 1C-1 and 1C-2.

As illustrated in FIGS. 3A-1 to 3C-2 and detailed below, in general, the enclosure system 100 of the present invention includes two jambs 110 and 112 that are coupled with lateral walls of the enclosure, the header 108, the sill 106, and stationary panels 114/116. In general, the jambs 110/112 are comprised of a jamb base 302 with one or more connection holes 304 that enable a coupling of a jamb 110/112 with the structure 102. The jambs 110 and 112 are mirror images of one another, with the drawing FIGS. 3A-1, 3B-1, and 3C-1 showing only the front, perspective left-sided jamb 112 (as viewed from outside the enclosure system 100 shown in FIGS. 1A-1, 1B-1, and 1C-1), and the respective FIGS. 3A-2, 3B-2, and 3C-2 showing the backside, perspective view of the same.

The jambs 110/112 include a first (or interior) fin 306 that has an first (or interior) length 308 that extends along an axial length 310 of the jambs 110/112, has a first (or interior) width 312 that is oriented at an angle to the jamb base 302, and has an upper fastener hole 314 (for the adjoining configuration that is illustrated in FIG. 3C-1) at an upper distal end for coupling with the header 108.

The jambs 110*a,c*/112*a,c* for the inline and adjoining configurations (FIGS. 3A-1 and 3A-2, and FIGS. 3C-1 and 3C-2) include a second (or middle) fin 316*a,c* that has a second length 318*a,c* that substantially extends along the axial length 310*a,c* of the jambs 110*a,c*/112*a,c*, having a top and a bottom notch 320*a,c* and 322*a,c* for respectively coupling the jambs 110*a,c*/112*a,c* with the header 108*a,c* and the sill 106*a,c*, and has a second width 324*a,c* that is oriented at an angle to the jamb base 302*a,c* and is equal to the first width 312*a,c*. The two notches (top and bottom 320*a,c* and 322*a,c*) facilitate right-handed and left-handed assembly, and enable the jambs to contact the header and the sill.

As further illustrated in FIGS. 3A-1 and 3A-2, and FIGS. 3C-1 and 3C-2 for the inline and adjoining configurations, the jambs 110*a,c*/112*a,c* further include an exterior (or third) fin 330*a,c* that has a third length 332*a,c* that substantially extends along the axial length 310*a,c* of the jamb 110*a,c*/112*a,c*, having a top notch 334*a,c*, with the third length 332*a,c* longer than the middle (or second) fin 316*a,c*, but shorter than the first 306*a,c*, and has a third width 336*a,c* that is oriented at an angle to the jamb base 302*a,c*, with the third width 336*a,c* having a shorter span than the first 312*a,c* and second 324*a,c* width. The first (or interior) fin 306, the second (or middle) fin 316, and the third (or exterior) fin 330 are parallel, with the first and second fins 306 and 316 forming a first channel 340*a,c* with a first channel width 342 and first channel depth 344*a,c*. The second and third fins 316*a,c* and 330*a,c* forming a second channel 346*a,c* with a second channel width 348*a,c* that is has a wider span than the first channel width 340*a,c*, and a second channel depth 350*a,c* that is limited by the third width 336*a,c*.

The jambs 110*b*/112*b* for the Neo-Angle configuration (FIGS. 3B-1 and 3B-2) include an exterior (or third) fin 330*b* that has a third length 332*b* that substantially extends along the axial length 310*b* of the jamb 110*b*/112*b*, and a third width 336*b* that is oriented at an angle to the jamb base 302*b*, with the third (or exterior) width 336*b* equaling the first (or interior) width 312*b*. The first (or interior) fin 306*b* and the third (or exterior) fin 330*b* are parallel, with the interior and exterior fins 306*b* and 330*b* forming a channel 352 with a channel width 354 (equal to the width of the base 302*b*) and a channel depth 356 defined by the widths 312*b* and 336*b* of the interior 306*b* and exterior 330*b* fins.

In general, the channel depths 344*a,c* and 356 are sufficiently deep for proper assembly of the stationary panel 114/116 (detailed below), accommodating for tolerances for construction variations. It is very common for a constructed wall not be perfectly vertical in relation to the ground (i.e., the wall not to be perfectly perpendicular to the ground). Therefore, the channel depths 344*a,c* and 356 must allow for imperfection of the wall, enabling the stationary panels 114/116 to be maintained therein regardless of the structural imperfections. Accordingly, the height and depths of the channel 344*a,c* and 356 provide sufficient tolerance for construction variations (e.g., verticalness of the wall in relation to the ground) to continue to accommodate the stationary panels 110/112.

Figures 2, 4A:
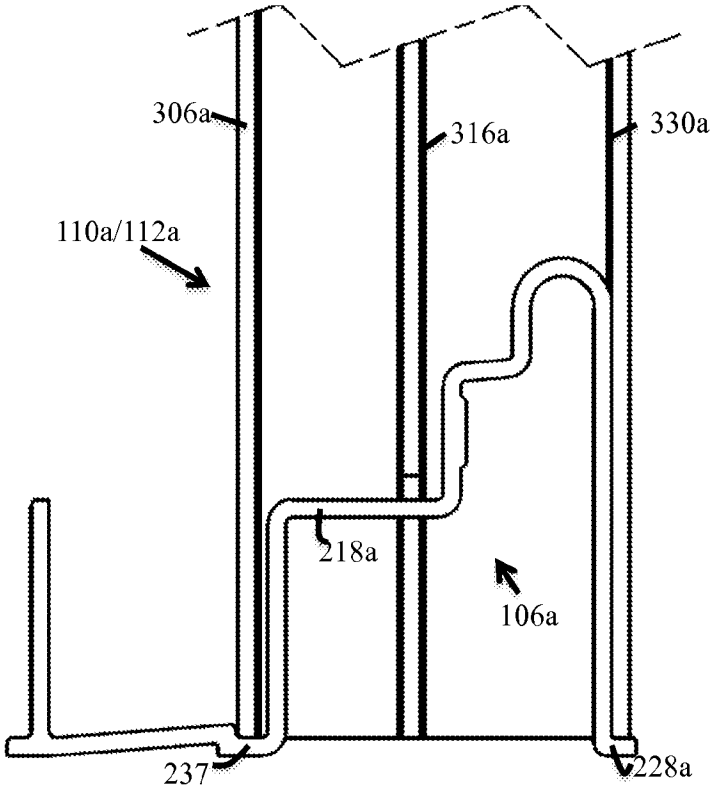
Figures 1, 4A:
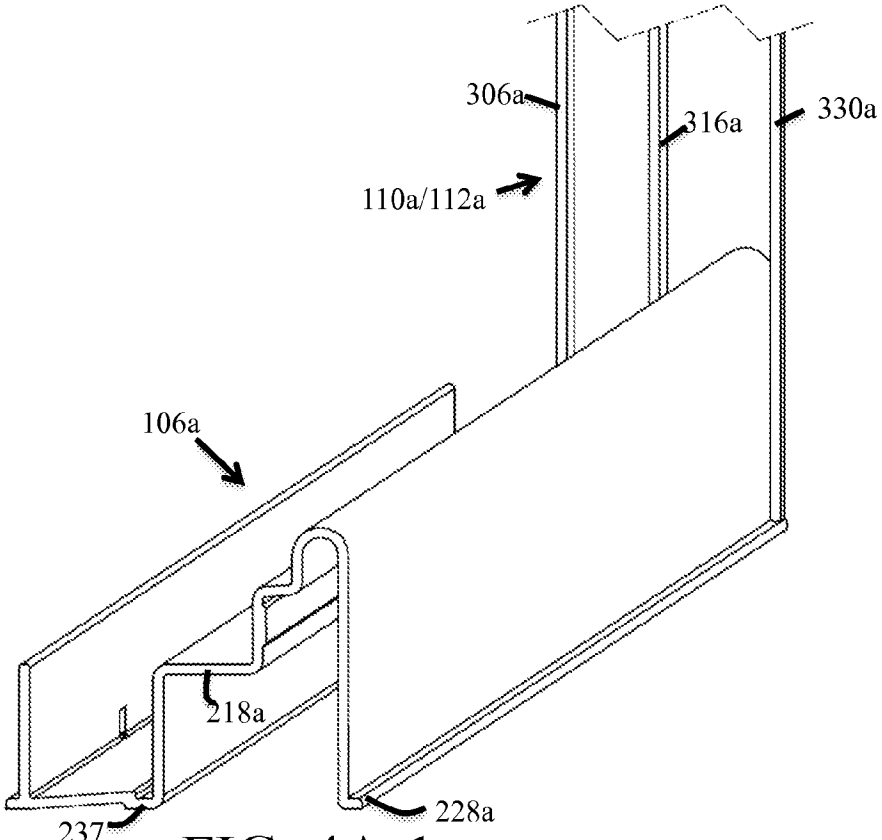
Figures 3, 4A:
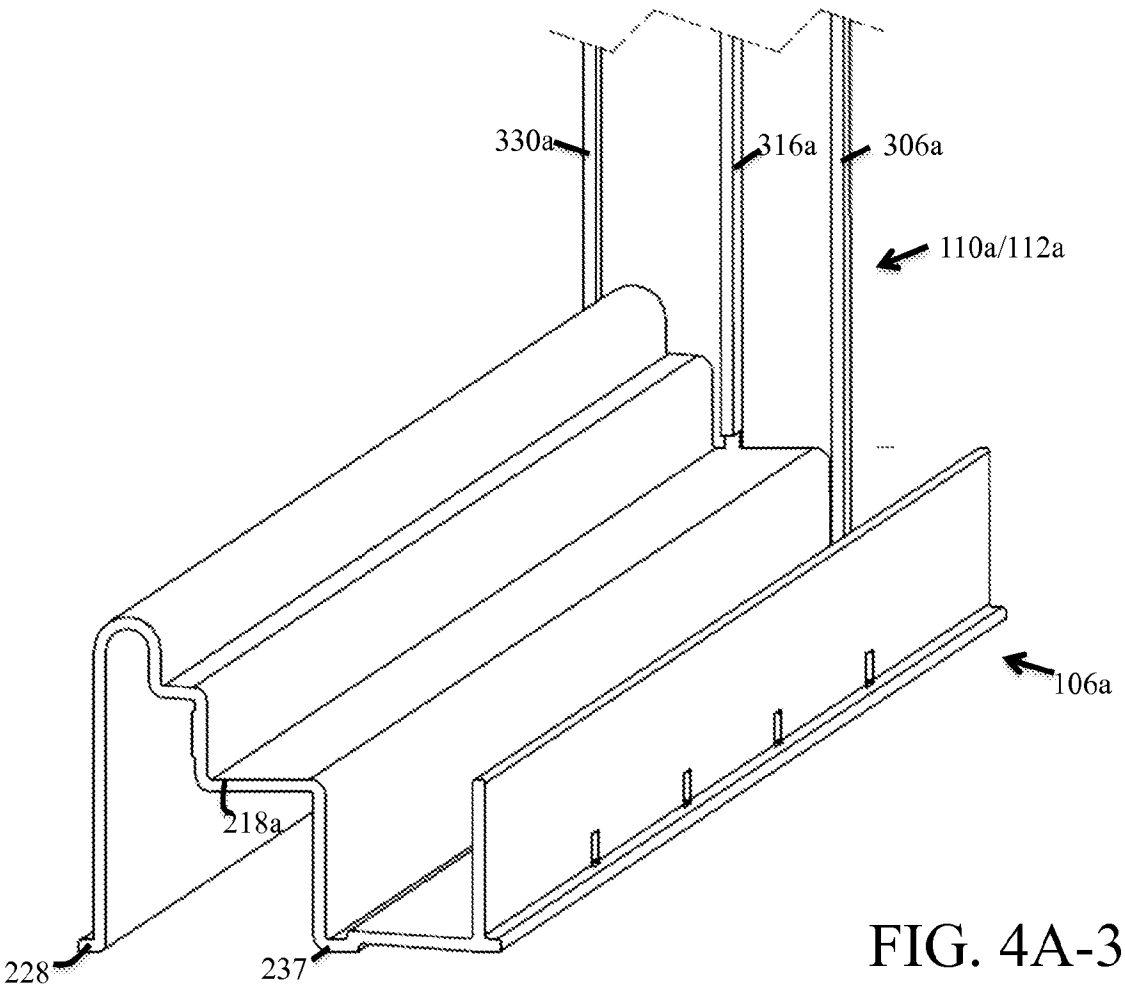
Figures 1, 4B:
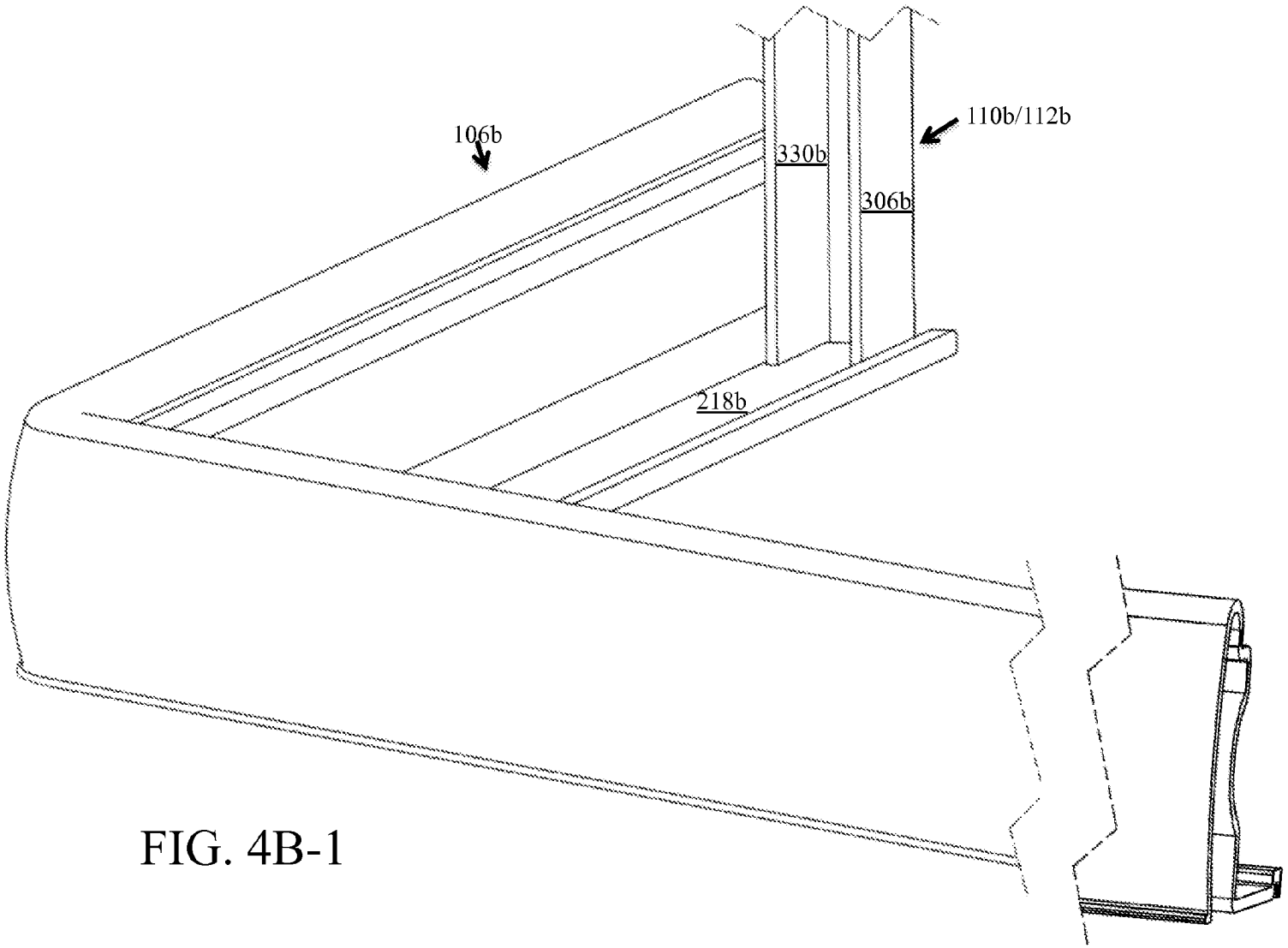
Figures 2, 4B:
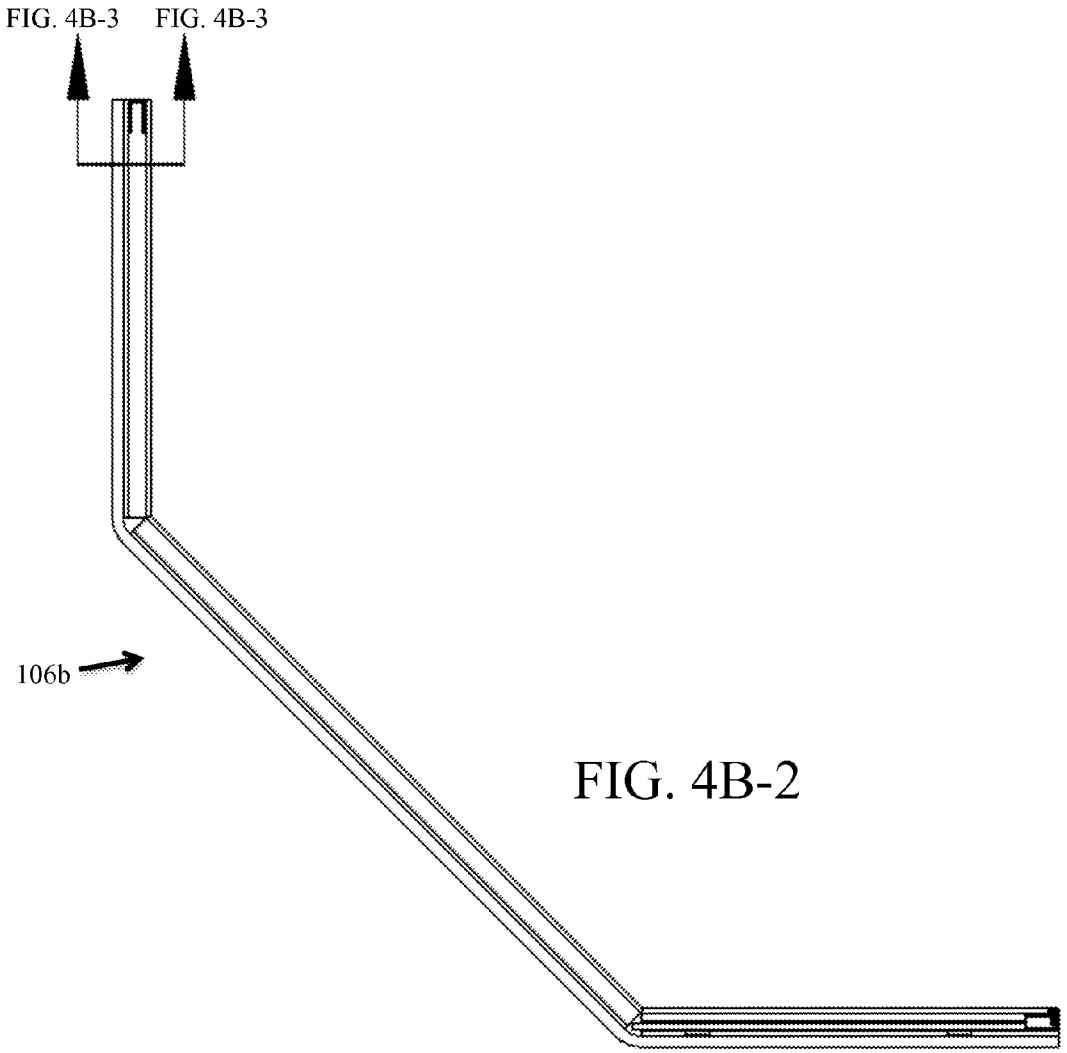
Figures 3, 4B:
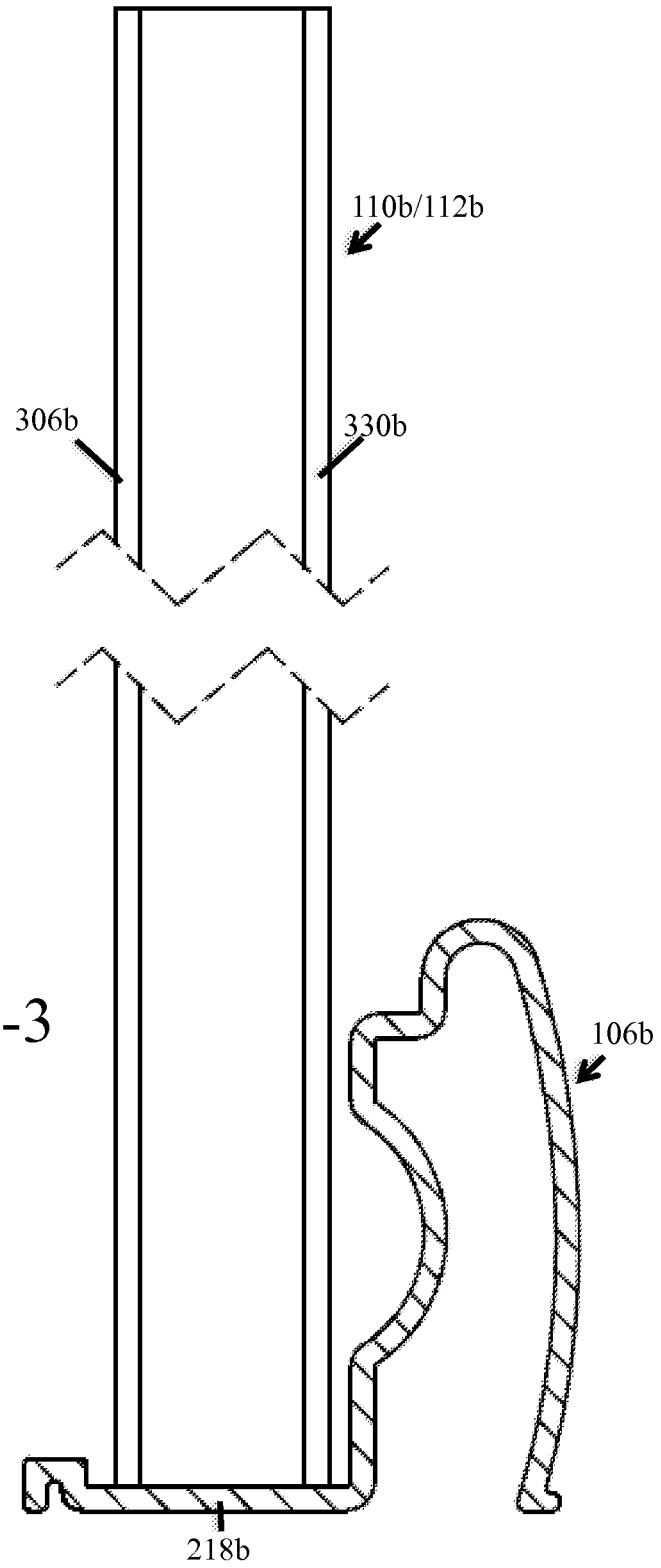
Figures 1, 4C:
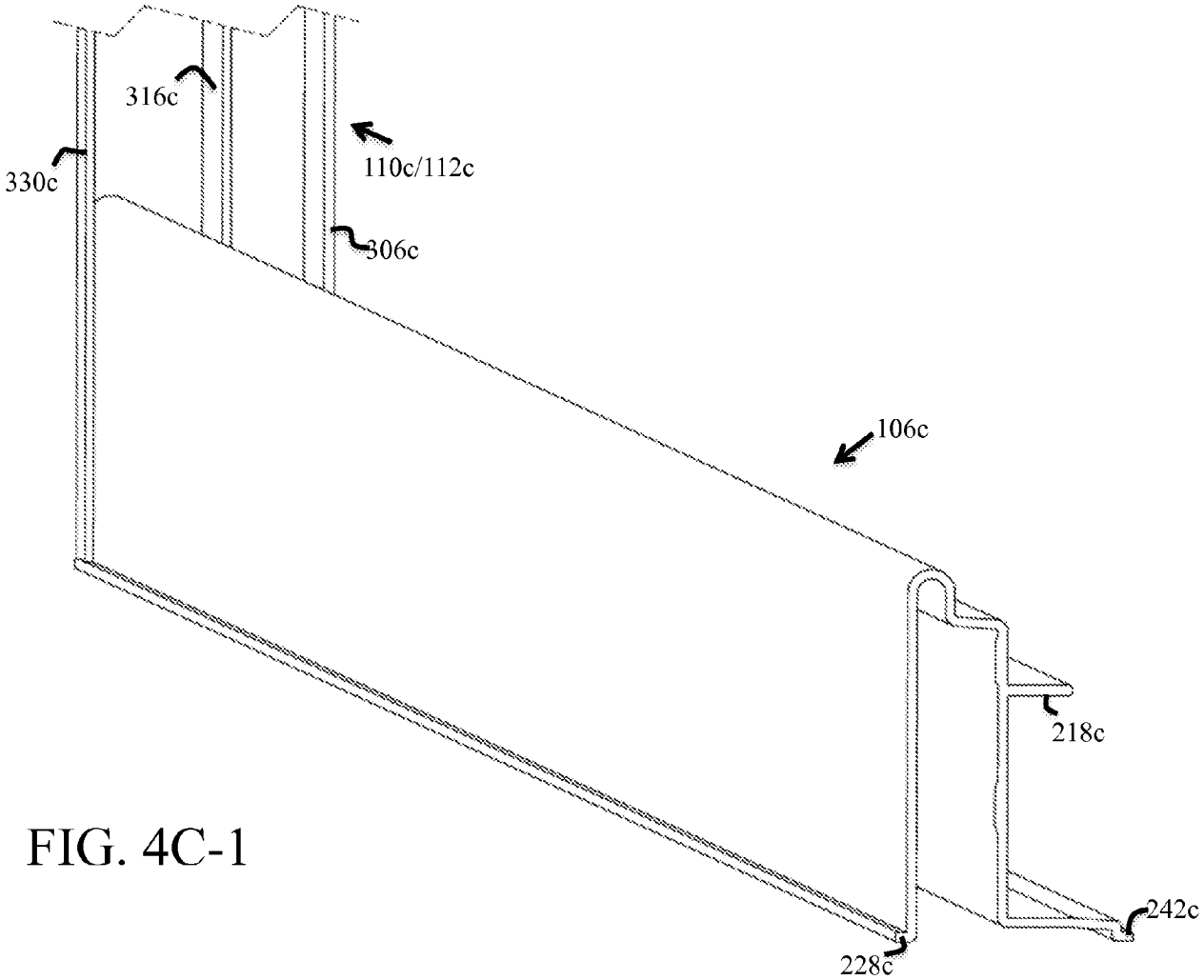
Figures 2, 4C:
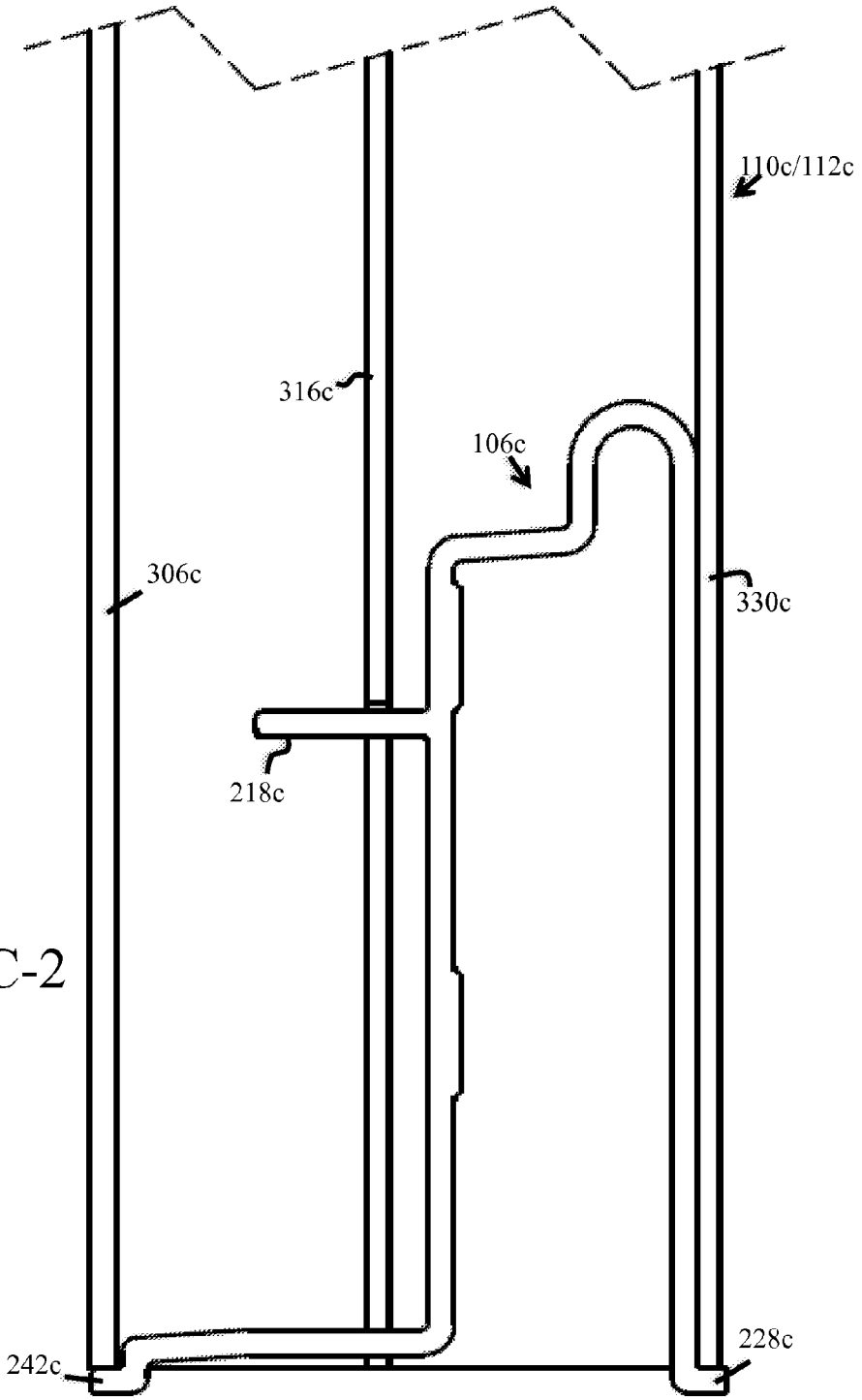
Figures 3, 4C:
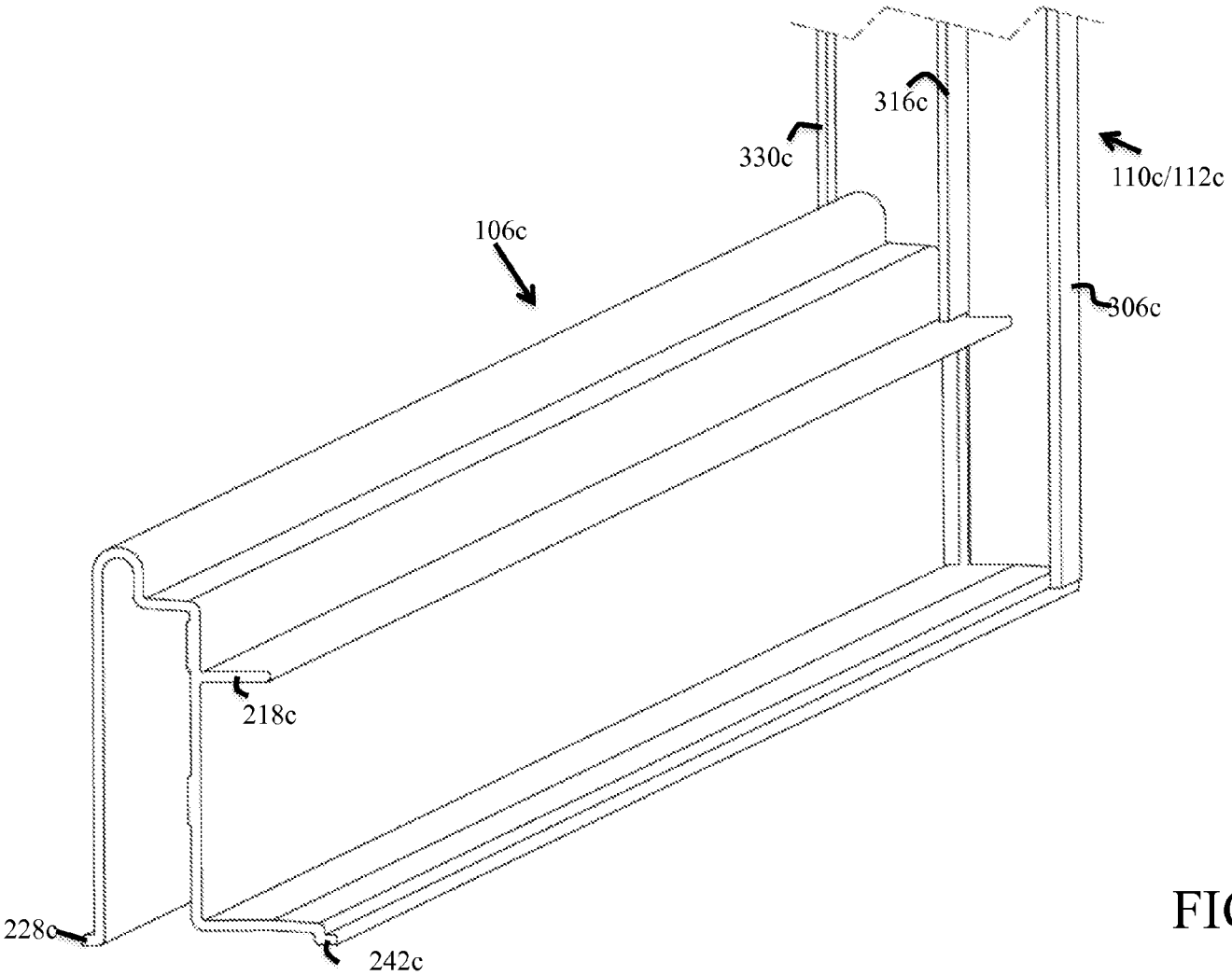

FIGS. 4A-1 to 4C-3 are non-limiting, exemplary illustrations of a jamb-sill combination of an enclosure system in accordance with the present invention. FIGS. 4A-1 to 4A-3 are non-limiting, exemplary illustrative views of a jamb-sill combination used with the inline enclosure shown in FIGS. 1A-1 to 1A-2. FIGS. 4B-1 to 4B-3 are non-limiting, exemplary illustrative views of a jamb-sill combination used with the Neo-Angle enclosure shown in FIGS. 1B-1 and 1B-2. FIGS. 4C-1 to 4C-3 are non-limiting, exemplary illustrative views of a jamb-sill combination used with the adjoining configuration enclosure system shown in FIGS. 1C-1 and 1C-2. The jamb-sill combinations shown in the figures are mirror images of one another, with the drawing FIGS. 4A-1 to 4C-3 showing left-sided jamb-sill combination (jamb 112).

As illustrated in FIGS. 4A-1 to 4A-3 and FIGS. 4C-1 to 4C-3 respectively for the inline and the adjoining configuration enclosures, the exterior portion 210*a,c* of the sill 106*a,c* accommodates the exterior fin 330*a,c* of a jamb 110*a,c*/112*a,c* and the interior portion 212*a,c* of the sill 106*a,c* accommodates the interior and middle fin 306*a,c* and 316*a,c* of the jamb 110*a,c*/112*a,c*. That is, the exterior portion 210*a,c* includes the exterior flange 228*a,c* upon which the exterior fin 330*a,c* of a jamb 110*a,c*/112*a,c* rests. The middle (or second) fin 316*a,c* rests (with the lower notch 322*a,c*) accommodates the stationary panel support 218*a,c* (with the interior fin 306*a,c* detailed below). It should be noted that prior to installation of the jambs 110*a,c*/112*a,c*, determination must be made as to handling of the unit, i.e., will the unit be left sided or right sided installation to install the remaining members accordingly.

As illustrated in FIGS. 4A-1 to 4A-3, the interior portion 212*a* of the sill 106*a* of the inline enclosure includes the lower step 237 upon which the interior fin 306*a* of the jamb 110*a*/112*a* rests. For the adjoining enclosure (FIGS. 4C-1 to 4C-3), the interior portion 212*c* of the sill 106*c* of the adjoining configuration includes the interior flange 242 upon which the interior fin 306*c* of the jamb 110*c*/112*c* rests. As illustrated in FIGS. 4B-1 to 4B-3 for the Neo-angle configuration enclosures, the interior portion 212*b* of the sill

106*b* accommodates both fins 306*b* and 330*b* of a jamb 110*b*/112*b*, resting on the stationary panel support 218*b*.

Figures 1, 5A:
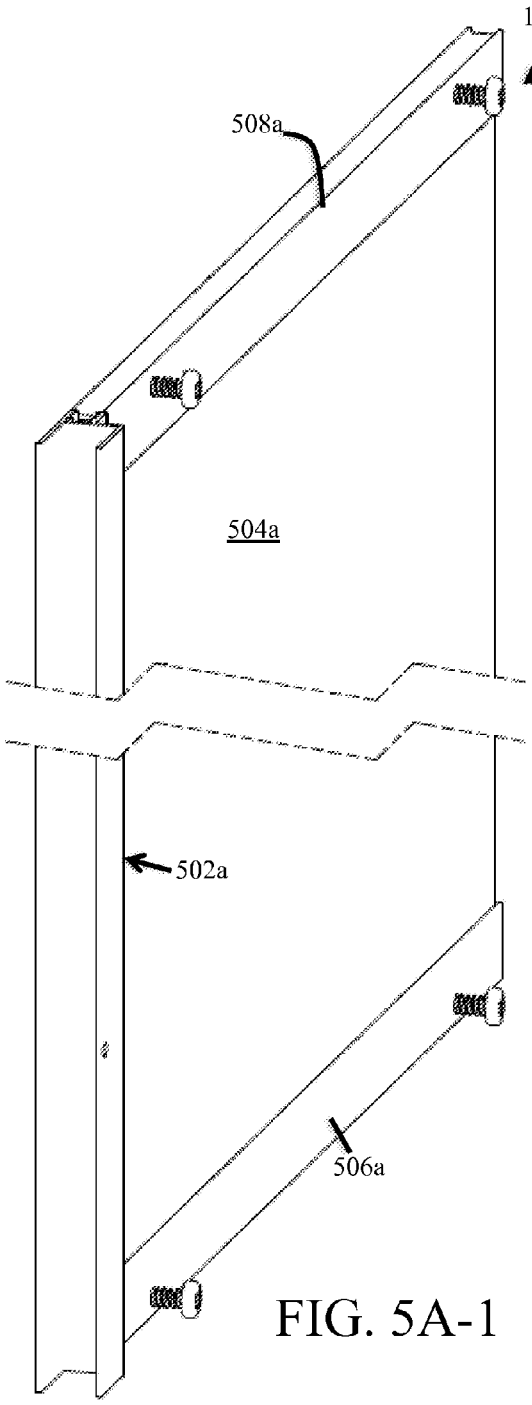
Figures 2, 5A:
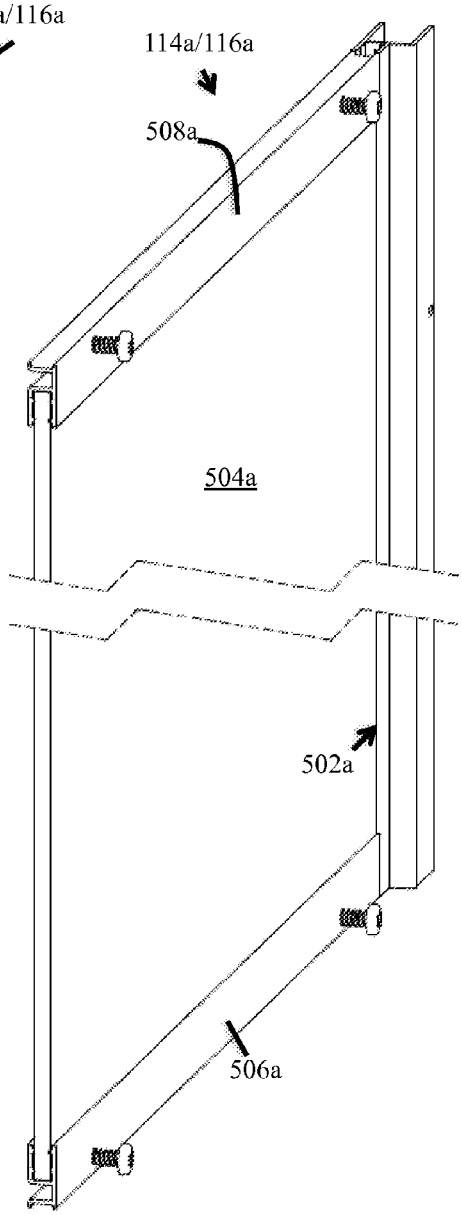
Figures 1, 5B:
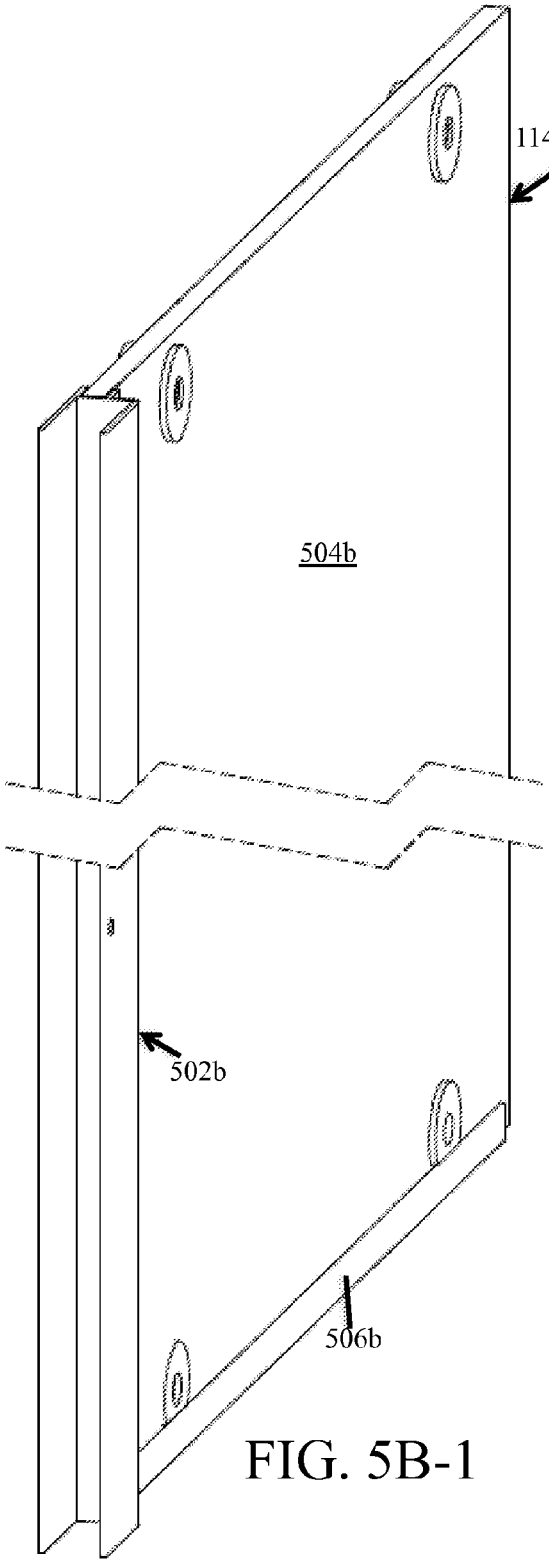
Figures 2, 5B:
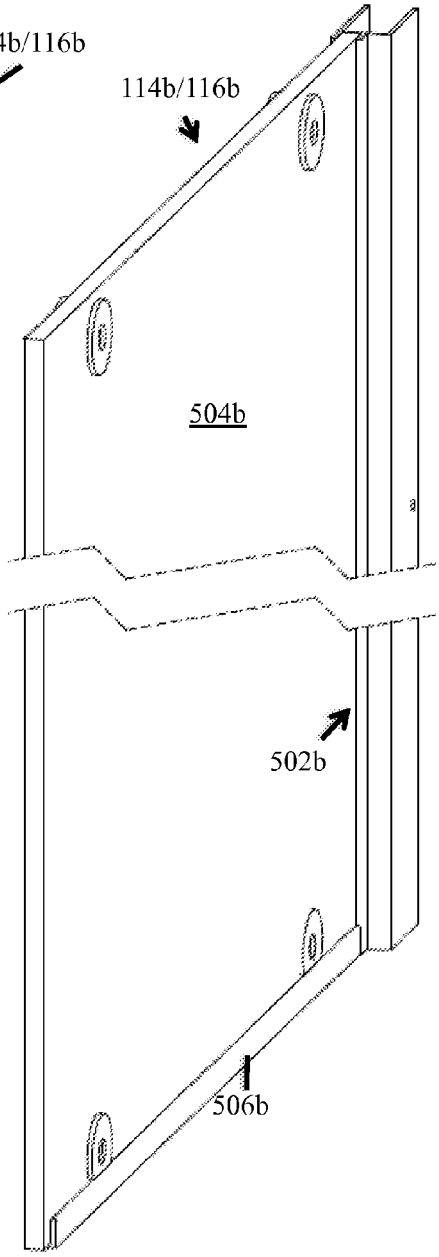
Figures 1, 5C:
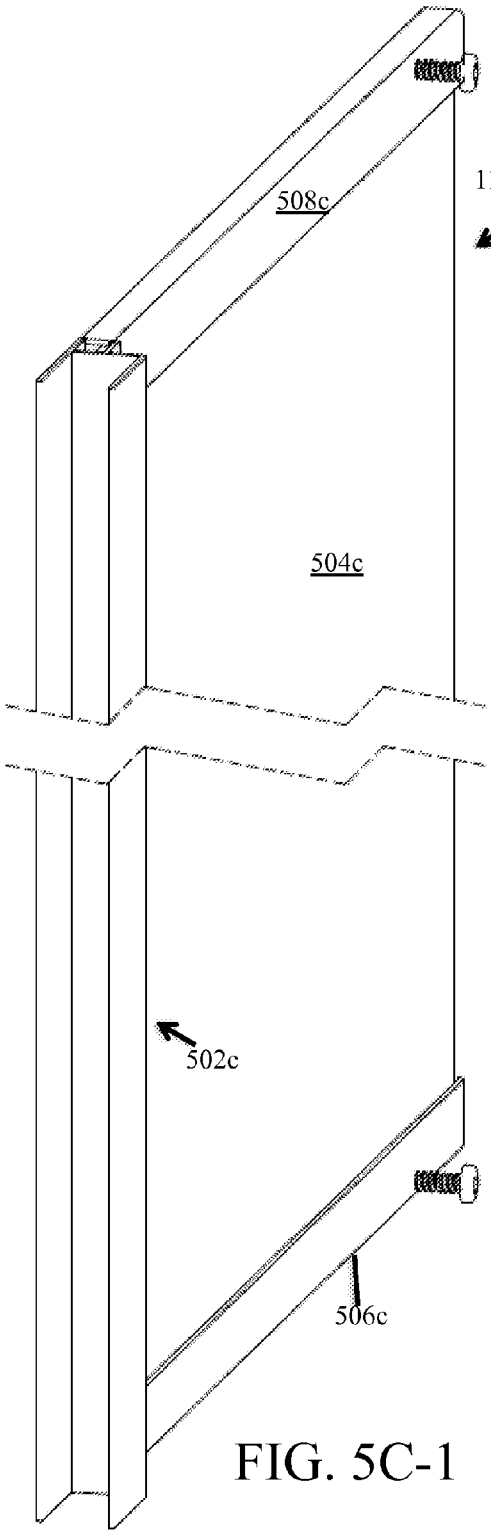
Figures 2, 5C:
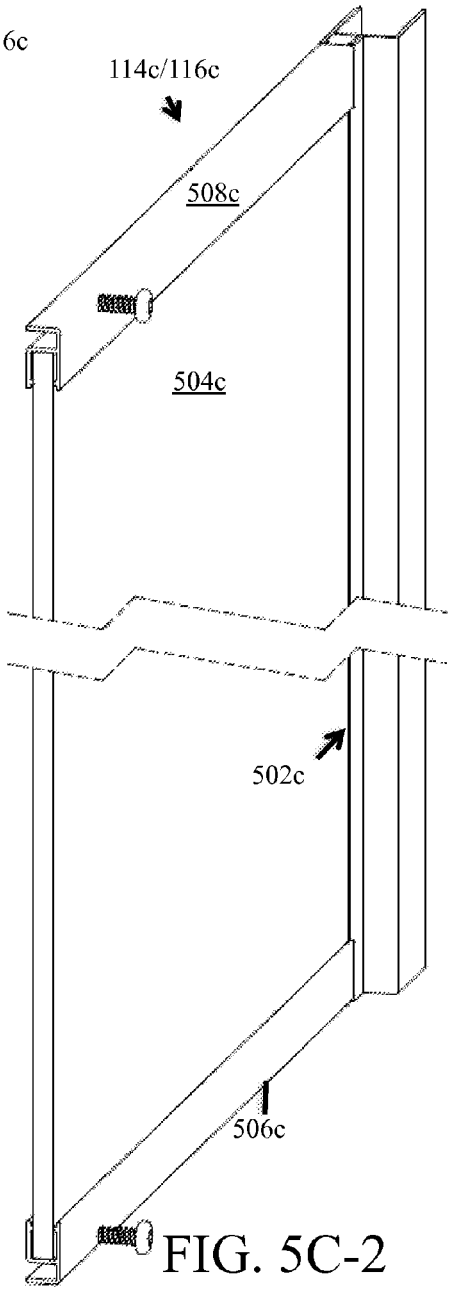

FIGS. 5A-1 to 5C-2 are non-limiting, exemplary illustrations of a stationary panel of enclosure systems in accordance with the present invention. FIGS. 5A-1 and 5A-2 are non-limiting, exemplary illustrative views of a stationary panel used with the inline enclosure shown in FIGS. 1A-1 to 1A-2. FIGS. 5B-1 and 5B-2 are non-limiting, exemplary illustrative views of a stationary panel used with the Neo-Angle enclosure shown in FIGS. 1B-1 and 1B-2. FIGS. 5C-1 to 5C-2 are non-limiting, exemplary illustrative views of a stationary panel used with the enclosure system shown in FIGS. 1C-1 and 1C-2. The stationary panels are mirror images of one another, with the drawing FIGS. 5A-1, 5B-1, and 5C-1 showing the perspective right-sided stationary panel 114 (as viewed from outside the enclosure system shown in FIGS. 1A-1, 1B-1, and 1C-1), and the respective FIGS. 5A-2, 5B-2, and 5C-2 showing the backside, perspective view of the same.

As illustrated in FIGS. 5A-1 to 5C-2 and detailed below, in general, the stationary panel 114/116 includes a transparent rigid material 504 (such as glass) that is framed on three sides and includes a lateral frame 502 that slides over the fins of the jambs 110/112 (on the non-accessing side(s) of the enclosure). The stationary panel 114*a,c*/116*a,c* of the inline and adjoining configurations further include an upper frame member 508 of the stationary panel frame that secures to the header 108, while a lower frame member 506*a,c* secures to the sill 106.

Figure 6A:
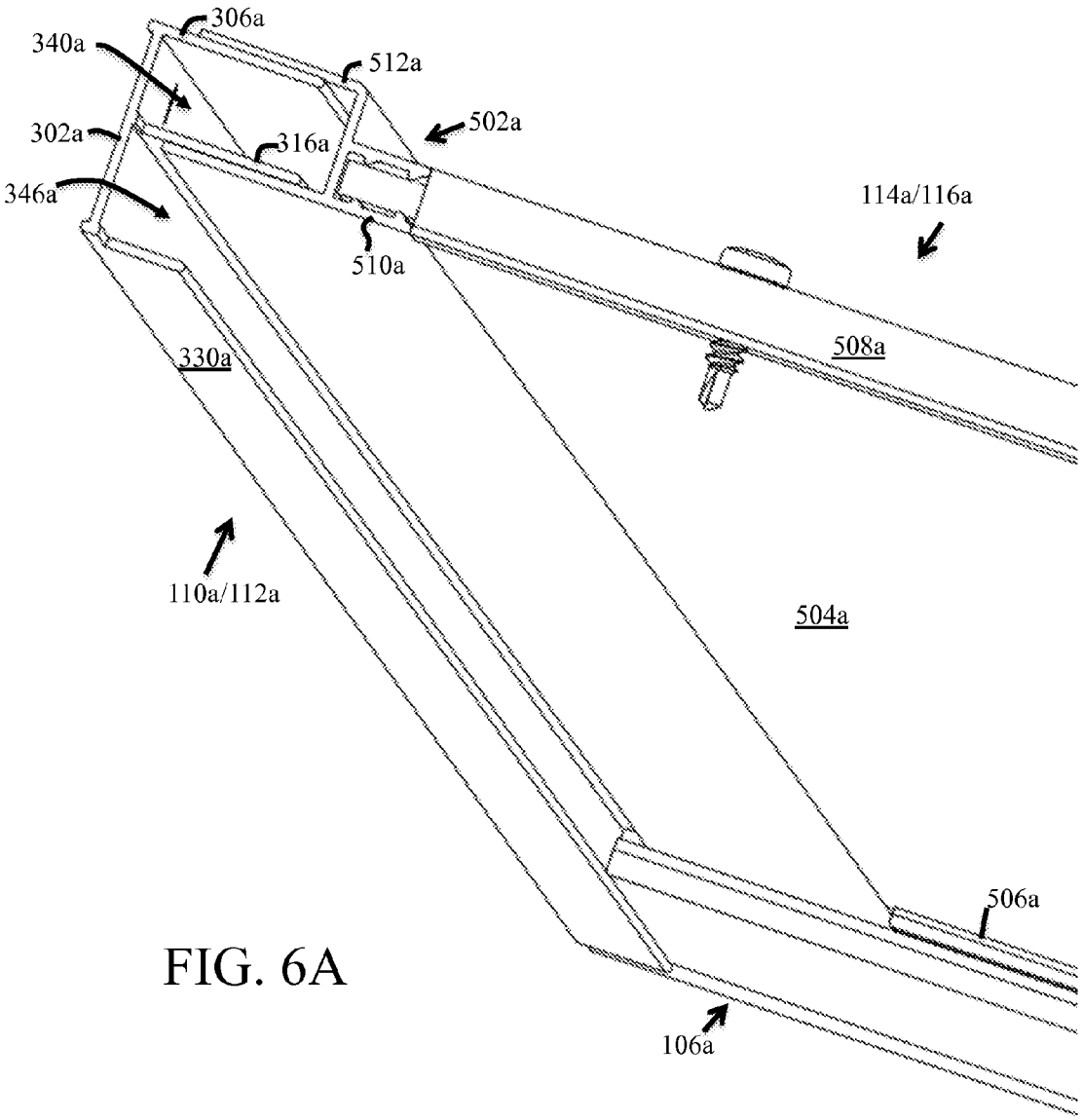
Figure 6B:
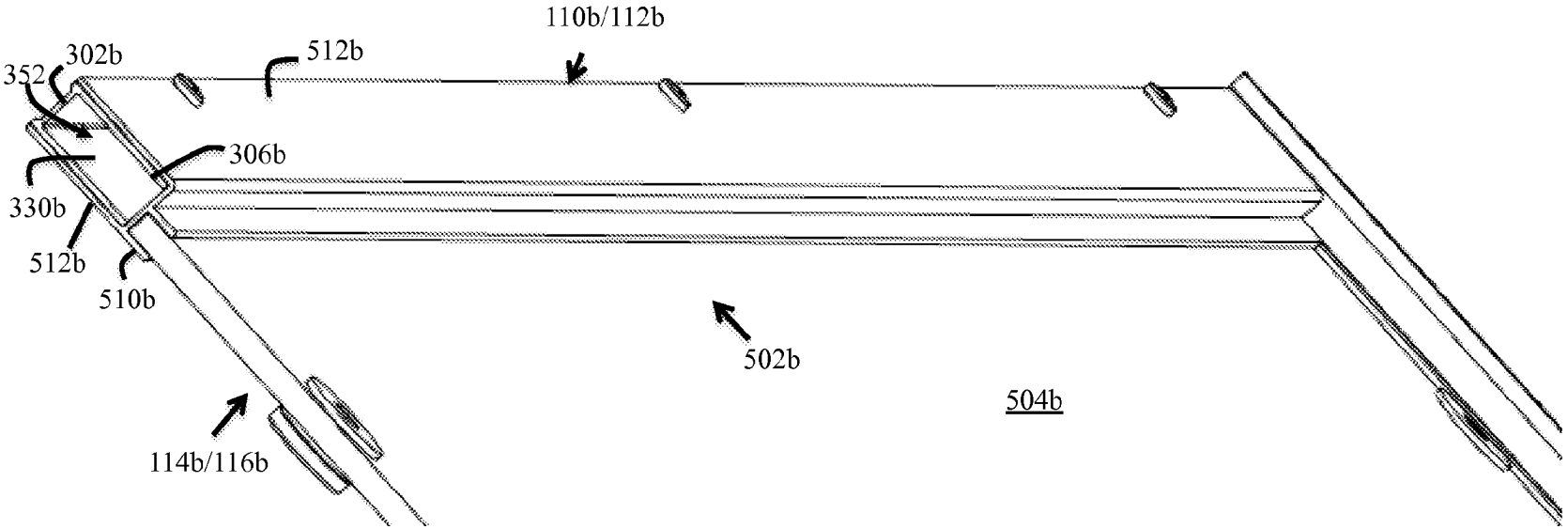
Figures 1, 6C:
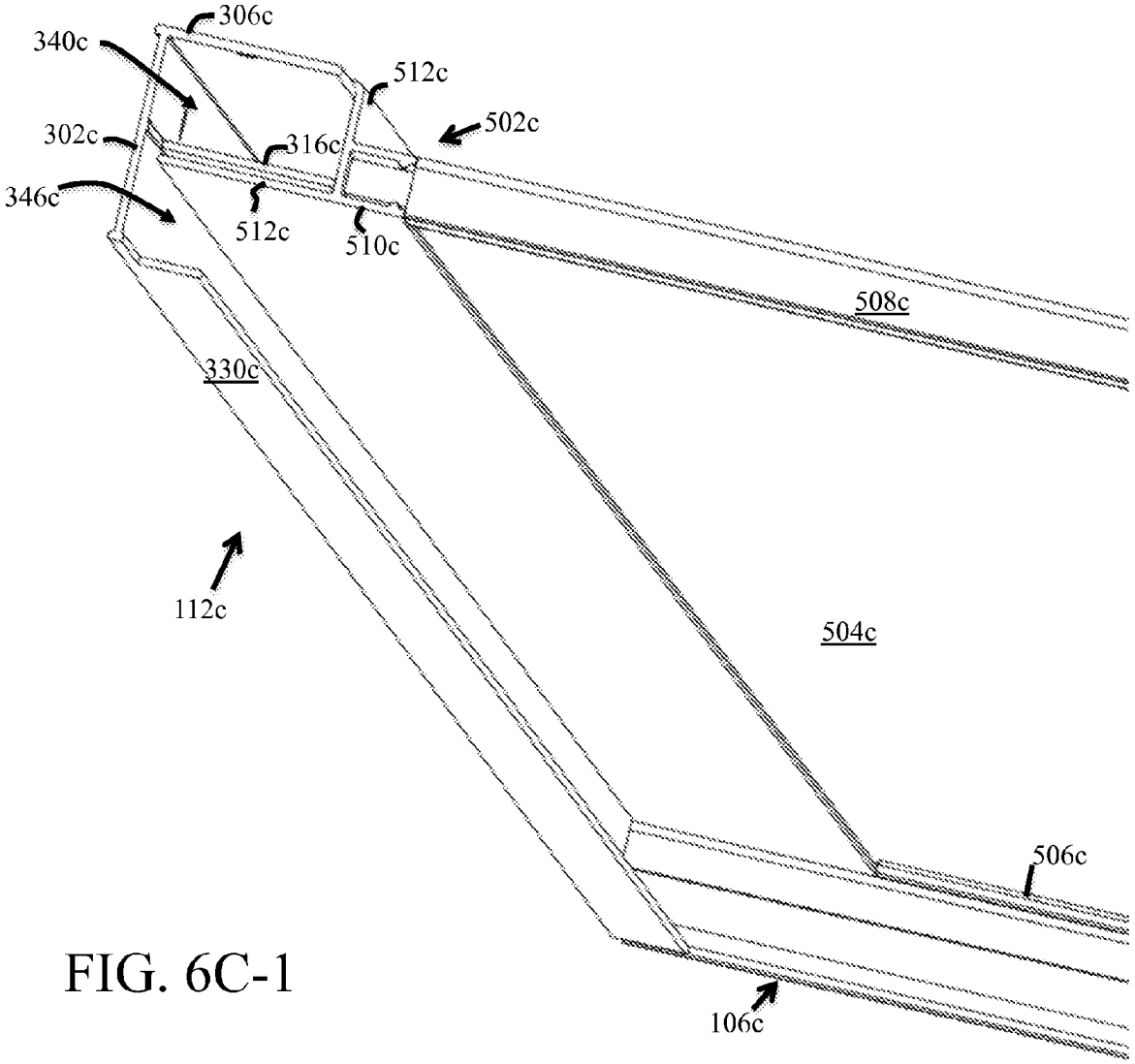
Figures 2, 6C:
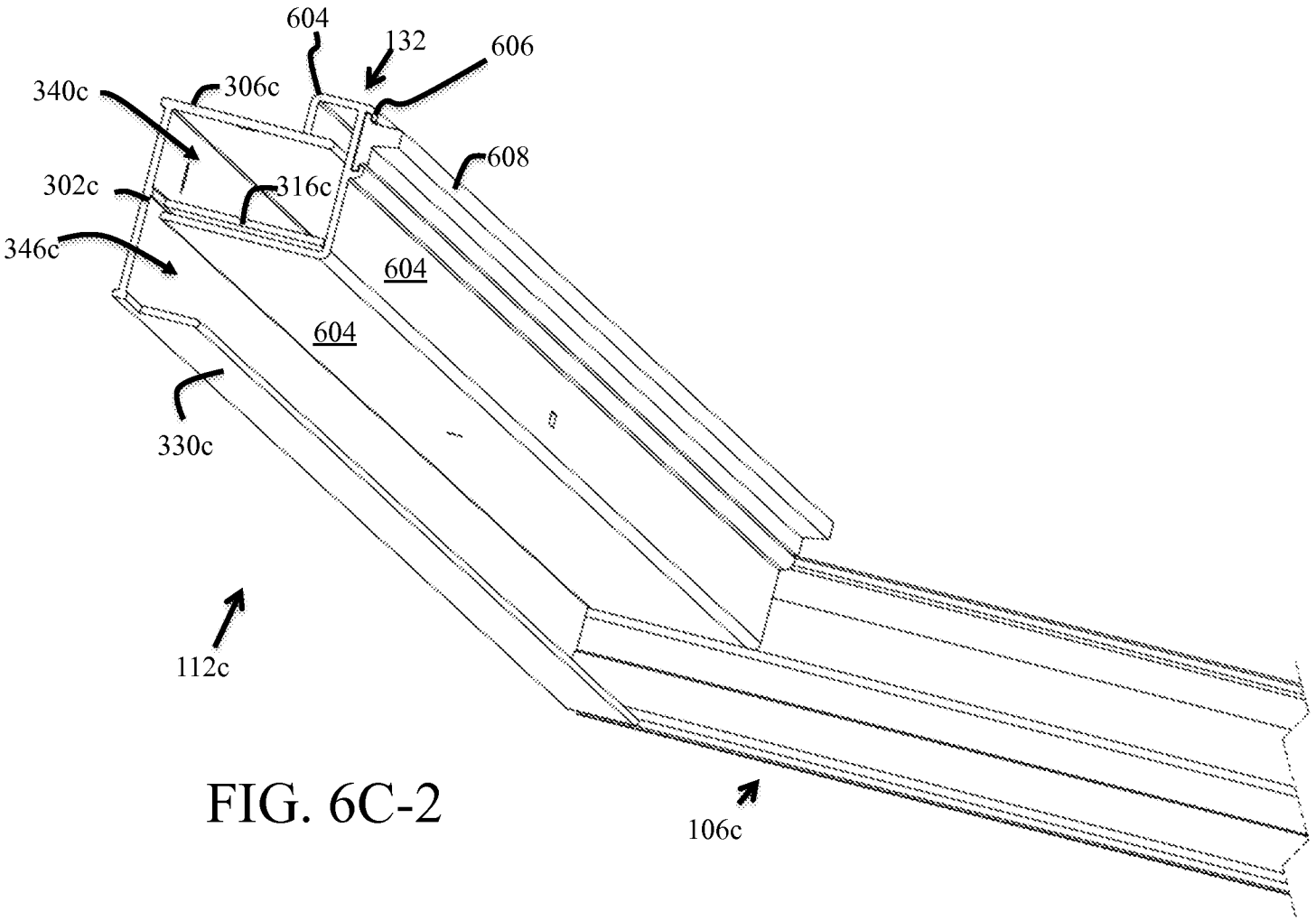
Figures 3, 6C:
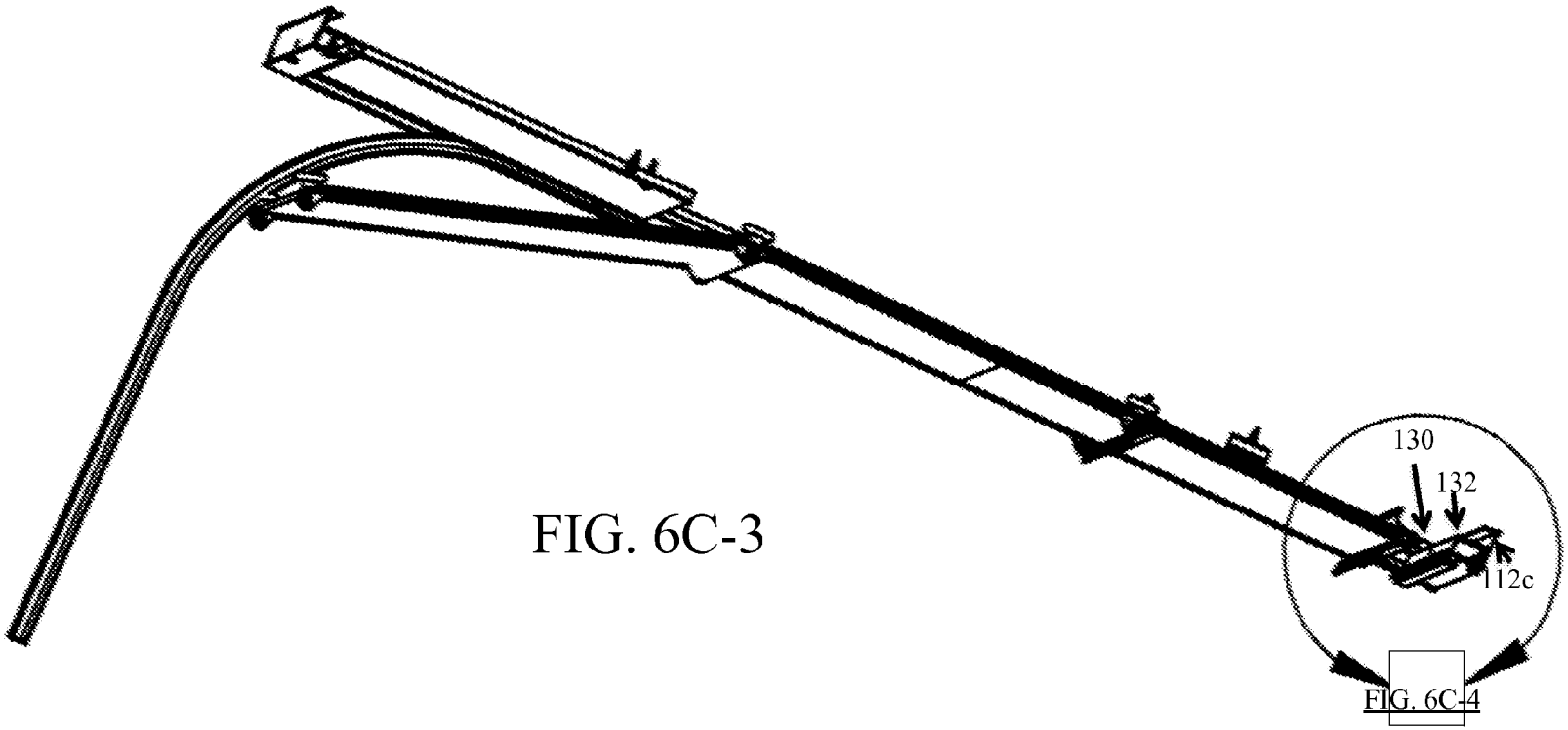
Figures 4, 6C:
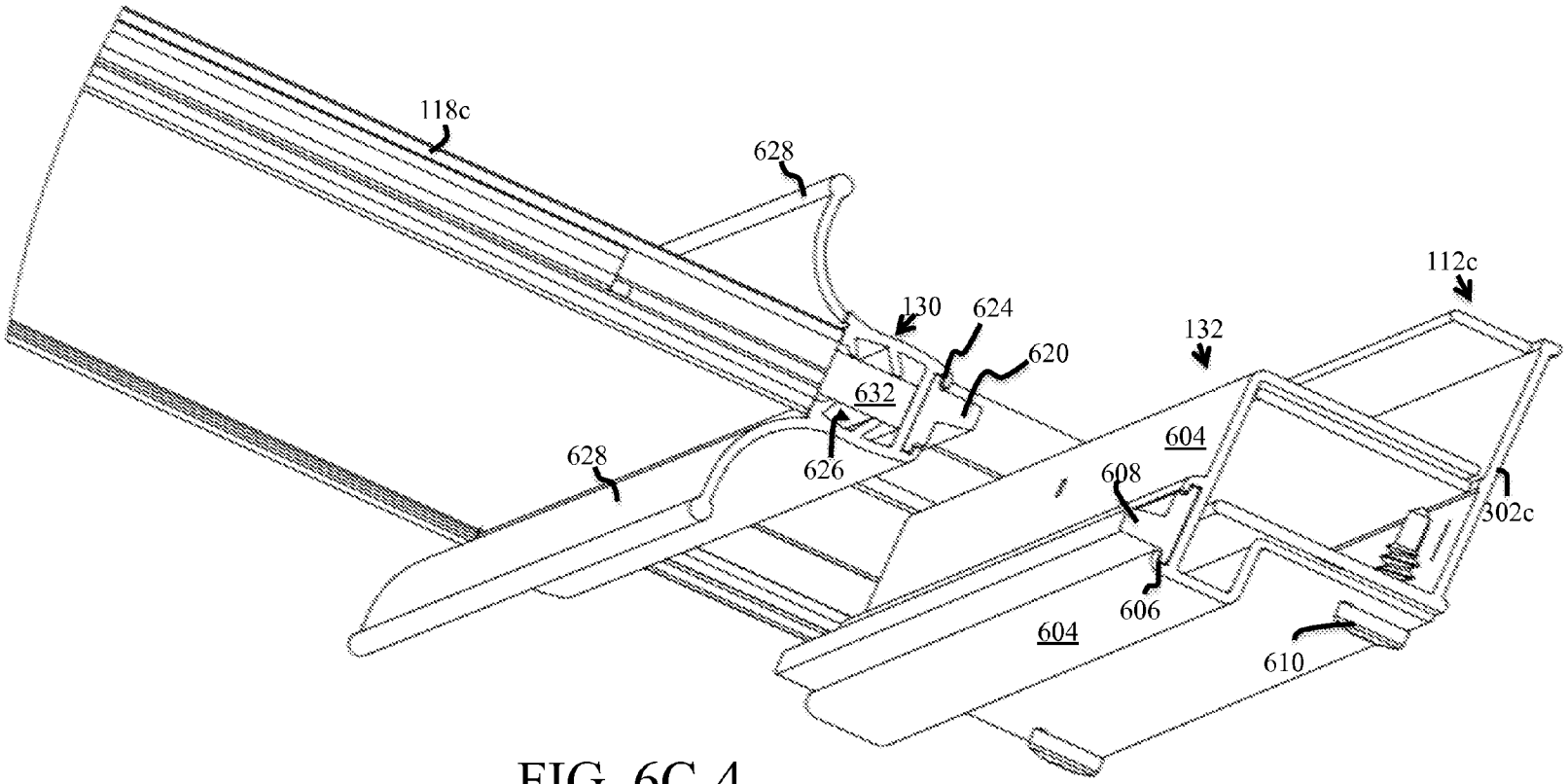

FIGS. 6A to 6C-4 are non-limiting, exemplary illustrations of a stationary panel-jamb combination of enclosure systems in accordance with the present invention. FIG. 6A is a non-limiting, exemplary illustrative view of a stationary panel jamb combination used with the inline enclosure shown in FIGS. 1A-1 to 1A-2. FIG. 6B is a non-limiting, exemplary illustrative view of a stationary panel-jamb combination used with the Neo-Angle enclosure shown in FIGS. 1B-1 and 1B-2. FIGS. 6C-1 to 6C-4 are non-limiting, exemplary illustrative views of a stationary panel jamb combinations used with the enclosure system shown in FIGS. 1C-1 and 1C-2.

FIGS. 6A and 6B show the left-sided stationary panel 116-jamb 112 combination for the respective inline and neo-angle configurations, with the right side being their mirror image, with the right sided combination being a mirror image. The left and right orientations for the stationary panel-jamb combination for the adjoining configuration are shown separately in FIGS. 6C-1 and 6C-2 to 6C-4.

As best illustrated in FIG. 6A, the lateral frame 502*a* includes a first coupling 510*a* that couples with the rigid member 504*a*, and a second coupling 512*a*, facing opposite the first 510*a*, which slides over a first (or interior) fin 306*a* and the second (or middle) fin 316*a* of the jamb 110*a*/112*a* (the first channel 340), with fasteners securing the stationary panel 114*a*/116*a* with the jamb 110*a*/112*a* along an axial length of the lateral frame 502*a* section covering over the channel 340*a*, facing the interior. As indicated above, the second channel 346*a* of the jamb with a shallower depth accommodates the one or more connection holes 304*a*, and facilitates in inserting a set of fasteners through the connection holes for connection of the jamb 110/112 with the structure 102.

As best illustrated in FIG. 6B, the lateral frame 502*b* includes a first coupling 510*b* that couples with the rigid member 504*b*, and a second coupling 512*b*, facing opposite the first 510*b*, which slides over a first (or interior) fin 306*b* and the second (or middle) fin 316*b* of the jamb 110*b*/112*b* (the channel 352), with fasteners securing the stationary panel 114*b*/116*b* with the jamb 110*b*/112*b* along an axial length of the lateral frame 502*b* section covering over the channel 352, facing the interior.

As best illustrated in FIGS. 6C-1 to 6C-4, the lateral frame 502*c* includes a first coupling 510*c* that couples with the rigid member 504*c*, and a second coupling 512*c*, facing opposite the first 510*c*, which slides over a first (or interior) fin 306*c* and the second (or middle) fin 316*c* of the jamb 112*c* (the first channel 340*c*), with fasteners securing the stationary panel 250*a* with the jamb 112*c* along an axial length of the lateral frame 502*c* section covering over the first fin 306*c*, facing the interior. As indicated above, the second channel 346*c* of the jamb with a shallower depth accommodates the one or more connection holes 304*c*, and facilitates in inserting a set of fasteners through the connection holes. All fasteners for all three types of enclosures are positioned and used from within the shower area for an esthetically pleasing look from outside. Further, the first and the second coupling 510 and 512 are comprised of a single piece.

As best illustrated in FIG. 6C-2, the adjoining configuration enclosure includes the jamb 112*c* to which a strike jam 132 is connected. The strike jamb 132 includes a sleeve 604 that slides over the channel 340*c* (covering the fins 306*c* and 316*c*), and includes a housing 606 for a magnet 608. The strike jamb 132 is connected to the jamb 112*c* by a set of fasteners 610 (FIG. 6C-4) from the inside of the enclosed space.

FIGS. 6C-3 and 6C-4 exemplarily illustrate the stile-strike jamb combination. As described above, the strike jamb 132 includes the housing 606 for a first section of a closure mechanism (magnet 608) that couples with a complementary, second section of the closure mechanism (magnet 620) of a non-stationary panel 118*c* to detachably maintain the non-stationary panel 118*c* in a closed position. A stile 130 includes a raceway 624 that extends longitudinally along an axial length of the stile 130, which accommodates a second section 620 of a closure mechanism that couples with a complementary, first section 608 of the closure mechanism to detachably maintain the non-stationary panel in a closed position. The stile 130 further includes a securing channel 626 that extends longitudinally along an axial length of the stile 130. The securing channel 626 receives a first side 632 of a non-stationary panel 118*c* to secure the stile 130 with the non-stationary panel. A handle 628 that is associated with the stile 130 along an exterior side of the securing channel 626 for facilitating articulation of the non-stationary panel 118*c*. It should be noted that the same closure mechanism 620 and 608 is used for the inline and neo-angle closure configurations, and associated with their respective non-stationary panels 118*a,b* and 120*a,b*.

Figures 1, 7A:
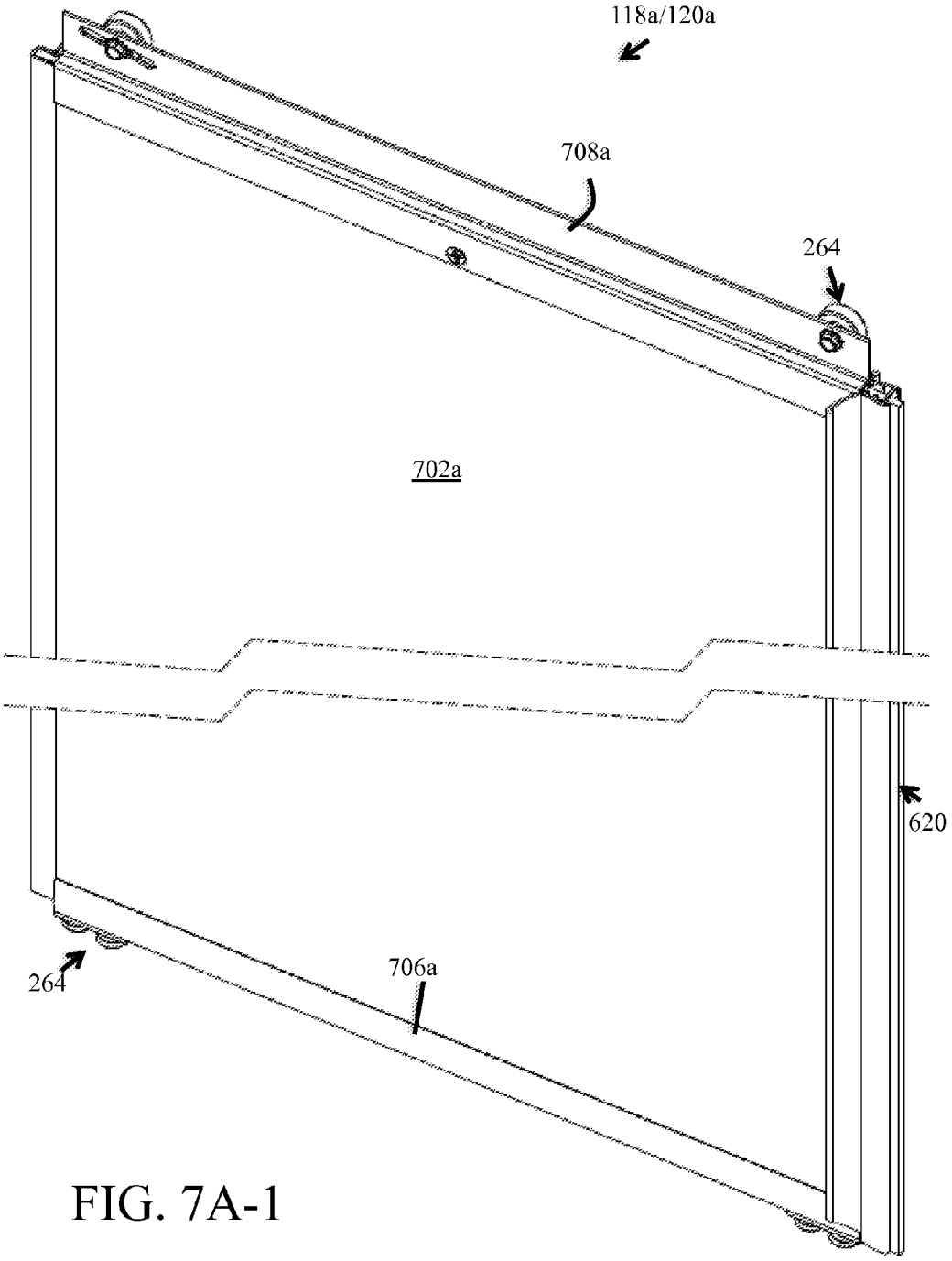
Figures 2, 7A:
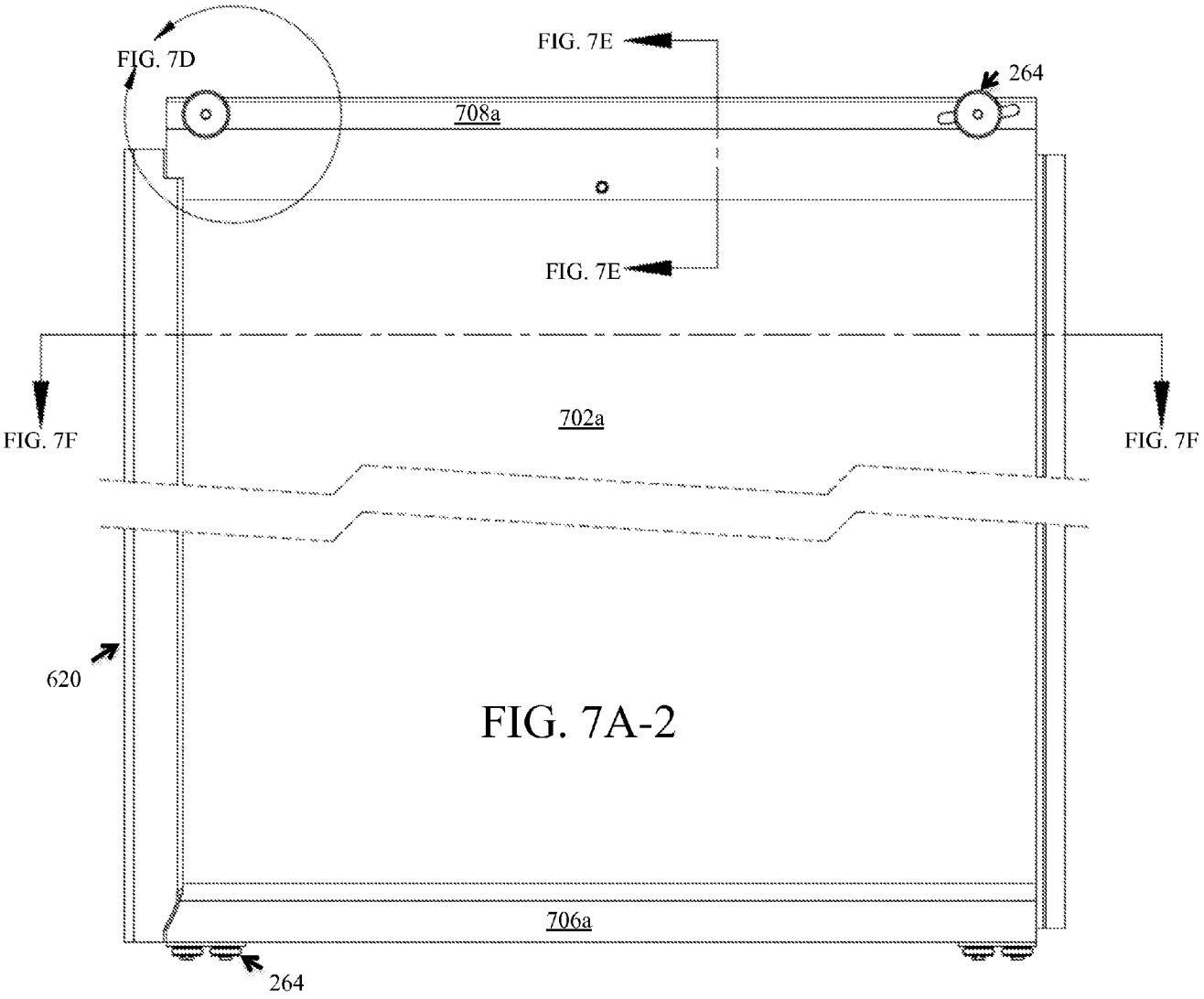
Figures 1, 7B:
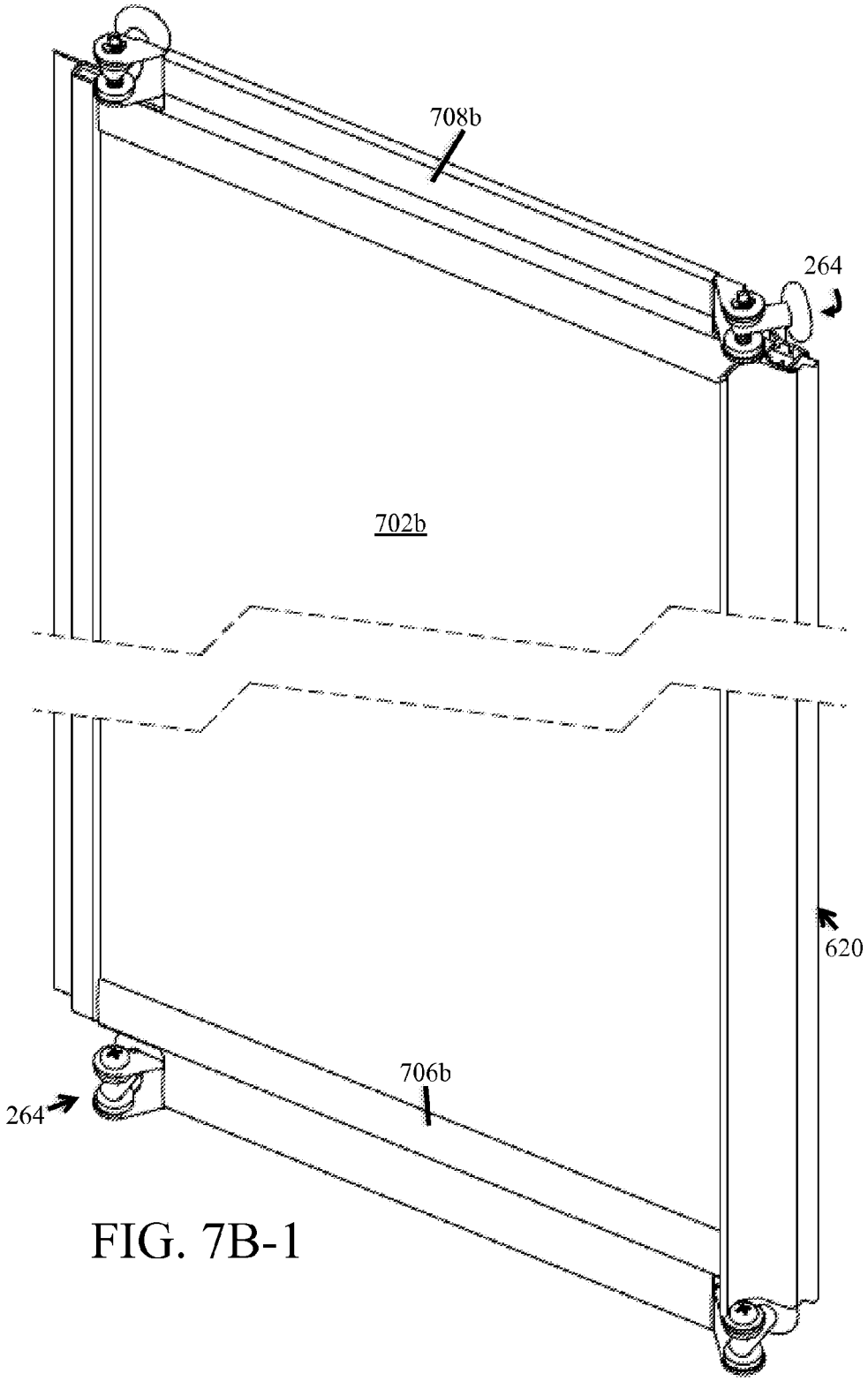
Figures 2, 7B:
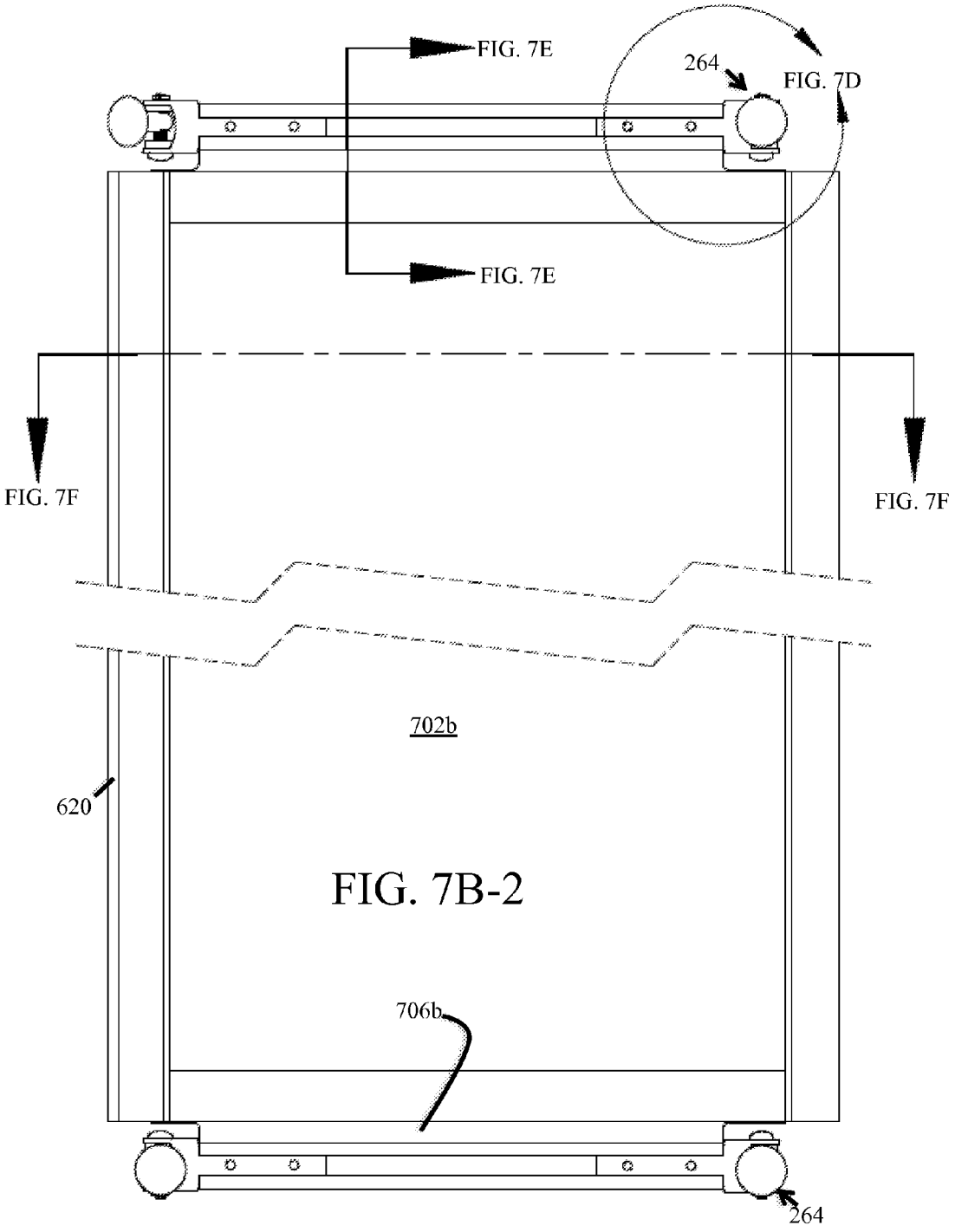
Figures 1, 7C:
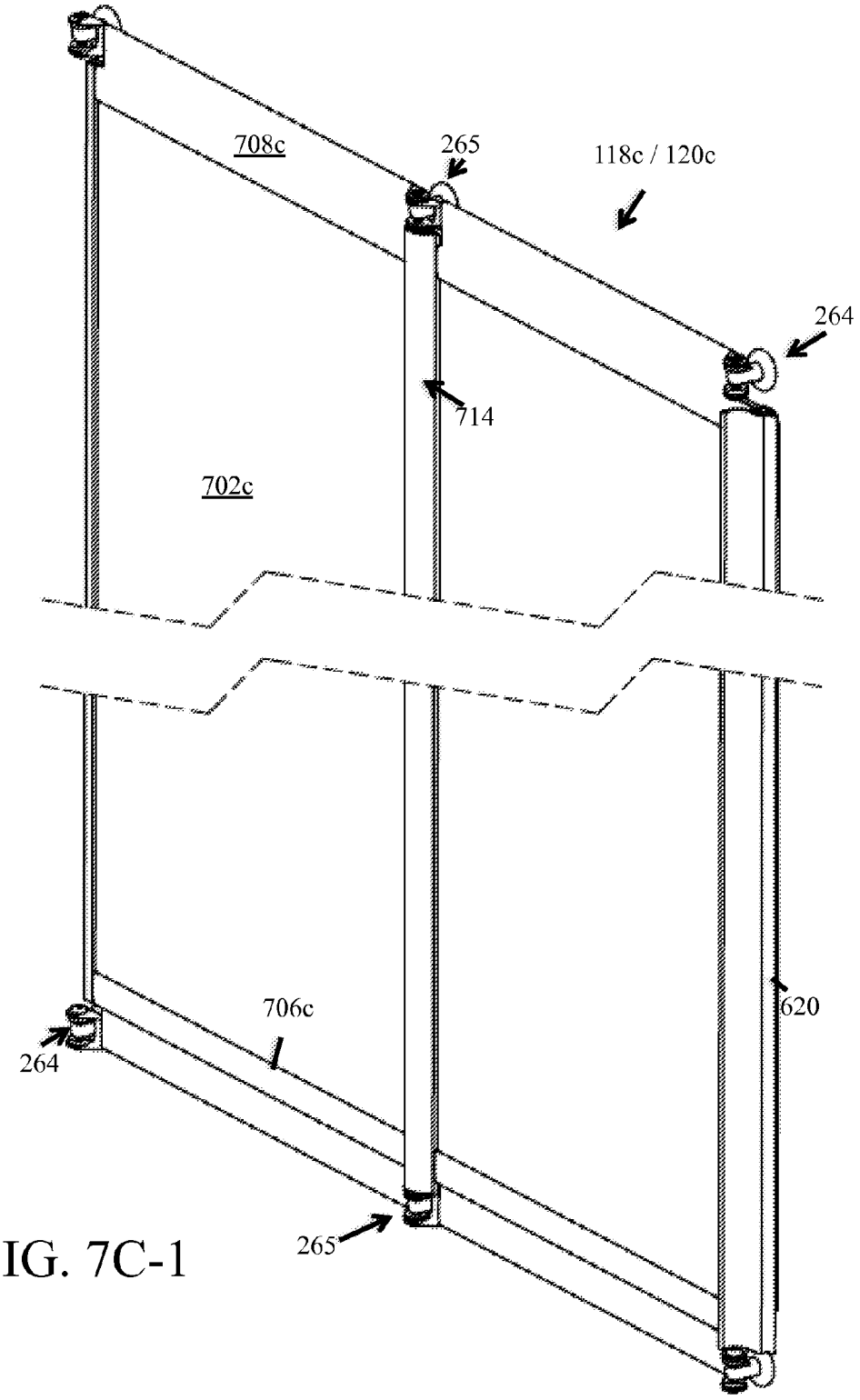
Figures 2, 7C:
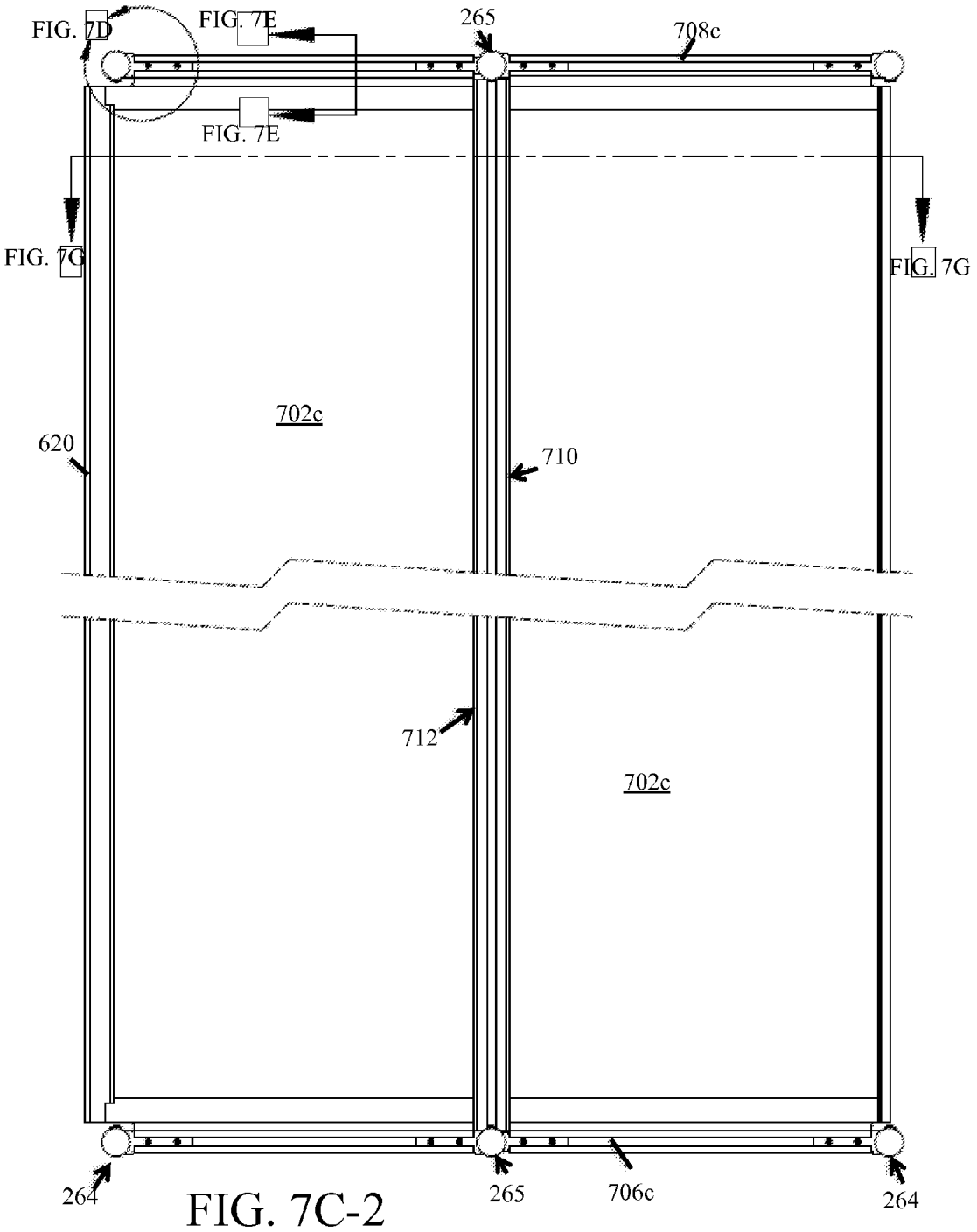

FIGS. 7A-1 to 7C-2 are non-limiting, exemplary illustrations of a non-stationary panel of enclosure system in accordance with the present invention. FIGS. 7A-1 and 7A-2 are non-limiting, exemplary illustrative views (inside and outside, respectively) of a non-stationary panel used with the inline enclosure shown in FIGS. 1A-1 to 1A-2. FIGS. 7B-1 and 7B-2 are non-limiting, exemplary illustrative views (inside and outside, respectively) of a non-stationary panel used with the Neo-Angle enclosure shown in FIGS. 1B-1 and 1B-2. FIGS. 7C-1 and 7C-2 are non-limiting, exemplary illustrative views (inside and outside, respectively) of a non-stationary panel used with the enclosure system shown in FIGS. 1C-1 and 1C-2.

As illustrated in FIGS. 7A-1 to 7C-2 and detailed below, in general, the non-stationary panels 118 and 120 include a transparent rigid material 702 (such as glass) that is framed on at least three sides and includes a first lateral frame that accommodates the stile 620. Further included are upper and lower frames 708 and 706 that allow coupling of different types of rollers 264/265 (detailed below).

Regarding the non-stationary panels 118*c* and 120*c* used in the adjoining configuration shown in FIGS. 7C-1 and 7C-2, the non-stationary panel 118*c* and 120*c* are juxtaposed adjacent one anther and articulate along the rails towards an adjoining wall from a fully closed position to a fully open position without substantial encroachment into an enclosing space. The non-stationary panel 118*c* and 120*c* are comprised of a frameless tethering side 710 and 712 that are positioned adjacent one another, and associated (coupled) by a flexible tether (bridging vinyl) 714 that extends longitudinally along an axial length of the non-stationary panels 118*c* and 120*c*, covering the frameless tethering sides 710 and 712 of both panels 118*c* and 120*c*.

Figure 7D:
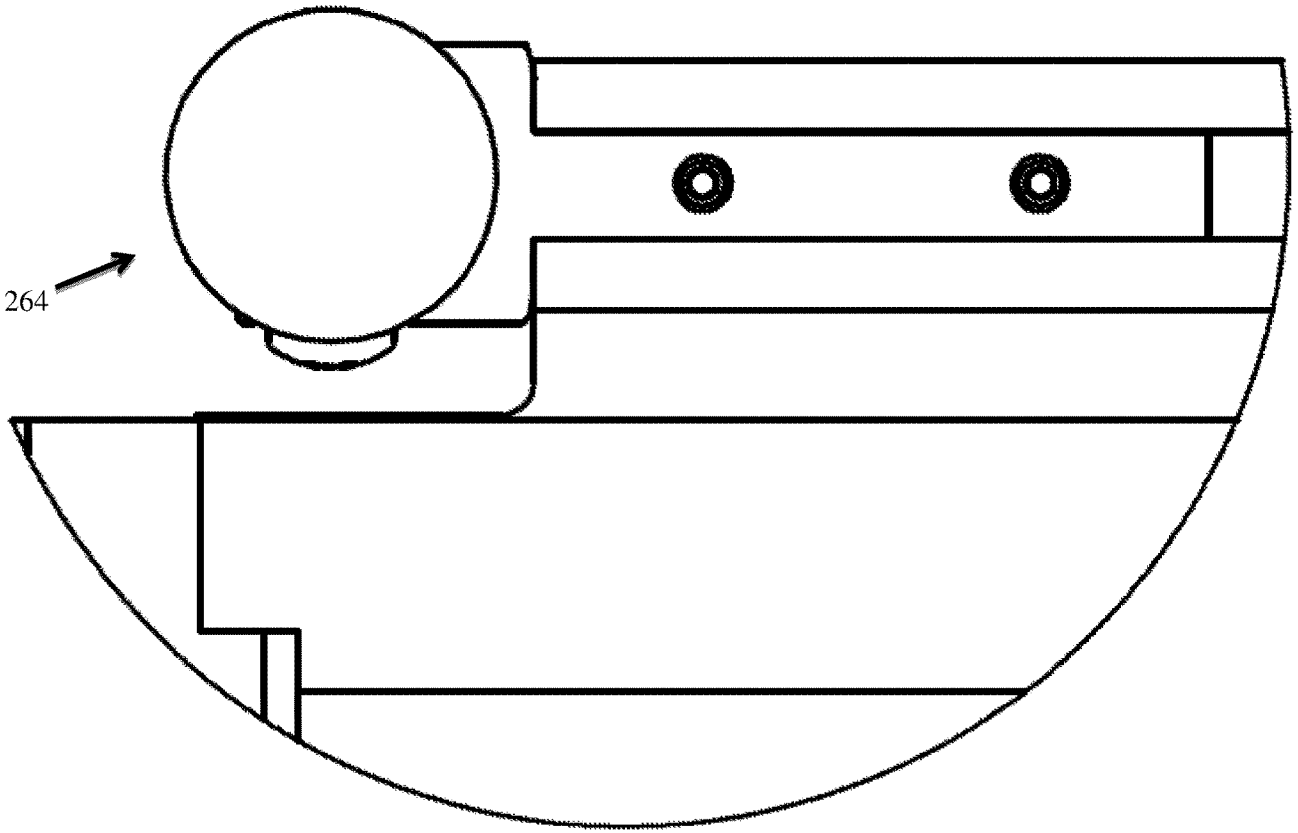

FIG. 7D is a non-limiting, exemplary illustrative enlarged view of a portion of the non-stationary panel shown in FIGS. 7A-2, 7B-2 and 7C-2, FIG. 7E is a non-limiting, exemplary illustrative sectional view of the non-stationary panels taken along the plane indicated in FIGS. 7A-2, 7B-2 and 7C-2, and FIGS. 7F and 7G are non-limiting, exemplary illustrative sectional views of the respective non-stationary panels for the neo-angle and adjoining configurations, taken along the plane indicated in FIGS. 7A-2, 7B-2 and 7C-2.

Figure 7E:
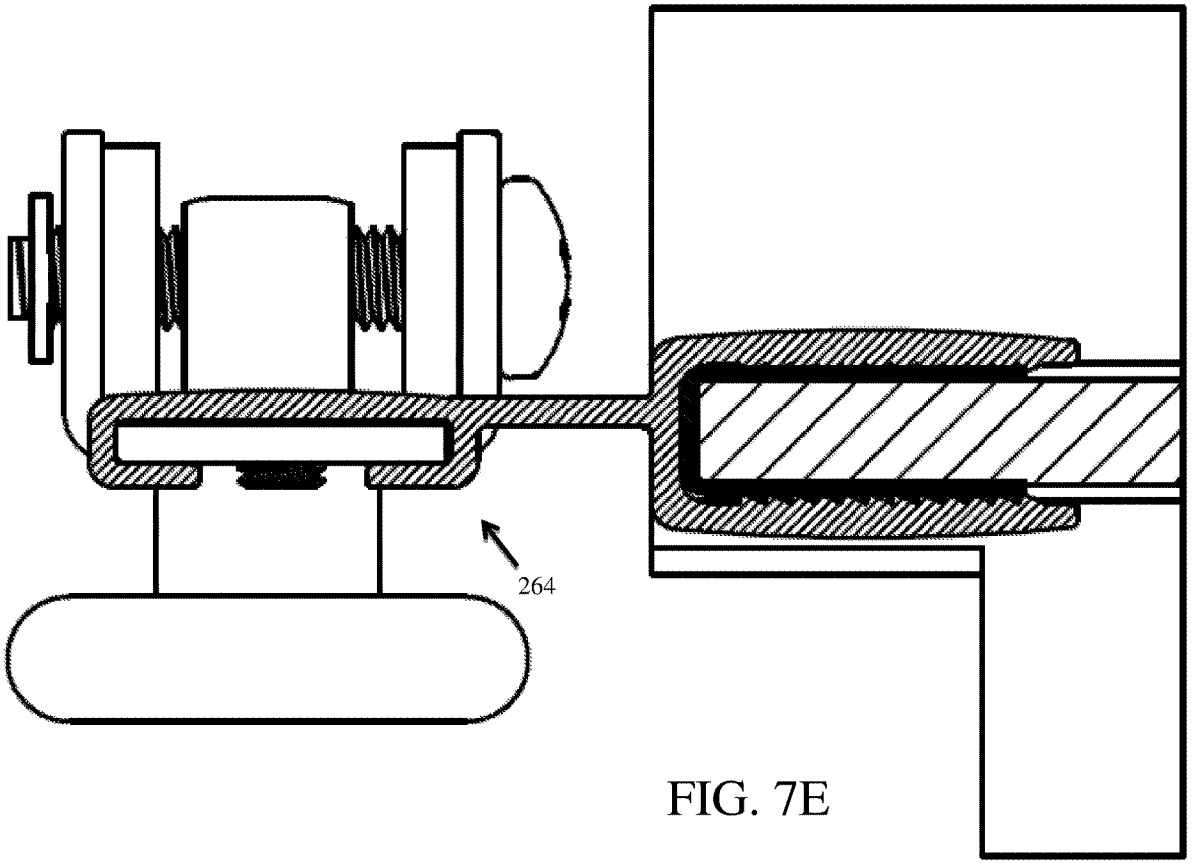
Figure 7F:
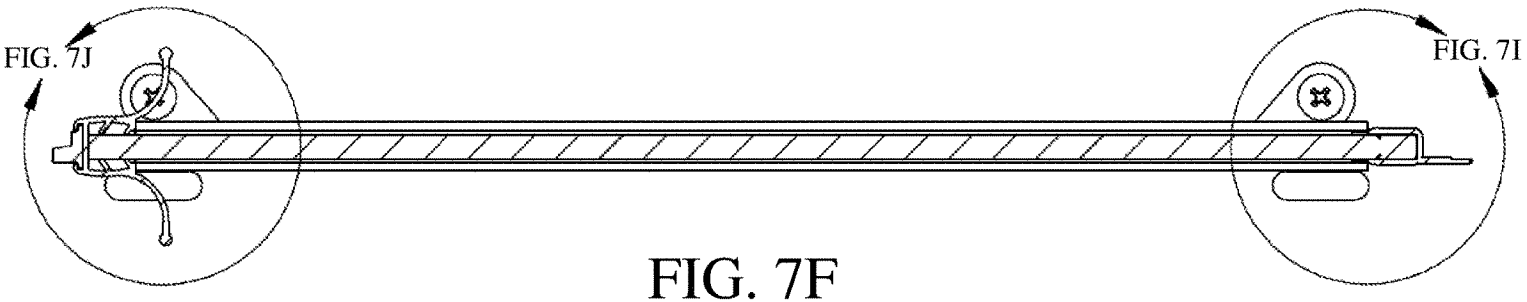
Figure 7G:
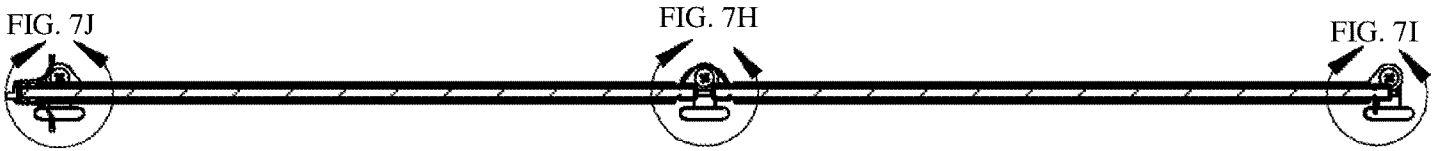
Figure 7H:
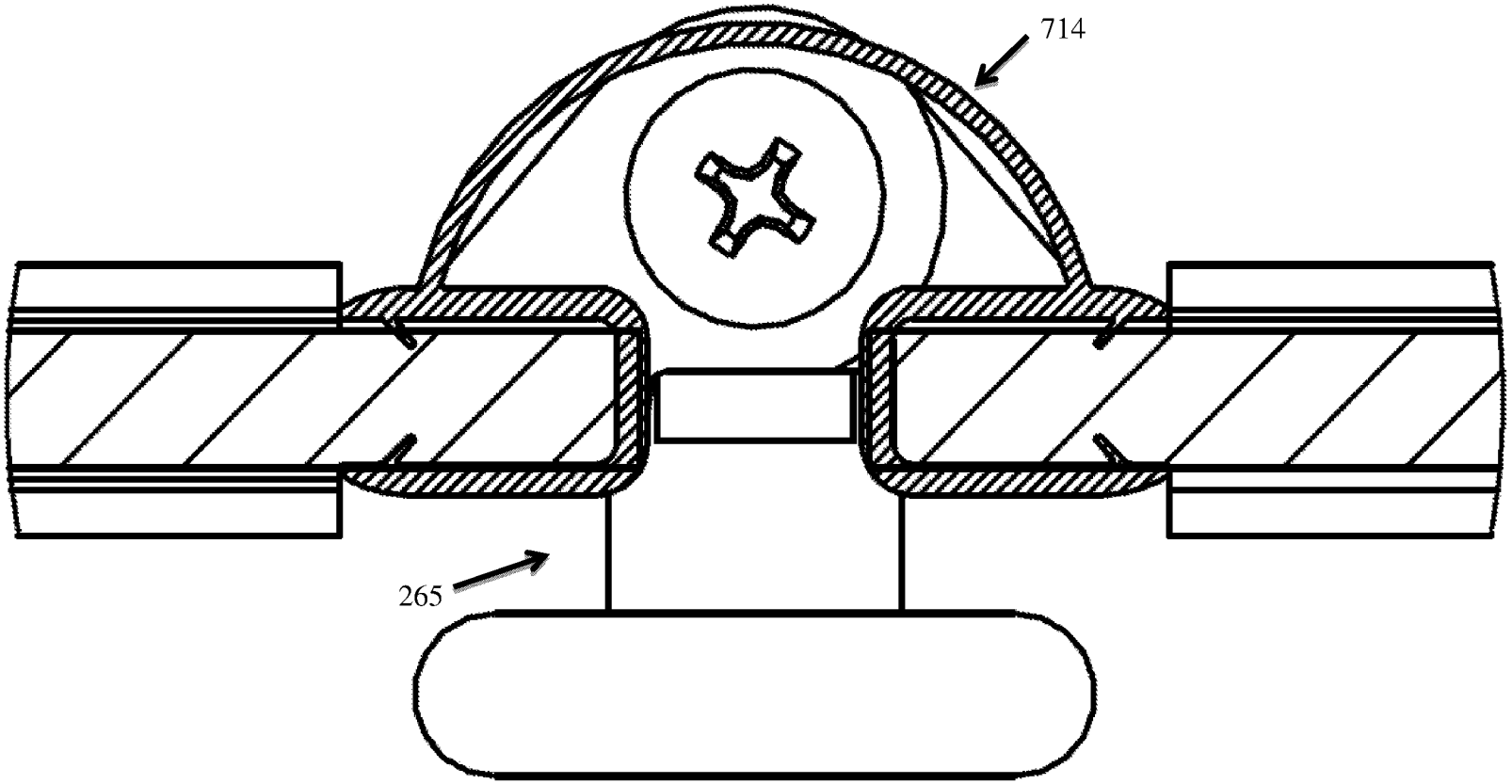
Figure 7I:
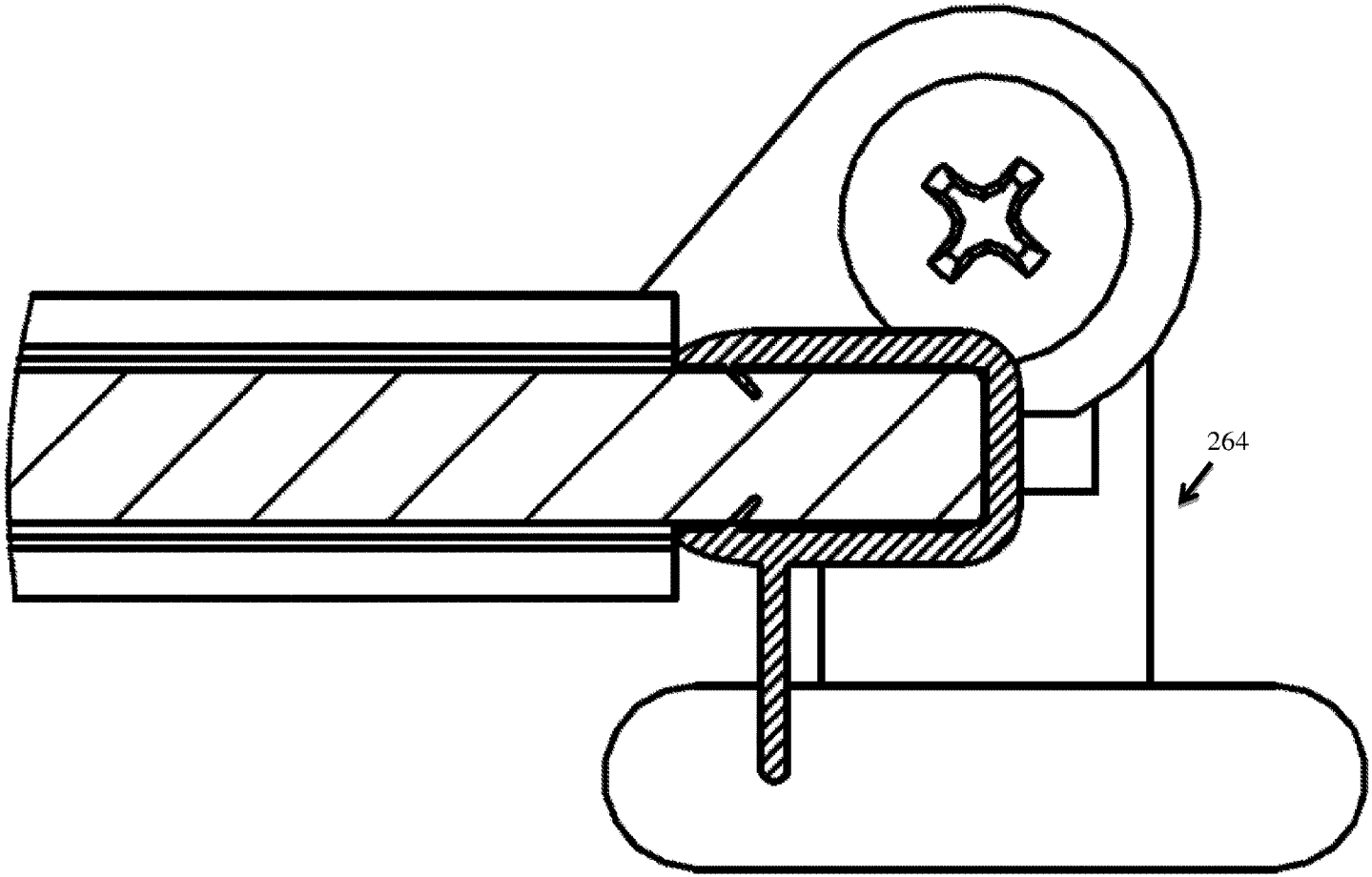
Figure 7J:
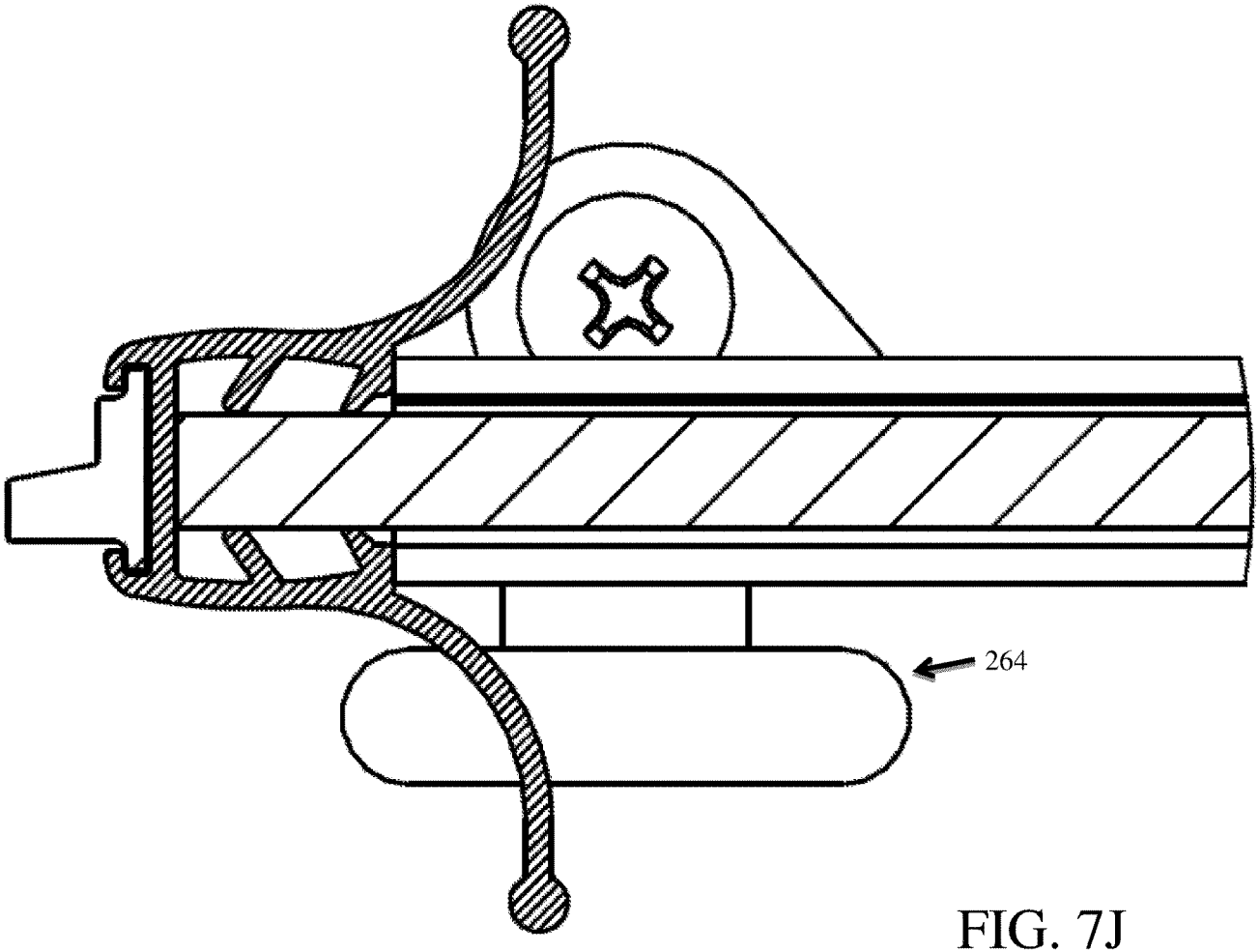

FIGS. 7D and 7E detail the relationship of distal rollers 264 in relation to the non-stationary panels 118 and 120. The distal rollers 264 are positioned at top and bottom distal ends of the non-stationary panels 118 and 120 with orientation that enables adjustments from inside the enclosed space. FIGS. 7H, 7I, and 7J are enlarged views of portions of the sectional views FIGS. 7F and 7G of the non-stationary panel, further illustrating the relationship between the rollers and the non-stationary panel. In particular, the FIG. 7H illustrates the hinge roller 265 and tether used between the non-stationary panels 118*c* and 120*c*.

Figure 8A:
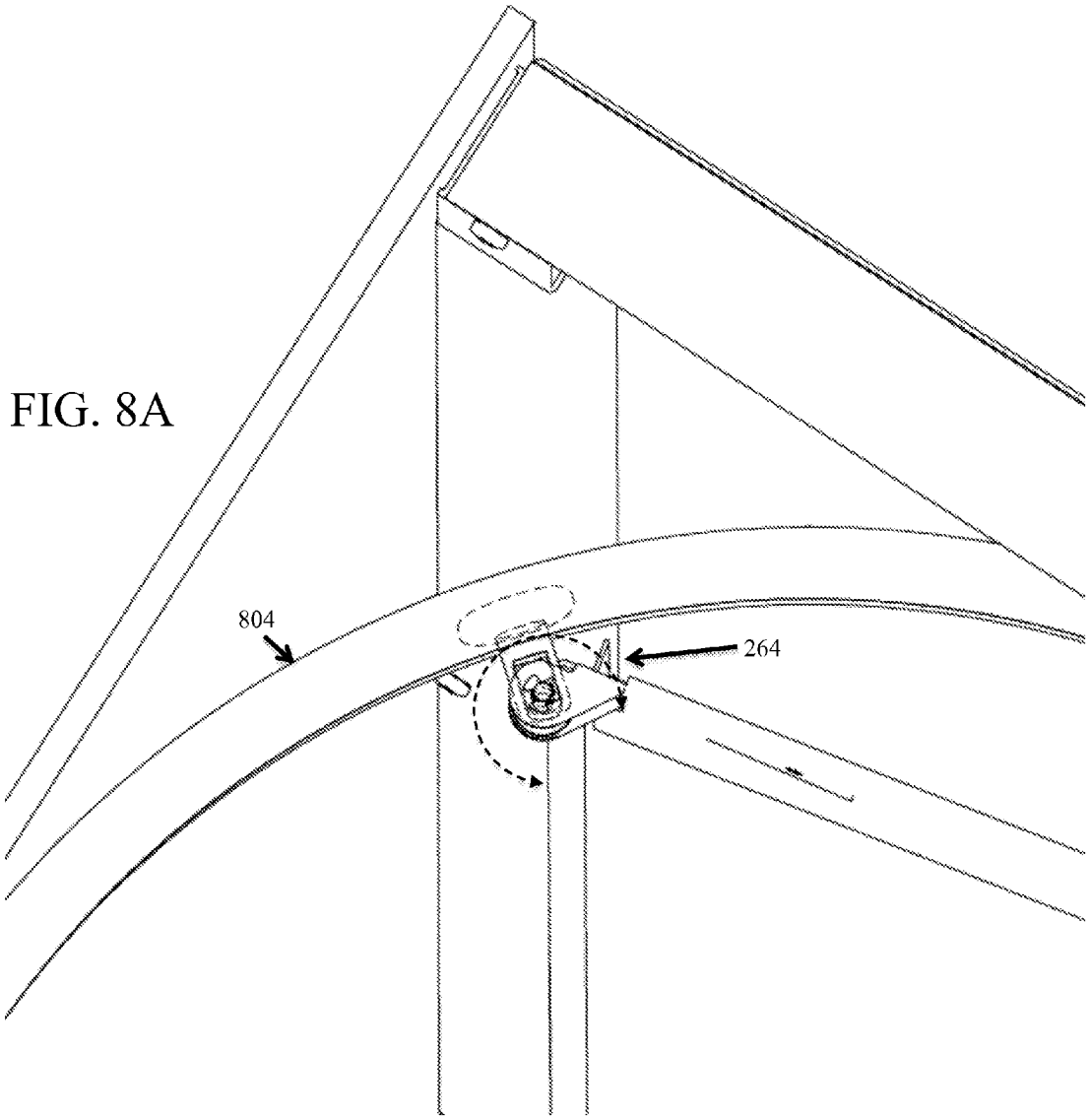
FIGS. 8A to 8L are non-limiting exemplary illustrations of various views of rollers in accordance with the present invention used with different types of enclosures.
Figure 8B:
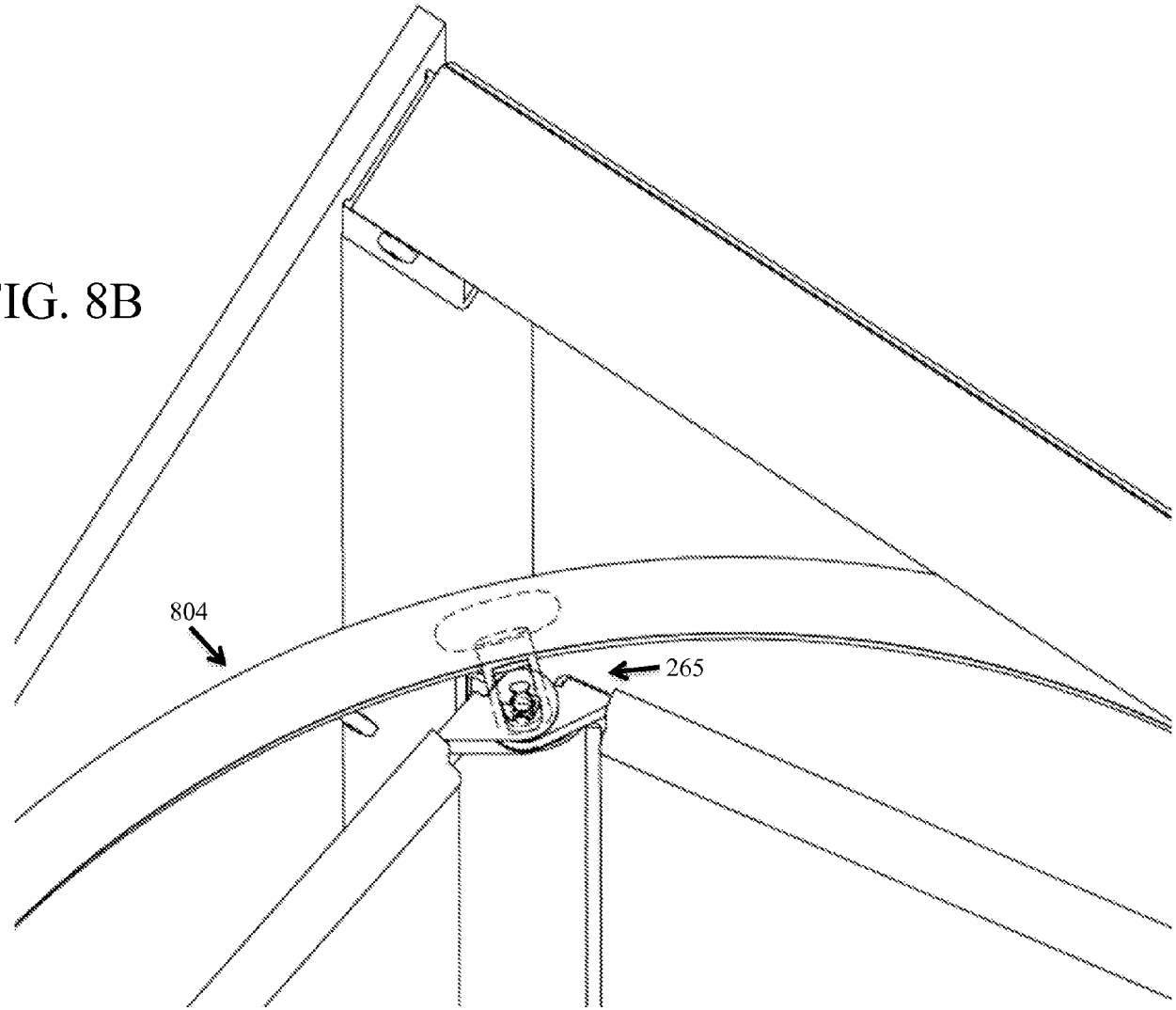
Figure 8C:
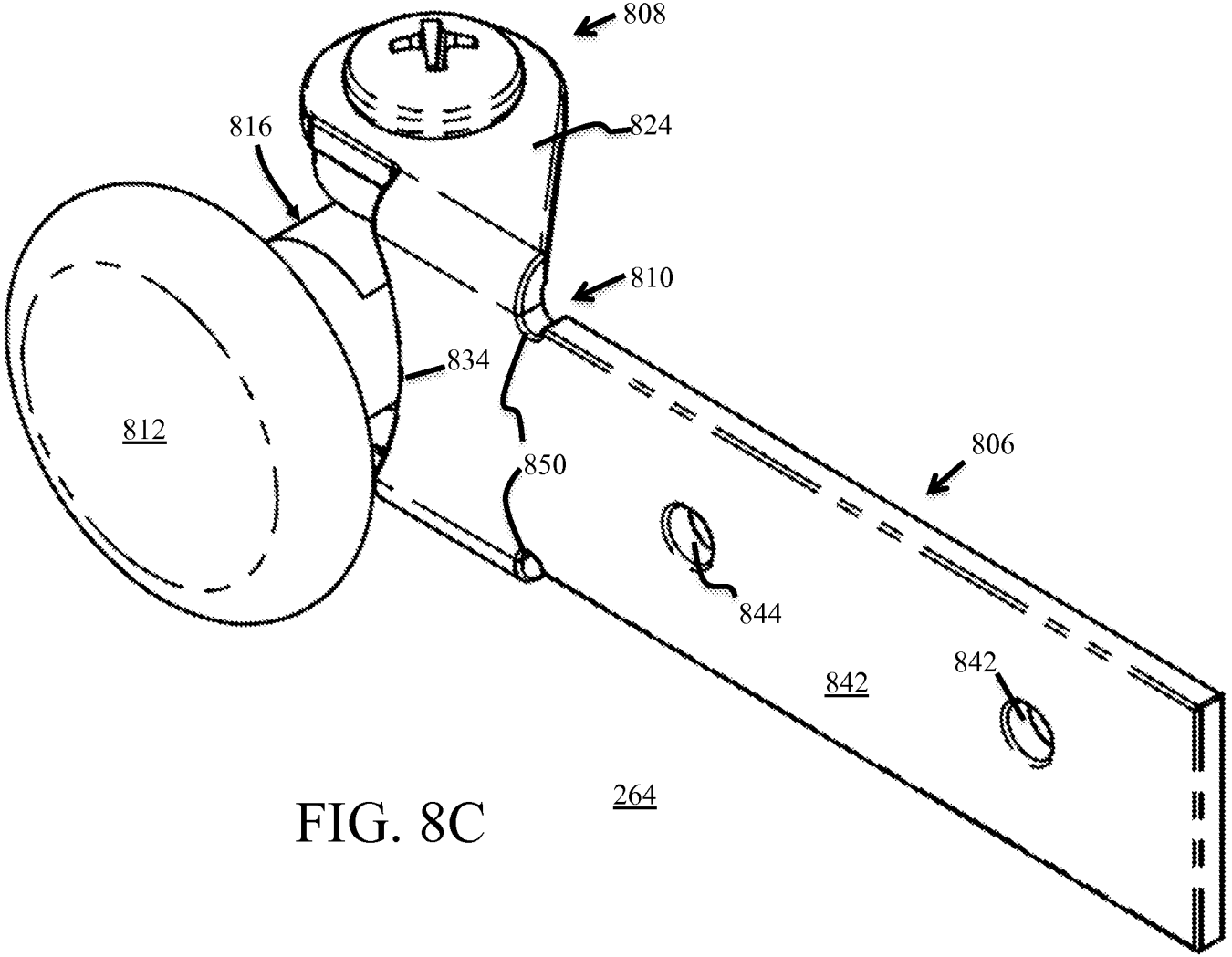
Figure 8D:
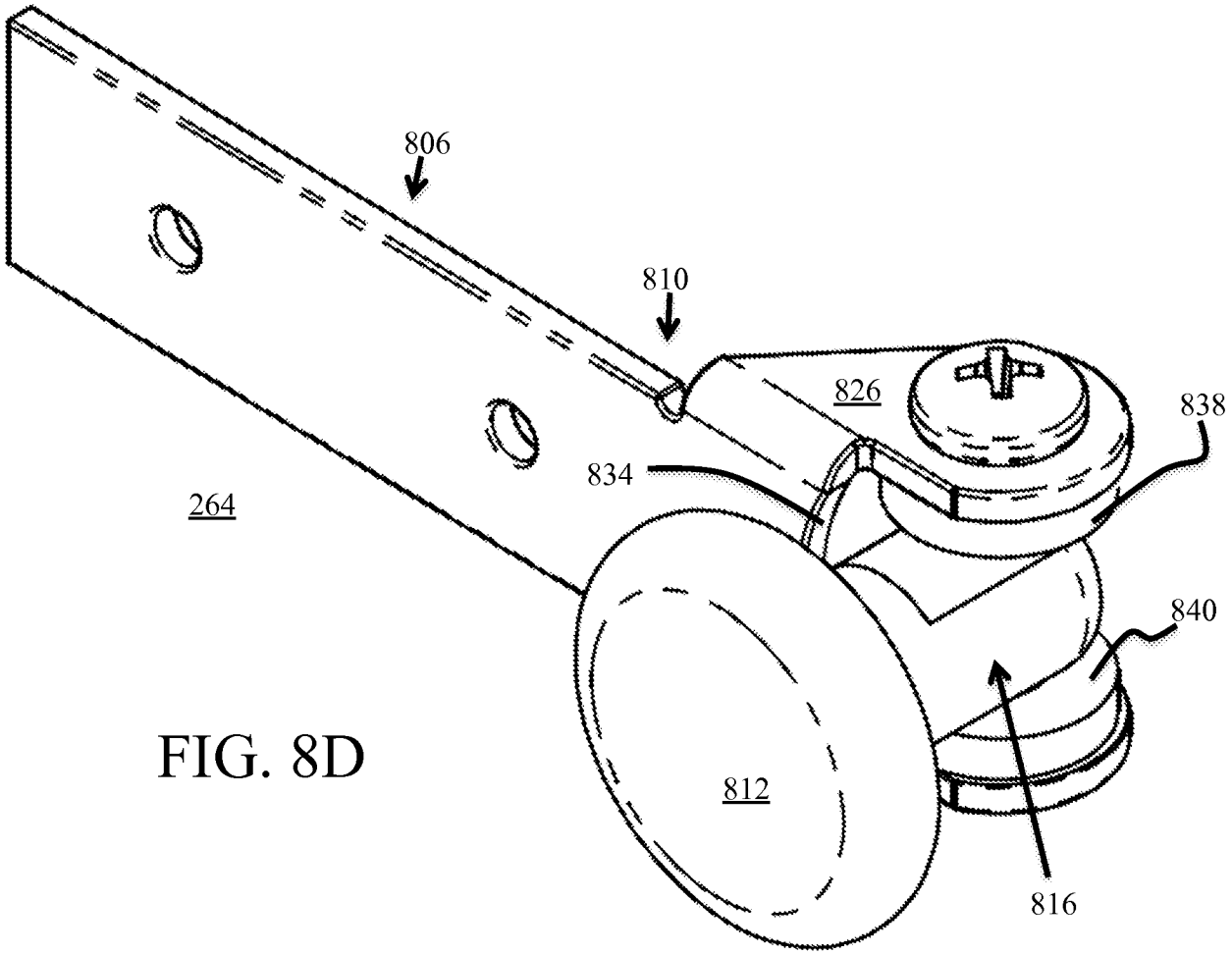
Figure 8E:
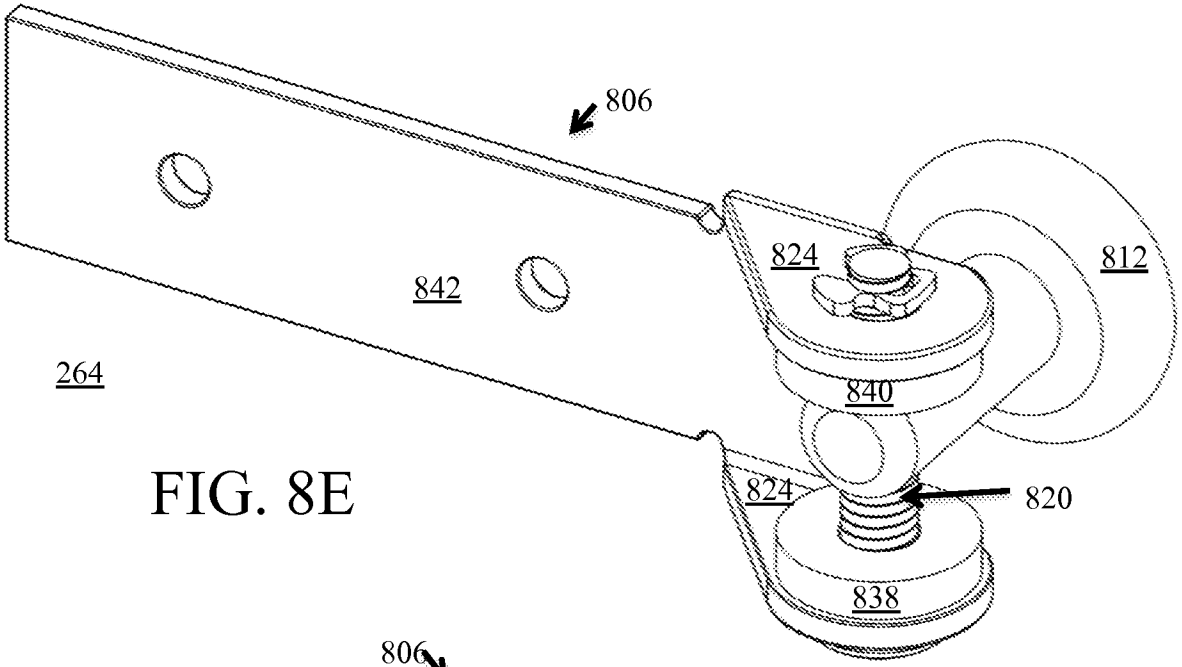
Figure 8F:
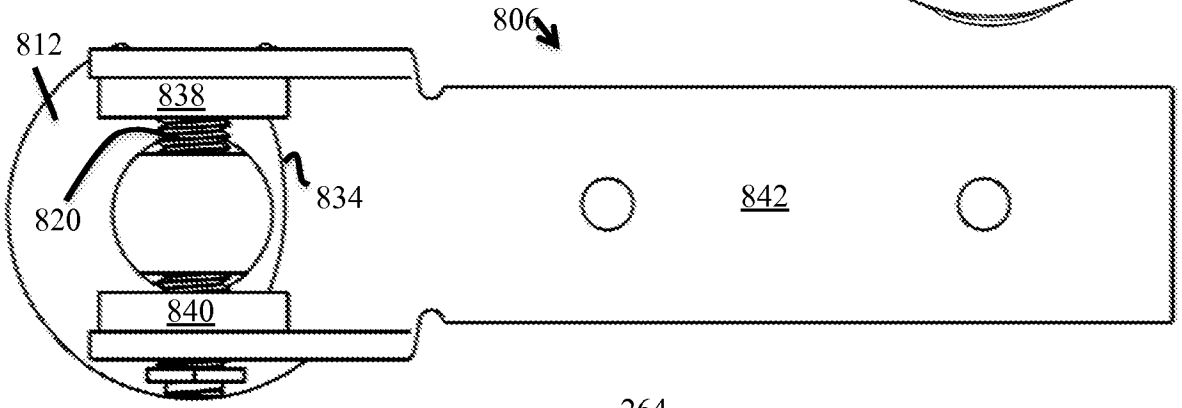
Figure 8G:
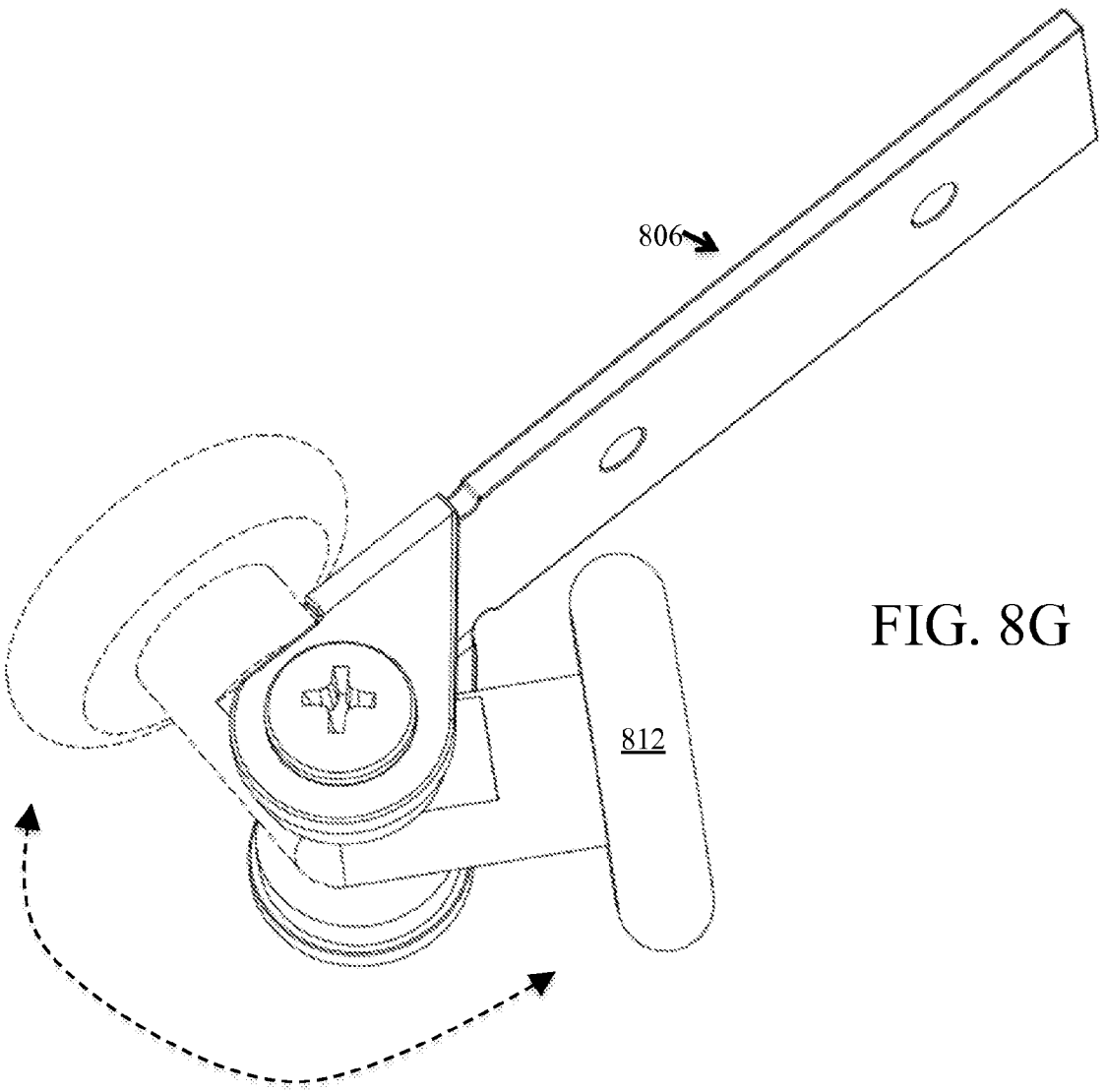

FIGS. 8A to 8L are non-limiting exemplary illustrations of various views of rollers in accordance with the present invention used with different types of enclosures. FIGS. 8A and 8B are non-limiting exemplary illustrations that show the distal and hinge rollers 264 and 265 during articulation along an extreme curved section 804 of a rail. The various elements that constitute the rollers 264 and 265 allow for such extreme maneuvering, which substantially reduces encroachment of the non-stationary panels into the enclosed space.

Figure 8H:
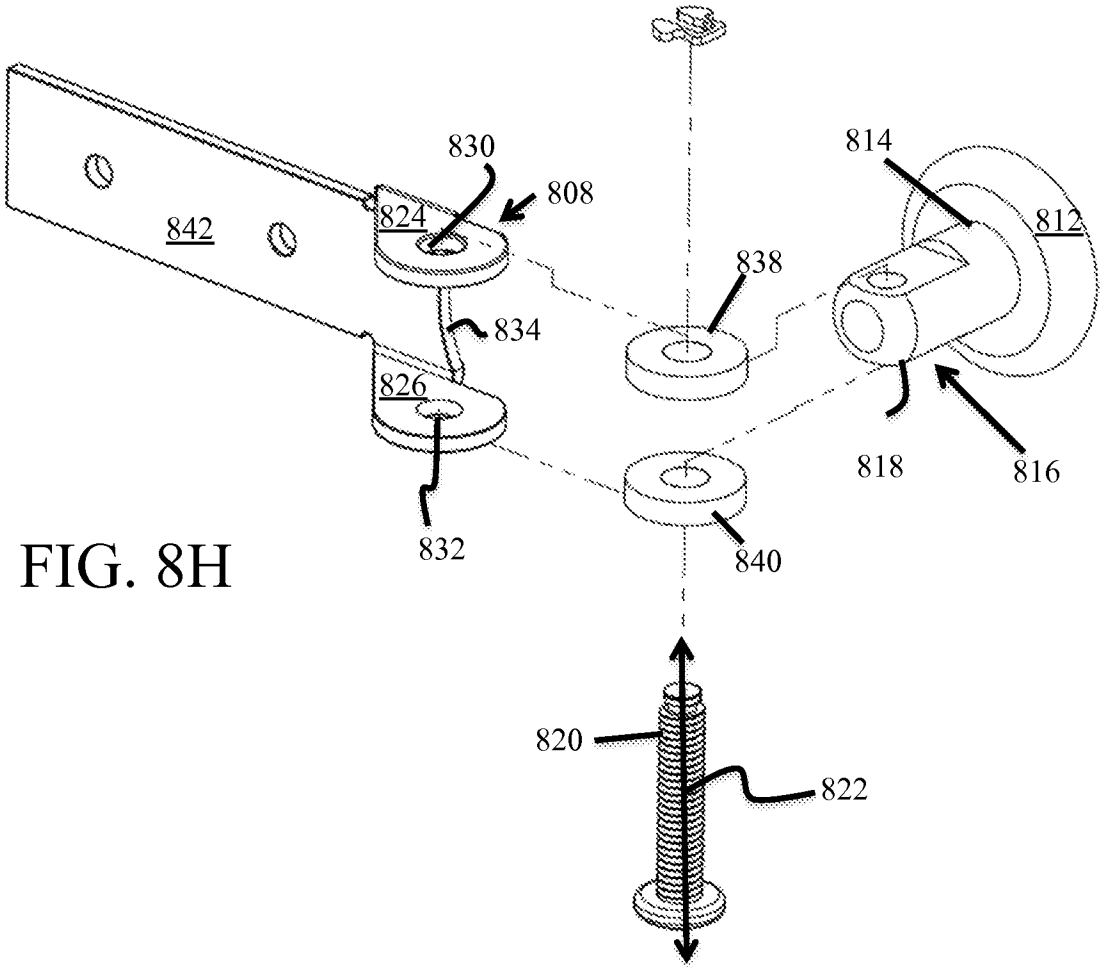
Figure 8I:
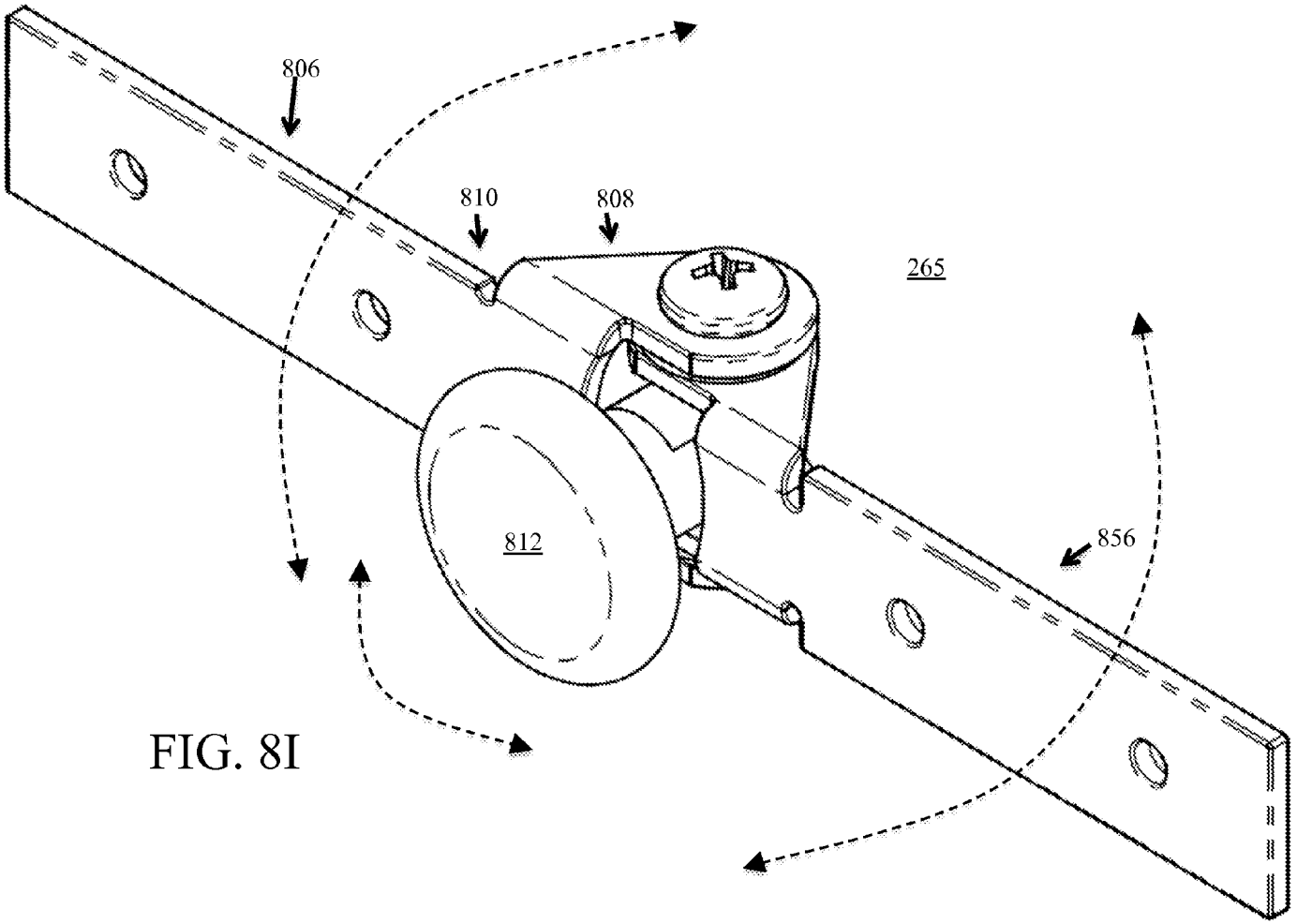
Figure 8J:
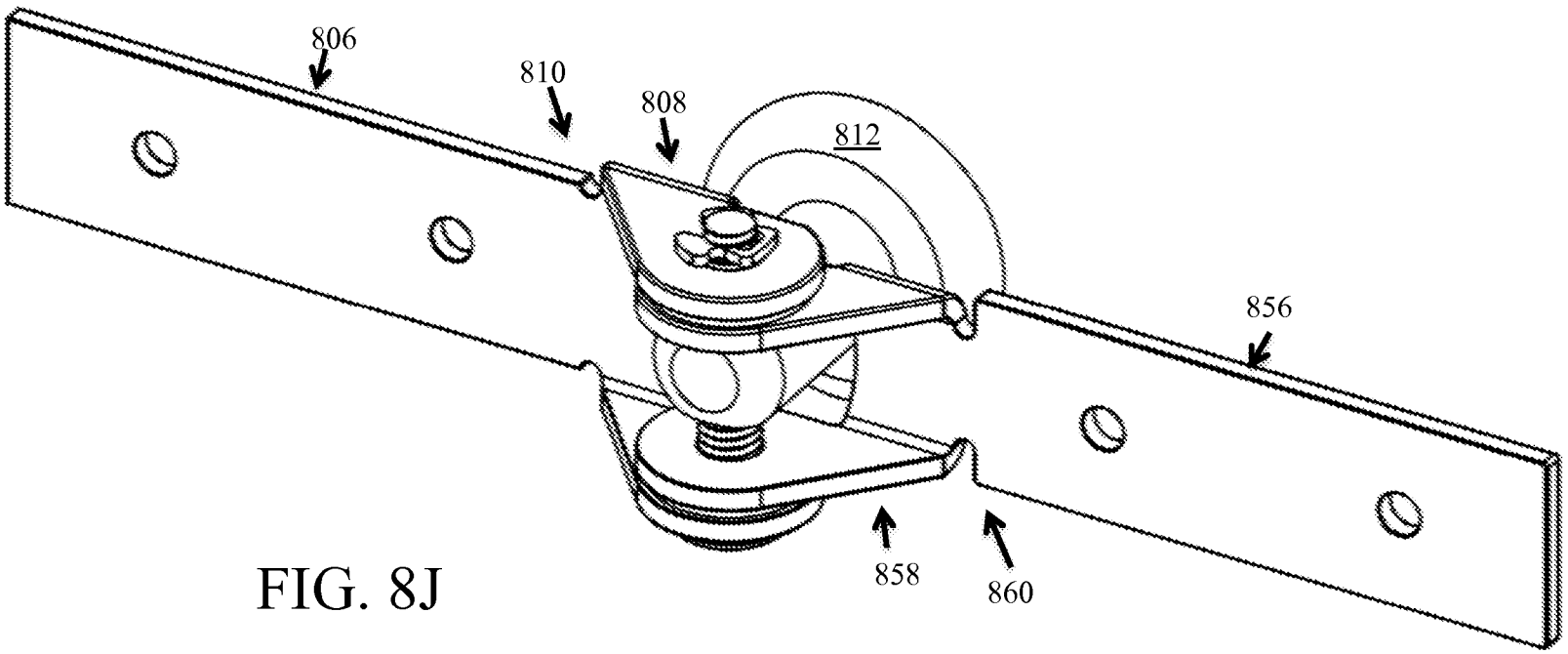
Figure 8K:
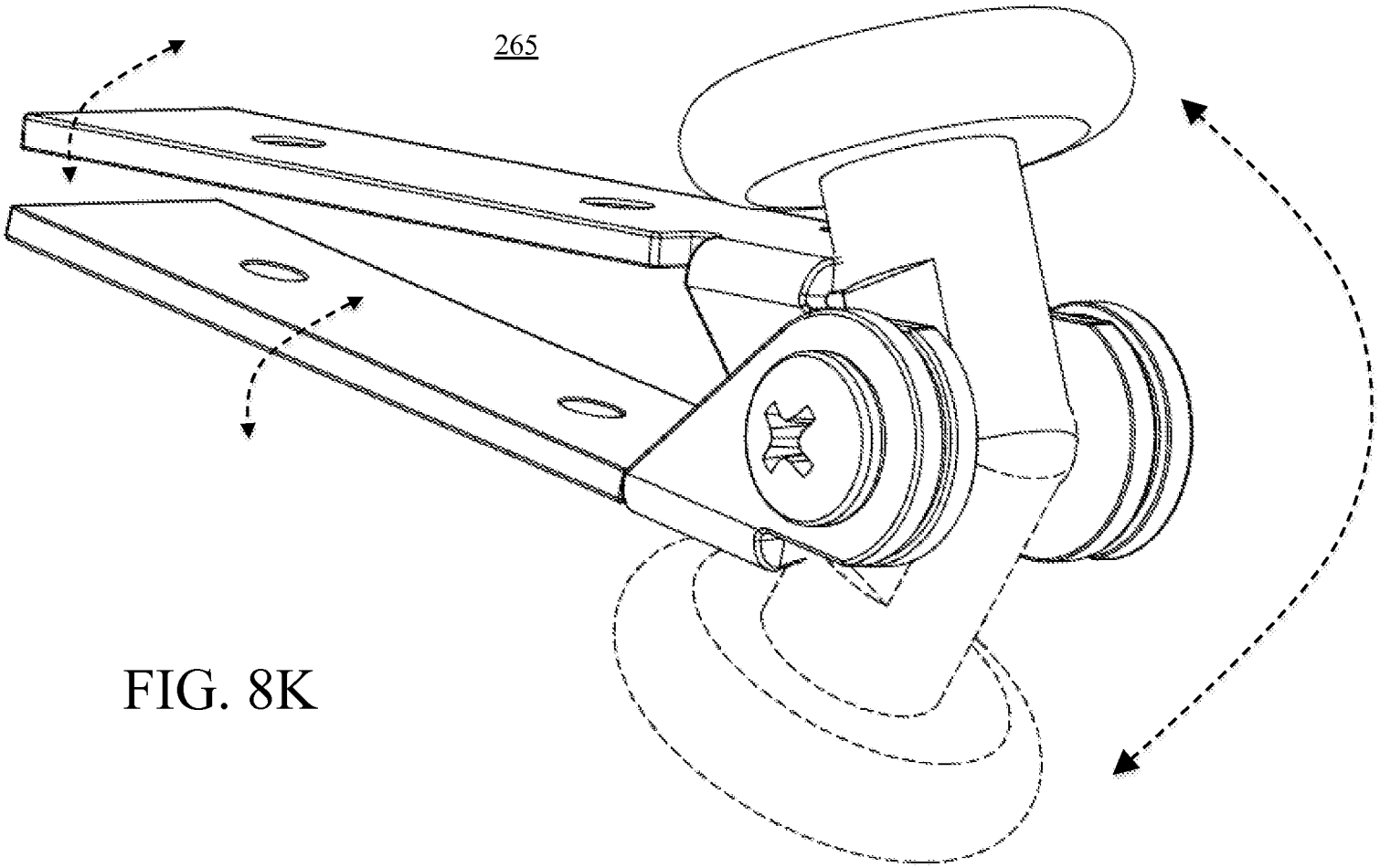
Figure 8L:
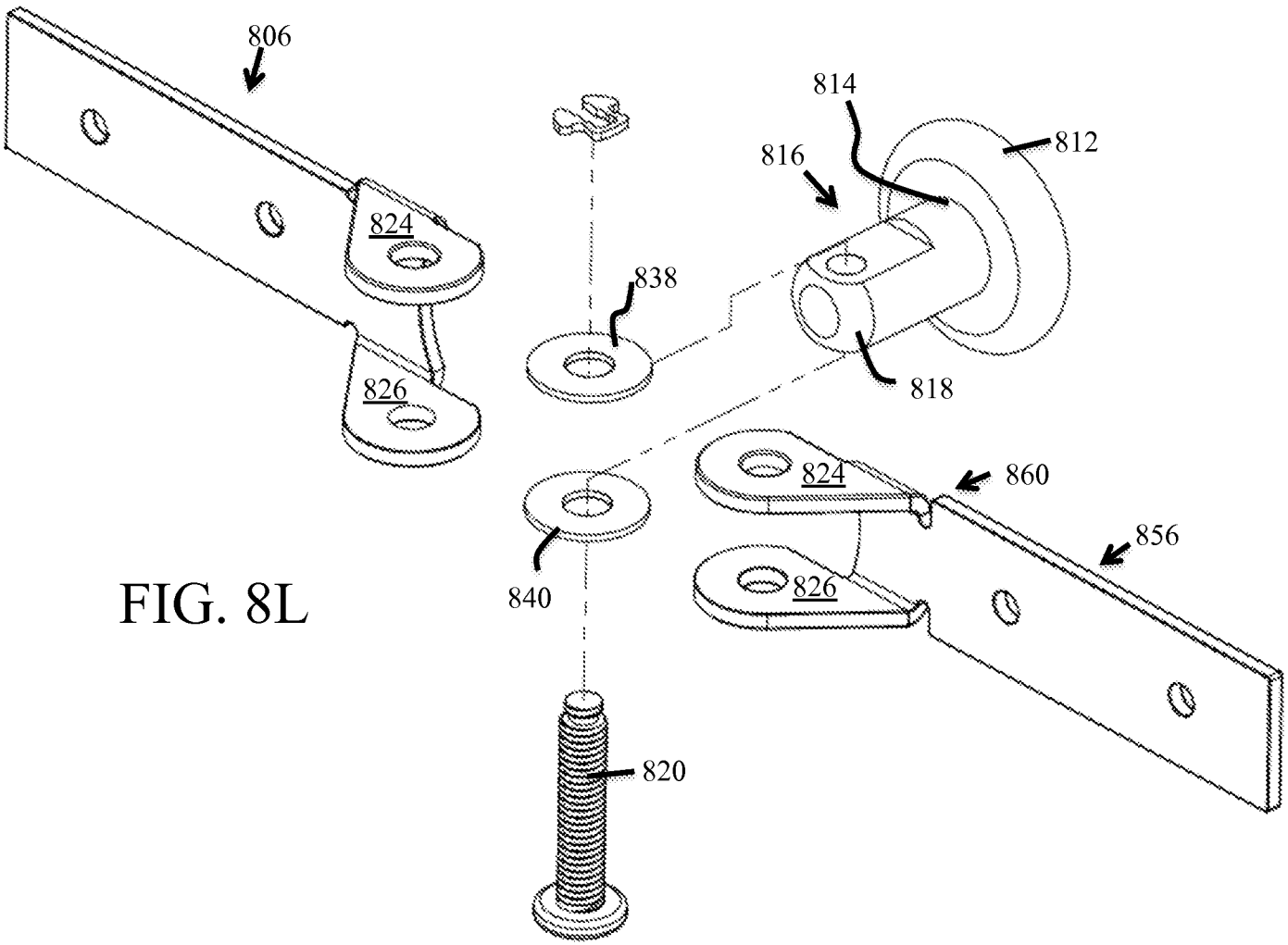

FIGS. 8A, and 8C to 8H are various views of the distal rollers 264 used at distal ends of non-stationary panels 118 and 120, with FIG. 8H illustrating an exploded view thereof. FIGS. 8B, and 8I to 8L are various views of the hinge rollers 802 used between non-stationary panels 118*c* and 120*c* (for the adjoining enclosure configuration), with FIG. 8L illustrating an exploded view thereof.

As illustrated in FIGS. 8A, and 8C to 8H, distal rollers 264 are comprised of bracket 806 that has a yoke 808 at an end 810 thereof. A wheel 812 is coupled with a first distal end 814 of an axle 816, with a second distal end 818 of the axle 816 coupled with the yoke 808 by a pivot-shaft 820. The bracket 806 includes a support section 842 that includes mounting mechanisms comprised of two apertures that receive a set of fasteners for securing the distal rollers 264 onto a structure such as a non-stationary panel 118 and 120 (e.g., FIG. 7D).

The support section 842 is inserted into a mounting channel of the non-stationary panels 118 and 120 and positioned at distal ends of the non-stationary panels 118 and 120. As the set fasteners (in the form of set screws) are tightened, they engage the back surface of the mounting channel, forcing the support section 842 to be pushed back against the inner face (towards the inside enclosed area) of the mounting channel and frictionally lock into position. A non-limiting example of manufacture of the bracket 806 is to use a stamping operation where the brackets 806 are stamped as a single piece unit, and then bent at a distal end to form the yoke 808. The stamping operation cuts out a small notch 850 from lateral sides of the bracket (forming "bending relief spots") to thereby facilitate bending the distal end 810 thereof into the yoke 808. The bend relief area 850 allows the support portion 842 of the bracket 806 to remain straight and not bend during the bending process when forming the yoke 808. The yoke extensions 824 and 826 have a sufficient span to allow for the above mentioned rotational degrees of the pivot-shaft 820.

In general, the pivot-shaft 820 includes an adjustment mechanism (threads) for vertically adjusting a position of the axle 816 along a longitudinal axis 822 of the pivot-shaft 820 within the yoke 808. A set of spacers 838 and 840 are used and positioned along the pivot-shaft 820 for preventing over-adjustments.

In general, the yoke 808 is comprised of a set of yoke extensions 824 and 826 with a set of aligned connection apertures 830 and 832 for accommodating the pivot-shaft 820. The pivot-shaft 820 is inserted through the second distal end 818 of the axle 816 and the aligned connection apertures 830 and 832, forming a pivot axis about which the axle 816 rotates, and only to be stopped by a crossbar section 834 of the yoke 808.

Accordingly, the wheel 812 and the axle 816 are coupled with the bracket 806 by the pivot-shaft 820 so that the wheel 812 rotates in relation to the axle 816, the axle 816 pivots in relation to the pivot-shaft 820, and the bracket 806 rotates in relation to the pivot-shaft 820.

As indicated above, FIGS. 8B, and 8I to 8L are various views of a hinge roller 265 in accordance with the present invention. The hinge roller 265 (shown in FIGS. 8B, and 8I to 8L) includes similar corresponding or equivalent components, interconnections, and or cooperative relationships as the distal roller 264 that is shown in FIGS. 8A, and 8C to 8H, and described above. Therefore, for the sake of brevity, clarity, convenience, and to avoid duplication, the general description of FIGS. 8B, and 8I to 8L will not repeat every corresponding or equivalent component and or interconnections that has already been described above in relation to distal rollers 264 that is shown in FIGS. 8A, and 8C to 8H.

As illustrated in FIGS. 8B, and 8I to 8L, hinge rollers 265 are comprised of similar constructions as those of distal rollers 264 in that the hinge rollers 265 include a first bracket 806 that has a first yoke 808 at first end 810 thereof, but the hinge rollers 265 further include a second bracket 856 that has a second yoke 858 at a first end 860 of the second bracket 856. The first and second brackets 806 and 856 pivot in relation to the pivot-shaft 820. In general, the first yoke 808 has a wider span than the second yoke 858, with the second yoke 858 positioned within the first yoke 808.

In general, the first bracket 806 is associated with a first structure (e.g., non-stationary panel 118*c*) and the second bracket 856 is associated with a second structure (e.g., non-stationary panel 120*c*), with the first structure 118*c* moving in relation to the second structure 120*c* in accordance with the motion of respective first and second brackets 806 and 856 in relation to the pivot-shaft 820.

As with the distal rollers 264, the hinge rollers 265 also include a wheel 812 that is coupled with a first distal end 814 of an axle 816, with a second distal end 818 of the axle is coupled with the first and second yokes 806 and 858 by an pivot-shaft 820. The pivot-shaft 820 is inserted through the second distal end 818 of the axle 816 forming a pivot axis about which the axle 816 rotates, enabling the first and second brackets 806 and 856 to rotate. Accordingly, the hinge-rollers couple the non-stationary panels 118*c* and 120*c*, and a first and a second distal rollers are positioned at top and bottom distal ends of the non-stationary panels 118*c* and 120*c* with orientation that enables vertical adjustments of the rollers from inside the enclosed space. More particularly, the hinge roller 265 couples the frameless tethering sides 710 and 712 of the non-stationary panels 118*c* and 120*c* at top and bottom distal ends thereof, with top distal and bottom distal corners of the first and second non-stationary panels 118*c* and 120*c* coupled with distal rollers 264. The hinge rollers 265 directly couple between the two panels (their tethering side) and function as a hinge. This also eliminates the need for vertical aluminums on the tethering edge of the glass door panels.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the inline enclosure illustrated in FIGS. 1A-1 and 1A-2 may use most types of conventional rollers. The various aspects, feature, and advantages of the present invention are equally applicable to other enclosures, non-limiting example of which may include corner unit enclosures. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. An enclosure, comprising:

a sill that includes a drainage system having:

a spill channel that has a first barrier and a second barrier;

the second barrier is positioned below the spill channel and faces a lower distal end of an exterior side of a stationary panel, with a non-stationary panel facing an interior side of the stationary panel.

2. The enclosure as set forth in claim 1, wherein:

the sill further includes exterior and interior support portions that accommodate jambs at distal ends of the sill, with the interior support further including a stationary panel support upon which a stationary panel rests.

3. An enclosure, comprising:

a sill that includes a drainage system that is comprised of:

a spill channel defined by an exterior side of a stationary panel in relation to a spill guide and a first barrier, forming the spill channel that redirects leaked fluid blocked by the first barrier for draining the leaked fluid;

a lower distal end of the exterior side of the stationary panel faces a second barrier, with the second barrier further blocking fluid and redirecting the leaked fluid drained from the spill channel and back into an enclosed space, with a non-stationary panel facing an interior side of the stationary panel.

4. The enclosure as set forth in claim 3, wherein:

the sill further includes:

an exterior portion that accommodates an exterior fin of a jamb; and an interior portion that accommodates an interior fin of the jamb.

5. The enclosure as set forth in claim 4, wherein:

the exterior portion includes an exterior flange upon which the exterior fin rests;

the interior portion includes an interior flange upon which the interior fin rests.

6. The enclosure as set forth in claim 4, wherein:

the sill further includes a stationary panel support upon which a stationary panel rests.

7. The enclosure as set forth in claim 6, wherein:

the stationary panel includes:

a lateral frame member that is associated with the interior and middle fins of the jamb.

8. The enclosure as set forth in claim 3, wherein:

the enclosure is capable of being installed as one of left or right handed unit.

9. The enclosure as set forth in claim 3, wherein:

the sill further includes:

an interior portion that accommodates the lower distal end of the stationary panel;

with the sill further including a stationary panel support upon which a stationary panel rests.

10. The enclosure as set forth in claim 9, wherein:

the stationary panel includes:

a lateral frame member that is associated with one or more fin of a jamb.

11. The enclosure as set forth in claim 9, wherein:

the sill further accommodates a fin of a jamb.

12. An enclosure, comprising:

one or more rollers;

a roller of one or more rollers is comprised of:

one or more bracket that has a yoke at an end thereof;

a wheel that is coupled with a first distal end of an axle, with a second distal end of the axle coupled with the yoke by a pivot-shaft;

the one or more bracket includes mounting mechanism for securing the roller onto one or more structures, with the pivot-shaft positioned on an interior side of the one or more structures.

13. The enclosure as set forth in claim 12, wherein:

the pivot-shaft includes an adjustment mechanism for adjusting a position of the axle along a longitudinal axis of the pivot-shaft.

14. The enclosure as set forth in claim 12, wherein:

the wheel and the axle are coupled with the one or more bracket by the pivot-shaft so that the wheel rotates in relation to the axle, the axle pivots in relation to the pivot-shaft, and the one or more bracket rotates in relation to the pivot-shaft.

15. The enclosure as set forth in claim 12, wherein:

the yoke is comprised of a set of yoke extensions with a set of aligned connection apertures for accommodating the pivot-shaft.

16. The enclosure as set forth in claim 15, wherein:

the pivot-shaft is inserted through the second distal end of the axle and the aligned connection apertures, forming a pivot axis about which the axle rotates.

17. The enclosure as set forth in claim 12, wherein:

the one or more brackets include:

a first bracket that has a first yoke at first end thereof;

a second bracket that has a second yoke at a first end of the second bracket;

with the first and second bracket pivoting in relation to the pivot-shaft.

18. The enclosure as set forth in claim 17, wherein:

the first yoke has a wider span than the second yoke.

19. The enclosure as set forth in claim 17, wherein:

the first bracket is associated with a first structure and the second bracket is associated with a second structure.

20. The enclosure as set forth in claim 19, wherein:

the first structure moves in relation to the second structure in accordance with the motion of respective first and second brackets in relation to the pivot-shaft.

21. An enclosure, comprising:

a sill that includes a drainage system that is comprised of:

a spill channel defined by an exterior side of a stationary panel in relation to a spill guide and a first barrier, forming the spill channel that redirects leaked fluid blocked by the first barrier for draining the leaked fluid;

a lower distal end of the exterior side of the stationary panel faces a second barrier, with the second barrier further blocking fluid and redirecting the leaked fluid drained from the spill channel and back into an enclosed space;

the sill further includes:

an exterior portion that accommodates an exterior fin of a jamb; and an interior portion that accommodates an interior fin of the jamb;

wherein:

the exterior portion includes an exterior flange upon which the exterior fin rests; and the interior portion includes an interior flange upon which the interior fin rests.

22. An enclosure, comprising:

a sill that includes a drainage system having:

a spill channel that has a first barrier and a second barrier;

the second barrier is positioned below the spill channel and faces a lower distal end of an exterior side of a stationary panel; and the stationary panel is associated with at least two fins of a wall jamb.

* * * * *